US012292234B1

(12) United States Patent
Anthony

(10) Patent No.: US 12,292,234 B1
(45) Date of Patent: May 6, 2025

(54) HUMIDIFICATION AND DEHUMIDIFICATION PROCESS AND APPARATUS FOR CHILLING BEVERAGES AND OTHER FOOD PRODUCTS AND PROCESS OF MANUFACTURE

(71) Applicant: Michael Mark Anthony, Athens, AL (US)

(72) Inventor: Michael Mark Anthony, Athens, AL (US)

( * ) Notice: Subject to any disclaimer, the term of this patent is extended or adjusted under 35 U.S.C. 154(b) by 200 days.

(21) Appl. No.: 17/803,419

(22) Filed: Jun. 27, 2022

Related U.S. Application Data

(62) Division of application No. 15/932,483, filed on Mar. 5, 2018, now Pat. No. 11,371,767.

(51) Int. Cl.
*F25D 5/02* (2006.01)
*F25D 31/00* (2006.01)

(52) U.S. Cl.
CPC ..... *F25D 5/02* (2013.01); *F25D 31/007* (2013.01); *F25D 2317/0413* (2013.01); *F25D 2317/043* (2013.01); *F25D 2321/147* (2013.01); *F25D 2331/805* (2013.01); *F25D 2331/809* (2013.01)

(58) Field of Classification Search
None
See application file for complete search history.

(56) References Cited

U.S. PATENT DOCUMENTS

2010/0251731 A1* 10/2010 Bergida ..... B65D 17/4012 220/592.2
2012/0144845 A1* 6/2012 Leavitt ..... F25D 5/02 62/4
2013/0174581 A1* 7/2013 Rasmussen ..... F25D 5/02 62/4

* cited by examiner

*Primary Examiner* — Henry T Crenshaw
(74) *Attorney, Agent, or Firm* — Frank L. Kubler

(57) ABSTRACT

A novel self-cooling food product container apparatus (10) and a process for manufacturing the same is disclosed. A self-cooling food product container (20) combined with a substantive vapor transport system producing a humidification cooling process for cooling food and beverage products P. Methods of assembling and operating the apparatus (10) are also provided.

13 Claims, 24 Drawing Sheets

HUMIDIFICATION AND DEHUMIDIFICATION PROCESS AND APPARATUS FOR CHILLING BEVERAGES AND OTHER FOOD PRODUCTS AND PROCESS OF MANUFACTURE

FILING HISTORY

This application is a divisional of application Ser. No. 15/932,483, filed on Mar. 5, 2018.

BACKGROUND OF THE INVENTION

1. Field of the Invention

The present novel invention relates generally to the art of cooling food and beverage food product containers and to processes for manufacturing such food product containers. More specifically the present invention relates to food and beverage food product containers for cooling a food product such as a beverage; methods of cooling said food products; and methods of assembling and operating the apparatus. The terms "beverage," "food," "food products" and "food product container contents" are considered as equivalent for the purposes of this application and used interchangeably. The term "food product container" refers to any sealed and openable storage means for a food product meant for consumption.

2. Description of the Prior Art

There previously have been many self-cooling beverage food product container devices for cooling the contents of a beverage or other food beverage food product container. These devices sometimes use flexible and deformable receptacles or rigid receptacle sides to store a refrigerant for phase change cooling. Some prior art devices use desiccants with a vacuum activated to evaporate water at low pressure and absorb vapor into a desiccant. Other prior devices use refrigerants stored between pressure vessels in liquid phase to achieve the cooling by causing a phase change of refrigerants from a liquid to a gaseous state. The present inventor has invented a variety of such devices and methods of manufacturing them. Several prior self-cooling food product container technologies rely on the evaporation of a refrigerant from the liquid phase to the gaseous phase. Some rely on desiccants only. Desiccant technologies rely the thermodynamic potential of a desiccant to absorb water from a gaseous phase into the desiccant to effectuate the evaporation of water in a vacuum. These earlier inventions do not satisfy all the needs of the beverage industry and they do not use electromotive heat transport means to cool a beverage. In fact, they are so structurally different from the present invention, that one skilled in the art cannot possibly transcend from the prior art to the present invention without an inventive process. In an effort to seek a cost effective and functioning apparatus for self-cooling a beverage food product container, the present inventor has done a variety of experiments to arrive at the present novel method. The following issues have kept the cost effective commercialization of all prior art devices prohibitively high.

Prior art that uses liquefied refrigerants fail to address the real issues of manufacturing and beverage plant operations that are crucial for the success of a self-cooling food product container program. Some such prior art designs require pressurized food product containers to store liquid refrigerants. The only liquid refrigerants that can be stored between commercially viable pressure canisters are BFCS, CFCS, hydrocarbons, ethers, and other highly flammable low-pressure gases. These gases are not commercially viable and have led to difficulty in implementation of such technologies. Most commercial refrigerants are ozone depleting and global warming and as such have been banned by the EPA in the USA and other governing bodies for direct release into the atmosphere as products of a self-cooling food product container. The EPA has mandated that no refrigerant be used in a self-cooling food product container except $co_2$ and if used, the design must be safe. Refrigerant currently available causes both global warming and ozone depletion. Generally, they are common refrigerants such as 134*a* and 152*a*. In some cases, flammable gases such as butane and propane have been tried but the risk factors are high for several reasons. Firstly, the use of such technologies in a closed room can cause a variety of effects including asphyxiation, poisoning and so on. Second, the flammability of some refrigerants limits the number of food product containers that can be opened in a closed environment such as during parties or in a vehicle. The present inventor has several patents on these prior technologies, has experimented with several of these technologies and has found them to be unsuitable for commercial viability. Further, the cost of refrigerants is very prohibitive and the cost of cooling cannot justify the use of refrigerant gases.

Examples of inventions that use pressurized gases are found in U.S. Pat. Nos. 2,460,765, 3,494,143, 3,088,680, 4,319,464, 3,241,731, 8,033,132, 4,319,464, 3,852,975, 4,669,273, 3,494,141, 3,520,148, 3,636,726, 3,759,060, 3,597,937, 4,584,848, 3,417,573, 3,468,452, 654,174, 1,971, 364, 5,655,384, 5,063,754, 3,919,856, 4,640,102, 3,881,321, 4,656,838, 3,862,548, 4,679,407, 4,688,395, 3,842,617, 3,803,867, 6,170,283, 5,704,222 and many others.

Prior art that uses cryogenic refrigerants such as $co_2$ fail to address the real issues of manufacturing and beverage plant operations that are crucial for the success of a self-cooling food product container program. All such prior art designs require very highly pressurized food product containers to store the cryogenic refrigerants. Some technologies that promise to use $co_2$ have implemented carbon traps such as activated carbon, and fullerene nanotubes to store the refrigerants in a carbon matrix. These added desiccants and activated carbon storage systems are too expensive to implement commercially and further, the carbon and other absorptive media that lowers the pressure can contaminate the beverage products. Therefore, there is a need to reduce the quantities of such chemicals needed. Cryogenic self-cooling food product containers that require the use of very high pressure vessels and cryogenic gases such as $CO_2$ require expensive food product containers made from high pressure bearing materials such as aluminum, steel, or fiber-glass. They are essentially dangerous, since the pressures involved are generally of the order of 600 psi or more. Further, they are complicated since the pressures involved are much higher than a conventional food product container can withstand; examples of such prior art include the devices disclosed in U.S. Pat. Nos. 5,331,817, 5,394,703 to the present inventor, U.S. Pat. Nos. 5,131,239, 5,201,183, and 4,993,236.

Desiccant-based self-cooling food product containers require the desiccant to be stored between a premade vacuum. When the vacuum is released between the two compartments, water vapor is pulled into the vacuum and then absorbed by the desiccant and heat of evaporation is taken from the cooled item and transported to condense in the desiccant. The heat taken by the evaporated water heats up the desiccant and must not be permitted to interact with the beverage, otherwise it would heat up the beverage again. It is very difficult to maintain a true vacuum in the desiccant chamber and in a water reservoir. Further, the valves and activation devices used by prior art require stiff pins, knives and so on. The vacuum must be maintained for a long period of storage and can sometimes fail. Migration of moisture into the desiccant can destroy the cooling capacity. Further, it is extremely difficult to handle desiccant crystals the way prior art designs are implemented, and powders in a mass-manufacturing environment where the desiccant has to be maintained moisture free and contaminant-free inside a pressurized beverage food product container. Thus, a better technology is needed to handle these desiccants separately from the food product container. Further, the heat absorption potential of desiccants reduces as the vacuum is released and evaporation starts, so that the process is inefficient by itself and is limited to the amount of desiccant used.

The problems presented by vacuums, including difficulties in creating and maintaining them and the lack of efficiency they can produce, have been encountered in other fields as well. An early example can be found in the evolution of Thomas A. Edison's light bulb. His first practical incandescent lamp, for which he received a patent in 1879, included a carbonized bamboo filament contained within an evacuated glass bulb. Although it arguably propelled the world into a new era, it was initially highly inefficient. Then in 1904, European inventors replaced the carbonized bamboo filament with tungsten, and in 1913 it was discovered that replacing the vacuum within the bulb with an inert dry gas doubled its luminous efficiency. Although this field of art is different from the present one, and the technical issues presented were quite different, this is perhaps a thought provoking example of an advance in product efficiency resulting from the replacement of a vacuum with a dry gas.

In general, these prior art technologies are not cost-effective technologies and they rely on extremely large and complicated canister designs in relation to the beverage food product containers within which they are contained. In fact, the ratio of desiccant to water is about 3:1 and the ratio of the volumetric loss in such beverage food product containers is about 40%. The cost of the desiccant or sorbent, the cost of the food product container, and the cost of the process of manufacture are prohibitive, despite nearly 20 years of trials. Thus it is advantageous to reduce the amounts of these components needed and to restructure the manufacturing process to divorce the interior of the food product container from these chemicals.

Examples of devices that use this technology are found in U.S. Pat. Nos. 7,107,783, 6,389,839, 5,168,708, 6,141,970, 8,299,024, 462,224, 7,213,401, 4,928,495, 4,250,720, 2,144,441, 4,126,016, 3,642,059, 3,379,025, 4,736,599, 4,759,191, 3,316,736, 3,950,960, 2,472,825, 3,252,270, 3,967,465, 1,841,691, 2,195,0772, 322,617, 5,168,708, 5,230,216, 4,911,740, 5,233,836, 4,752,310, 4,205,531, 4,048,810, 2,053,683, 3,270,512, 4,531,384, 5,359,861, 6,141,970, 6,341,491, 4,993,239, 4,901,535, 4,949,549, 5,048,301, 5,079,932, 4,513,053, 4,974,419, 5,018,368, 5,035,230, 6,889,507, 5,197,302, 5,313,799, 6,151,911, 6,151,911, 5,692,381, 4,924,676, 5,038,581, 4,479,364, 4,368,624, 4,660,629, 4,574,874, 4,402,915, 5,233,836, 5,230,216. U.S. Pat. No. 5,983,662 uses a sponge in place of a desiccant to cool a beverage.

Prior art also reveals chemically endothermic self-cooling food product containers. These rely on the use of fixed stoichiometric reactions of chemicals to absorb heat from the food product container contents. U.S. Pat. Nos. 3,970,068, 2,300,793, 2,620,788, 4,773,389, 3,561,424, 3,950,158, 3,887,346, 3,874,504, 4,753,085, 4,528,218, 5,626,022, 6,103,280, and numerous others use endothermic reactions remove heat from water to cool the beverage food product container.

Prior endothermic self-cooling food product containers depend on the stoichiometric mixture of a fixed amounts of chemicals to achieve a fixed amount of cooling. After the cooling process, the thermodynamic transport mechanism and potential to cool is exhausted and no further cooling can take place. Further, the products of the reaction remain as caustic and acidic components in the form of bases and acids that can be harmful. For example, us patent application pub. No: US 2015/0354885AL shows a system for externally cooling a beverage containing a specific amount of beverage. The system comprises a cooling housing having an inner wall and an outer wall, the inner wall being of thermally conductive material contacting at least a part of the beverage holder, the cooling housing defining an inner compartment including at least two separate, substantially non-toxic reactants, causing, when reacting with one another, a non-reversible, entropy-increasing reaction producing substantially non-toxic products in a stoichiometric number at least a factor, 3 larger than the stoichiometric number of said reactants, said at least two separate substantially non-toxic reactants initially being included in said inner compartment separated from one another and causing, when reacting with one another in said non-reversible, entropy-increasing reaction, a heat reduction of said beverage within said beverage holder. While no recovery system is used to economize on the stoichiometric ratio of reactants, the system falls under the same types of endothermic systems disclosed in all prior art that use a fixed cooling potential based on fixed stoichiometric ratio of reactants. No further cooling is disclosed using electromotive heat transport means.

The present invention differs from all the mentioned prior art and provides a novel cost effective and thermodynamically simple and viable heat transport means for cooling a beverage in a food product container by renewing the cooling potential of fixed amounts of reactants using electromotive regeneration of a dry gas. Many trials and designs have been made to obtain the present configuration of the disclosed invention.

Generally related us patents that teach reaction cooling include: U.S. Pat. No. 4,319,464, issued on March 1982 to Dodd; U.S. Pat. No. 4,350,267, issued on September 1982 to nelson et al.; U.S. Pat. No. 4,669,273, issued on June 1987 to Fischer et al; U.S. Pat. No. 4,802,343 issued on February 1989 to Rudick et al; U.S. Pat. No. 5,447,039 issued on September 1995 to Allison; U.S. Pat. No. 5,845,501 issued on December 1998 to Stonehouse et al; U.S. Pat. No. 6,065,300, issued on May 2000 to anthony; U.S. Pat. No. 6,102,108 issued on August 2000 to Sillince; U.S. Pat. No. 6,105,384 issued on August 2000 to joseph; U.S. Pat. No. 6,341,491, issued on January 2002 to Paine et al; U.S. Pat. No. 6,817,202, issued on November 2004; and anthony, U.S. Pat. No. 7,107,783.

1.0 Deficiencies of Prior Art that Use Endothermic Cooling Systems a) Endothermic cooling systems of the prior art have a limited potential to solvate and then cause cooling since the solvation energy of the ionizable compounds used, for example, usually depends on the temperature of a solvent such as water. The water acts as humidification liquid to ionize chemicals and the ions redeem energy of solvation, and as the solvent cools, the process becomes energy deficient, and this makes the process of extraction of solvation energy exponentially slow, and as such, these technologies do not use the full potential of the solvation energy available. For example, to cool 16 oz of beverage by 30° F. one needs to dissolve at least 127 g of potassium chloride in about 380 g of water. This is not commercially viable in a self-cooling food product container technology that relies only on this process. The present invention overcomes this deficiency by means of an extremely dry gas. Dry gas with a dew point of 10° F. to −150° F. can easily absorb vapor from a liquid that is cooled to freezing point. The dry gas simply increases its dew point temperature, while the actual thermometric temperature of the dry gas itself remains constant.

b) Further, stored solutes used for endothermic cooling in a solvent such as water require a stoichiometric molar ratio with water for the purpose of cooling. In all prior art, a fixed amount of cooling can be achieved by irreversibly combining a fixed amount of water with a fixed amount of ionizable compounds Such as chlorides and nitrates. The solvation products of endothermic reactants can result in acidic solutions and basic products such as hydrochloric acid and sodium hydroxide obtained from the dissolution of ions of potassium chloride in water. This deficiency is solved by dry gas acting as a mediator to force this transference of water from a liquid state to a vapor state from the cold solution to dry out the chemical compounds and offset the stoichiometric ratio of water to compounds used and renew in a reversible manner the entropy-increasing reactions in distinct compartments formed by a compartment forming sleeve member with protuberances that can cool again by requiring more water to solvate. The protuberances permit one side of the compartment forming sleeve member to hold a humidification liquid and the other side of the compartment forming sleeve member to act as a dry gas evaporator. Dry gas takes away the heat of reformation of these solutes from solution. This has the advantage of regenerating ionizable compounds that may be re-ionized reversibly for endothermic reactions by a desalting and salting process that can only take place with dry gas acting as an intermediary transport means for evaporation.

c) Further, the prior art requires impervious metals to be used for the desiccant and the water chamber due to the need to sustain a true vacuum over a long period of time. In the present invention, even though aluminum may be used in the construction of the apparatus according to the present invention, the parts of the apparatus surrounding the food product Preferably are made from heat-shrinkable plastic materials such as injection stretch blown polyethylene tetraphthalate (PET) and shrinkable poly vinyl chloride (PVC), which are inexpensive materials interacting with a standard aluminum or steel food product container. The implementation of such materials permits them to perform mechanical functions when subjected to the heat of evaporation and actually do mechanical work from this heat by increasing a dry gas chamber's volume to generate a rarefication of a fixed volume of dry gas therein by means of the heat-shrinkable physical properties of said material.

d) Further, the food product container itself is not modified in any breakable manner, thus the manufacturing process of the food product container is unaffected by the methods used to manufacture the present apparatus.

Thus the present invention bypasses the stoichiometric limitations of common methods of cooling a product by endothermic reactions and also bypasses the need for a true vacuum and other deficiencies and goes directly into the properties of electromotive vapor and heat transport means using a dry gas in a low vapor pressure state with dew point temperatures in the range 10° F. to −150° F. as well as the properties of materials used acting in a beneficial manner.

2.0 Deficiencies of Prior Art that Use Desiccant/Vacuum Cooling Systems a) Prior desiccant technologies need to store a permanent true vacuum to evaporate water at low pressure and cause cooling. The present invention bypasses this step of storing a vacuum in desiccant processes and utilizes the physical properties of the materials used by the invention to create a rarefication of dry gas only when required. Dry gas starts the process of evaporation and the process of evaporation is enhanced by rarefication of the dry gas. In most cases, the materials used to manufacture the present invention are preferably made from a combination of heat-shrinkable plastic materials, such as injection stretch blown heat-shrinkable polyethylene tetraphthalate (PET) and heat-shrinkable poly vinyl chloride (PVC), which are inexpensive materials interacting with a standard aluminum or steel food product container. The implementation of such heat-shrinkable materials permits them to perform mechanical functions when subjected to the heat of evaporation and actually do mechanical work from this heat by expanding the dry gas chamber's volume to generate a rarefication of the dry gas by means of the heat-shrinkable physical properties of said material. Although aluminum can be used in many parts of its construction, particular features used for rarefication of the dry gas require such heat-shrinkable plastic materials.

b) Further, desiccant processes in prior art generate 100% partial vapor pressure of the evaporant such as water in the cooling chamber when the vacuum is exposed to the cooling chamber. This presents problems. The water vapor evaporated by the vacuum reduces the vacuum and stops the process until the desiccant starts again to reduce the vapor pressure in the cooling chamber. Thus the process depends on the rate of absorption of vapor by the desiccant.

c) Further, the water vapor evaporated by the vacuums of prior art fills the cooling chamber and can contact the cooling surfaces and condense to transfer heat of condensation from one section of said cooling chamber to another. The minimum operating temperature of the evaporated vapor is 32° F., which is the freezing point of water. The dry gas system used by the present invention has dew point temperatures in the range 10° F. to −150° F., which is below the freezing point of water, and thus the evaporation of water vapor into dry gas is not hampered by cooling and icing. The dry gas dew point temperature is increased by evaporation, but does not heat up the cooling chamber.

d) Further, during the sorption reaction, heat of sorption can heat up the sorbent material and the sorbability for water decreases markedly. Dry gas becomes even more hygroscopic as it heats up by taking heat away from a vapor absorber to lower its dew point temperature.

In the present invention, a plastic heat-shrinking vapor absorber technology is used by some embodiments of the present invention. A dry gas is used to absorb humidification liquid vapor from distinct compartments made by a compartment forming sleeve member that can be at ice-cold temperatures while lowering the dry gas's dew point temperature (not its temperature). Unlike the conventional desiccant systems of the prior art, this humidification liquid vapor is not readily available to the cooling surfaces for condensation. The humidification liquid vapor is held by the low vapor pressure of the dry gas, and thus will not condense back on cooling surfaces. The plastic heat-shrinking vapor absorber absorbs the vapor from the dry gas and the need for a true vacuum is eliminated. Thus any humidification liquid can be used. For example, a humidification liquid such as dimethyl ether which is a pressurized liquid can be used but can give off vapor that can be absorbed by a dry gas instantly. In a sense the dry gas acts as a locomotive vapor pressure cascade conductor for transferring vapor from the liquid phase to the plastic heat-shrinking vapor absorber using an electromotive potential. As long as the vapor is not exposed to the cooling chamber, it is absorbed by the plastic heat-shrinking vapor absorber which interacts with the electromotive nature of dry gas more readily than with the direct vapor. For example, standard desiccants in air conditioners that use desiccant-wheels use the advantages provided by a dry gas to move moisture and regenerate. This is not done in a vacuum. One can imagine that the dry gas has interstitial van de wall forces that hold the vapor in a tightly confined interstitial form that is more suitable for the plastic heat-shrinking vapor absorber to absorb it. It has been shown that molecular sieves of smaller pore size can absorb vapor from dry gas more readily than from the direct absorption of vapor itself. This can be explained if one realizes that polar vapor molecules mostly tend to electrostically bond to form cascade chains toward the lower vapor pressure regions and thus exhibit viscous behavior like a fluid eliminating their polarity. The polarity of humidification liquids such as water is what is needed to drive the desiccant absorption process. This is seen in non-polar gases for example as duplex formations of ordinary gases such as $h_2$, $n_2$, $o_2$ and so on. Dry gas discourages this polarity thus the usual electrostatics associated with dry air to drive the process electrostatically.

The present invention uses a plastic heat-shrinking vapor absorber's heat to activate the physical properties of a plastic heat-shrinking vapor absorber chamber wall that is specially designed to alter its shape to generate and create a rarefication in by increasing the volume of the dry gas chamber in which a fixed amount of dry gas is stored. Thus there is no need to store a permanent vacuum and a true vacuum is not required.

Further, as an added advantage, the present invention uses deformable simple seals comprising sealing ring structure made of one of a suitable O-ring seals, metal band seals, rubber band seals, putty seals, and sealing waxes seal to cause actuation and perform a sealing function and thus the present invention does not necessarily require pins, knives and other methods to introduce water vapor to the plastic heat-shrinking vapor absorber, even though they may still be used. There is no worry about a loss of vacuum during storage. As such the plastic heat-shrinking vapor absorber and the subcategory of vapor absorbers used in the invention do not necessary have to have the best affinity for the humidification liquid vapor of the humidification liquid used. Instead they are optimized for delivery of said humidification liquid vapor by dry gas. Thus while prior inventions require desiccants that are fine tuned for pure vapor absorption, the present invention fine tunes the vapor absorber for absorption of vapor from a dry gas.

SUMMARY OF THE INVENTION

The present invention accomplishes the above-stated objectives, as well as others, as may be determined by a fair reading and interpretation of the entire specification.

Dry gas such as substantially dry air, substantially dry $CO_2$, substantially dry nitrogen, and other substantially dry gases with a very low dew point temperature can cause extreme cooling as is evidenced by weather patterns that are predominantly driven by the humidity of air and heat energy available in the atmosphere. Not surprisingly, dry air can result in dramatic snow and ice formation, in turn resulting in extreme weather patterns across the world. It is not surprising that lip-balm used for dry lips sells well in winter. From hurricanes to tornadoes, to heavy snow storms, and icy winter storms, nature has provided an amazing electromotive heat transport means that can be emulated to assist in cooling a beverage and a food product using humidification and dehumidification of air. It is my theory that the tremendous vacuous energies of a tornado are a result of the sudden condensation of water vapor from the dehumidification of humidified dry air. Water vapor is 1840 times the volume of the same weight of liquid water, and so when a huge cloud condenses, a tremendous reduction in volume is obtained resulting a vacuum which appears as a funnel cloud of a tornado. No simple wind motion can generate such tremendous energies. Similarly, the humidification of very dry air results in very cold temperatures that results in snow storms. This happens as moisture is picked up by dry air and evaporated to remove heat from the surrounding environment followed by saturation of the same wet air which again deposits its vapor as moisture in the cold environment as snow and hail in the cold environment it has created.

Water has the best thermodynamic potential to cool a food product. It has the highest heat of evaporation and as such it can be used in combination with electromotive drying and regenerative processes that also rely on water molecules to cool a food product container. However, water does not easily evaporate due its high heat of evaporation and as such it must be "enticed" to do so by an appropriate means. Further, as water cools, for example in an endothermic reaction, and in a desiccant evaporation system, it becomes more and more difficult to evaporate it. Thus, neither endothermic cooling nor conventional desiccant cooling systems of prior art by themselves prove to be the most efficient forms of cooling a food product such as beverage. The combination of dry gas mediation, and other cooling methods can use the two fundamental substances, water and dry gas to effectively increase the thermodynamic potential to cool a food product.

The Invention

The following definitions are generally used to described some terms used in the present disclosure to describe this invention.

- "food product container" shall mean a food product container either made from metal or made from plastic and containing a food or beverage product as used by the invention.
- "food product" shall mean any substance that is a consumable item preferably a liquid beverage;
- "inward facing" shall mean pointing in the direction of the food product;
- "outward facing" shall mean pointing in the direction away from the food product;

"dew point temperature" shall mean the temperature at which the vapor of a humidification liquid in a sample of dry gas at constant barometric pressure condenses into humidification liquid at the same rate at which it evaporates.

"Compartment forming sleeve member" for the purposes of this application shall mean a cup-like container with thin walls and made from one of plastic and metal.

"Covering sleeve member" for the purposes of this application shall mean a cup-like container with thin walls and made from one of plastic and metal.

"Protuberating" for the purposes of this application shall mean

"humidification liquid" for the purposes of this application shall mean any liquid that is used to evaporate and cool itself.

"dry gas" shall mean a gas having a substantially low dew point temperature for a particular humidification liquid with a substantially low partial vapor pressure for said humidification liquid that approaches a vacuum with a dew point temperature less than 10° F. for said humidification liquid. Thus a dry gas can be dry for humidification liquid and still be a wet gas in relation to another liquid.

"humidification liquid vapor" for the purposes of this application shall mean the vapor of any humidification liquid.

"inward facing" for the purposes of this application shall mean any structure facing toward the food product container side wall. Thus an inward facing undulation will make distinct compartments with surfaces they surround and touch tangentially.

"outward facing" for the purposes of this application shall mean any structure facing away the food product container side wall.

"distinct compartment" for the purposes of this application shall mean a space bounded by protuberances and two surfaces that contact said protuberances.

"protuberances" for the purposes of this application shall mean any curvilinear and linear protrusions from a wall including undulations of the wall that are inward facing and that are outward facing. Thus outward facing protuberances can form distinct compartments with surfaces that surround and contact said outward facing protuberances and inward facing protuberances can form distinct compartments with surfaces that they surround and contact said inward facing protuberances.

"heat transport means" for the purposes of this application shall mean a thermodynamic and electromotive potential to exchange heat between substances;

"sealing structure" for the purposes of this application shall mean any structure that forms a seal between two walls.

"chamber" for the purposes of this application shall mean shall means a space sealed by one or more sealing structures.

"Cup-like" for the purposes of this application shall mean a structure shaped like a cup having a closed end and an opposing open end separated by a cylindrical wall.

"Heat-shrinkable" for the purposes of this application shall mean a material that forms surfaces whose areas can be shrunk by heating.

"sealing portion" for the purposes of this application shall mean a part of a wall that can form a seal with another wall.

"wider" for the purposes of this application shall mean having dimensions greater than;

"pressure difference" for the purposes of this application shall mean a difference in pressure between two fluids separated by a dry gas seal including a difference in pressure due to gravitational height differences between said two said fluids. It is anticipated that any one of such two fluids are contained in a chamber and may have a higher pressure than the other.

"ions" for the purposes of this application shall mean an atom or molecule that has a non-zero net electrical charge;

"chemical compound" for the purposes of this application shall mean any chemical compounds that can react with one another to cool endothermically and that can dissolve in humidification liquid such as water to form ions from its elements or a combination of its elements thereof and cool endothermically.

"compartment forming sleeve member" for the purposes of this application shall mean a thin walled cylindrical structure that can take the form of preferably a thin walled cup and possibly a cylinder made from a non-permeable barrier material such as plastic and aluminum;

"food product" for the purposes of this application shall mean any substance that is a consumable item, preferably a liquid beverage;

"food product container" shall mean any food product container made from metal or plastic that can store a food or beverage;

"dry gas" for the purposes of this application shall mean a gas having little or no humidification liquid in it, with a substantially low partial water vapor pressure approaching vacuum with a dew point temperature less than 10° F. It is noted that the dry gas itself could be liquefied;

"wet gas" for the purposes of this application shall mean a dry gas humidified to have a higher water vapor pressure than dry gas and a dew point temperature greater than 10° F.

"low vapor pressure medium" for the purposes of this application shall mean any condition that results in an extremely rare medium, such a dry gas, a vacuum, or a low partial vapor pressure medium;

"dry gas chamber" for the purposes of this application is a functional structure that preferably contains and delivers a dry gas and may hold other structures within it.

"PVC" shall mean heat-shrinkable polyvinyl chloride.

"PEr" shall mean heat-shrinkable polyethylene tetraphthalate.

"ionizable" shall describe any compound that can be dissolved in water to form ions from its elements or a combination of its elements thereof.

"vapor absorber" for the purposes of this application shall mean any substance or combination of substances that can absorb humidification liquid vapor as defined herein.

"plastic heat-shrinking vapor absorber" for the purposes of this application shall mean any substance or combination of substances that can absorb humidification liquid vapor and generate heat of condensation of said humidification liquid vapor for heat-shrinking a heat-shrinkable plastic.

"sealing wax" for the purposes of this application shall mean any wax that is insoluble in humidification liquid.

"thermal wax" for the purposes of this application shall mean any wax that has a melt point temperature of least above ambient temperature.

"reacting chemical compound" shall mean at least hydrated chemical compound that reacts with another chemical compound to provide endothermic cooling and reaction released humidification liquid by said reaction.

"dissolving chemical compound" shall mean a chemical compound that dissolves in a humidification liquid and provides endothermic cooling of said humidification liquid by its ionization.

"upright" for the purposes of this application shall mean vertical orientation.

For orientation purposes and clarity, the food product container is assumed to be standing in an upright, vertical orientation with the food product container's bottom resting on a horizontal plane.

This invention can also use the thermodynamic potential of the evaporation of a humidification liquid such as water, water-ethanol azeotropes, dimethyl ether-water azeotropes, or a suitable liquid and the ability of a substantially low vapor pressure medium such as a dry gas to force this evaporation from even cold liquids. To do this, a standard food product container such as a can or a bottle is provided. Food product container is preferably a cylindrical beverage food product container of standard design, and with standard food product release means and a standard food product release port.

First Embodiment of the Present Invention

In a first embodiment of the invention, a food product container is provided with a simple adhesive backed rectangular one of metal strip and plastic strip attached to the food product container side wall to provide for a seal breaking structure. The seal breaking structure may also be inwardly disposed as an indentation made on the food product container side wall but preferably the Seal breaking structure may be provided as a thick self-adhesive plastic strip attached to acts as a disruption of the smoothness of the food product container side wall. Seal breaking structure is provided for disrupting the seal made by a Dry Gas Seal as a sealing structure on the food product container side wall.

A covering sleeve member seal is provided as a sealing structure in the form of one of a ring structure made from one of an O-ring seal, a rubber band seal, a putty seal, and sealing wax seal, a glue bonding agent and shaped in the form of a thin loop. In the case when it is a rubber band, it is the type that is commonly used to hold multiple objects together such as a stack of papers. In the case when it is an O-ring, it is the type of rubber seal that is conventionally used for sealing purposes between surfaces. Covering sleeve member seal circumscribes the food product container side wall with cross sectional dimensions preferably less than 4 mm. Preferably covering sleeve member seal is expandable to form a tight sealing band around the food product container. If made from sealing wax, covering sleeve member seal should be formed on the food product container side wall at the appropriate location as defined herein. For example, in the case when it is one of a rubber band and an O-ring, the loop diameter of covering sleeve member seal is expandable and covering sleeve member seal is placed circumferentially to hold tightly around the food product container top wall seam in a plane parallel to the diametric plane of the food product container and close to the food product container top wall.

A dry gas seal is also provided, once again in the form of one of a ring structure made from an O-ring seal, a rubber band seal, a putty seal, and sealing wax seal, a glue bonding agent and shaped in the form of a thin loop. Dry gas seal circumscribes the food product container side wall and should have a cross sectional dimensions preferably less than 4 mm in width. Where the dry gas seal is a rubber band, it is expanded to form a band around the food product container side wall. If made from sealing wax, dry gas seal should be formed on the food product container side wall at the appropriate location. When a rubber band is used, dry gas seal is placed circumferentially and to hold sealing tight around the food product container side wall in a plane angled to the diametric plane of the food product container. The minimal distal separation of the dry gas seal below the covering sleeve member seal is preferably about 20 mm.

Before the apparatus is used, seal breaking structure is located between the dry gas seal and the covering sleeve member seal.

A compartment forming sleeve member is provided, and in a first embodiment, the compartment forming sleeve member preferably is made from a thin material such as plastic, rubber, cardboard and aluminum, with a compartment forming sleeve member wall having a wick material made from one of cotton, woven meshes, absorptive paper, and absorptive cardboard laminated on said compartment forming sleeve member wall. Preferably compartment forming sleeve member is made from thin plastic material and formed by compressive molding, heat-shrinking, injection stretch-blowing and by injection molding.

The compartment forming sleeve member has a compartment forming sleeve member side wall with surface protuberances on the inside surface and on the outside surface such as the protuberances shown in FIG. 2, FIG. 12, FIG. 20, FIG. 21, FIG. 22 and FIG. 24. These protuberances can be in the form of waves with inward facing protuberances and outward facing protuberances. The purpose of the inward facing protuberances and outward facing protuberances to increase its strength, surface area, and permit the following to be possible:

a) A variety of distinct reacting chemical compounds and dissolving chemical compounds can be stored exclusively in distinct compartments between formed between protuberances against the food product container side wall. Many species of distinct reacting chemical compounds can be stored exclusively in distinct compartments formed by the inward facing protuberances when they form distinct compartments against a covering sleeve member. Thus pairs of endothermically reacting chemical compounds of different species of reactants can be stored in said distinct compartments. Further different species of dissolving chemical compounds can also be stored in said distinct compartments.

b) Further, humidification liquid created by the reacting chemical compounds can be used to endothermically dissolve dissolving chemical compounds to generate even more cooling.

c) Humidification liquid provided outside these reactions can also be pulled into between the protuberances to ionize chemical compounds and cool endothermically. Dry gas also provided can also pass freely through the distinct compartments to evaporate humidification liquid.

d) deforming the protuberances causes reacting chemicals that react endothermically that are stored exclusively in distinct compartments before they react can be made to react when the protuberances are deformed or broken to permit said reacting chemicals to mix and react.

The uniform wavelike protuberances of the compartment forming sleeve member are shown in FIG. 2, FIG. 12, FIG. 20, FIG. 21, FIG. 22 and FIG. 24, and these are but examples of the possible protuberances that can be made on the compartment forming sleeve member side wall. For example, the compartment forming sleeve member side wall may be injection molded to have ribs projecting from its walls to form distinct compartments that serve the same the same purpose. A variety of projected shapes such as the aforementioned protuberances may be used to increase the surface area of the compartment forming sleeve member. For example, the inward facing protuberances of the compartment forming sleeve member can mate tangentially with a food product container side wall to form outward facing distinct compartments consisting of the outward facing protuberances around the food product container side wall to hold chemical compounds and permit humidification liquid held in the outward facing distinct compartments formed with the food product container side wall to enter therein and ionize said chemical compounds that dissolve endothermically therein and provide for a first cooling of the product. Then the humidification liquid, which is preferably water, can be evaporated by dry gas present in the outward facing distinct compartments to be absorbed by a plastic heat-shrinking vapor absorber to provide a second cooling means. The reverse configuration is also possible when the chemical compounds are held between the outward facing protuberances against the food product container side wall and the humidification liquid is held between the inward facing protuberances outside and permitted to enter between the outward facing protuberances and cause endothermic cooling by solvation.

The compartment forming sleeve member could also be made as a cylindrical wall with protuberating that provide structural support and also provide for the holding of solutions and permit the free passage of dry gas to evaporate humidification liquid in the dry gas chamber. Preferably, the compartment forming sleeve member is a heat-shrinkable plastic sleeve with a wicking material attached to its surfaces to permit it to absorb humidification liquid and hold enough humidification liquid by osmotic pressure without spilling it.

In the first embodiment of the invention, the compartment forming sleeve member circumferentially surrounds the food product container side wall at least in part in areas below the dry gas seal and it is held in place by using with one of a glue, tape, and by friction against the food product container side wall. Preferably, the compartment forming sleeve member surrounds to cover in part the exposed surface of the food product container side wall below the dry gas seal and extend to surround the food product container bottom edge as a cup-like structure.

A covering sleeve member is provided which preferably is made from one of a heat-shrinkable polyethylene terephthalate (PET) and poly vinyl chloride (PVC), to form a heat-shrinkable thin-walled cup-like sleeve that encases in whole or in part the food product container. Preferably, the covering sleeve member has a covering sleeve member side wall that can take on a variety of shapes but must have cylindrical sealing portions that permit it to mate sealingly with portions of the food product container side wall as described in the paragraphs and pages which follow. Covering sleeve member can also have the inward facing protuberances of the compartment forming sleeve member can mate tangentially with a food product container side wall to form outward facing distinct compartments consisting of the outward facing protuberances around the food product container side wall to hold chemical compounds and permit humidification liquid held in the outward facing distinct compartments formed with the food product container side wall to store said chemical compounds for endothermic reactions only. The covering sleeve member side wall is the outside covering of the apparatus and covers in whole the compartment forming sleeve member and the sealed food product container containing a food product below the food product container top wall and forms in part the inward facing wall of the dry gas chamber and the humidification liquid chamber wall in part. The covering sleeve member side wall is preferably made with plastic materials such as heat-shrinkable PET and heat-shrinkable PVC that can be reshaped in portions by heat-shrinking when heat is applied to those portions. The covering sleeve member side wall preferably covers in-part the food product container side wall and may extend to cover in part the food product container top wall. The covering sleeve member side wall just fits to cover and surround the compartment forming sleeve member. Since the compartment forming sleeve member has outward facing protuberances that tangentially touch the inward facing surface of the covering sleeve member side wall it forms a part of the dry gas chamber that can have a multitude of distinct compartments formed by the inward facing protuberances with the covering sleeve member side wall.

Should the covering sleeve member side wall extend and cover most or all of the food product container top wall, then an extension grip made from a simple plastic ring may be added and snapped to the food product container top wall seam to permit a user to be able to grip and rotate extension grip and thus rotate the food product container relative to the covering sleeve member. As shown in FIG. 17, covering sleeve member may be constructed with support structures such as channels and cavities that permit it to have more structural strength to prevent collapse when a vacuum is applied.

The covering sleeve member side wall covers over the attached compartment forming sleeve member and covers in-whole or in-part the food product container. Covering sleeve member side wall has a covering sleeve member sealing portion that can be heat-shrunk to shrink in diameter to seal against the food product container side wall to form a seal. It is anticipated that the covering sleeve member side wall end is located at the covering sleeve member sealing portion, but it is contemplated that the covering sleeve member side wall end may extend beyond the covering sleeve member sealing portion. When the covering sleeve member sealing portion is heat shrunk, the covering sleeve member side wall applies pressure and clamps around the surface of covering sleeve member seal on the food product container side wall, and also applies pressure and clamps around the surface of the dry gas seal on the food product container side wall to form the humidification liquid chamber between the food product container side wall and the covering sleeve member side wall.

As stated above, the covering sleeve member is rotatable relative to the food product container side wall. Thus, advantageously, the dry gas seal and the covering sleeve member seal rotate with covering sleeve member in unison relative to the food product container side wall. It is anticipated that the covering sleeve member side wall deforms by compressive heat-shrinking around the covering sleeve member seal to securely hold the covering sleeve member seal and provide for the same to sealingly rotate with covering sleeve member. However, it is also anticipated that covering sleeve member may be made from thin aluminum that can be spun-shaped and then formed to securely hold the covering sleeve member seal and provide for the same to sealingly rotate with covering sleeve member. It is anticipated that the covering sleeve member side wall partially deforms by compression around the dry gas seal to securely hold the dry gas seal and provide for the same to sealing rotate with covering sleeve member against the food product container side wall. However, it is also anticipated that covering sleeve member may be made from thin aluminum that can be spun-shaped to securely hold the covering sleeve member seal and provide for the same to sealingly rotate with covering sleeve member. It is also anticipated that covering sleeve member seal is symmetrically placed with respect to the rotation forces of covering seal and may not rotate with the covering sleeve member but nevertheless forms a seal between covering seal and the food product container side wall. However, the dry gas seal is not symmetric with respect to rotation of the covering sleeve member and as such it is anticipated that dry gas seal must rotate in unison with the covering sleeve member relative to the food product container side wall.

The covering sleeve member side wall can either be heat-shrunk (if made from one of heat shrink PET or heat shrink PVC) or one of crimped and spin-formed using rollers (if made from aluminum) to compress and to seal against the covering sleeve member seal as stated above. Covering sleeve member side wall can be strengthened by protuberances such as by ribbing, undulations, and circumferentially grooving it for example, to provide for strength, surface area, and permit a variety of distinct ionizable chemical compounds to be stored exclusively in distinct compartments between inward facing protuberances, and to also permit easy passage of dry gas and vapor. Covering sleeve member side wall has a covering sleeve member sealing portion that is used to form a sealing surface with covering sleeve member seal. The covering sleeve member sealing portion, when shrunk to seal against the dry gas seal presses it against the food product container side wall to form a fluid seal. When the covering sleeve member sealing portion is shrunk to clamp and seal on the surface of dry gas seal it forms a rotatable seal between the food product container side wall and covering sleeve member. It is anticipated that covering sleeve member sealing portion partially deforms around the covering sleeve member seal to securely hold the covering sleeve member seal and provide for the same to rotate with covering sleeve member. It is anticipated that covering sleeve member side wall also partially deforms around the dry gas seal to securely hold the dry gas seal and provide for the same to sealingly rotate with covering sleeve member when rotated. This provides an actuating means when covering sleeve member is rotated.

The inward facing surface of the covering sleeve member side wall in part, the dry gas seal, the covering sleeve member seal, and the outward surface of the food product container side wall in part, together form a humidification liquid chamber. Humidification liquid is sealingly stored in the humidification liquid chamber. It is anticipated that the humidification liquid can also be a pressurized liquefied gas.

The covering sleeve member side wall has a covering sleeve member restriction portion that clamps against the wick on the compartment forming sleeve member to form a restricted vapor passageway for humidification liquid vapor and dry gas to pass through in a controlled manner. When the compartment forming sleeve member restriction portion is clamped around the surface of the wick it forms a rotatable restricted vapor passageway. It is anticipated that the covering sleeve member side wall slidingly rotates over the restricted vapor passageway when rotated without deforming or rotating the restricted vapor passageway and the compartment forming sleeve member itself. The covering sleeve member is made with a covering sleeve member bottom wall that sealingly connects to the covering sleeve member side wall. Covering sleeve member bottom wall turns to sealingly connect to an inwardly bowed covering sleeve member annular wall preferably forming a frustoconical shape. The covering sleeve member annular wall may also take a partial-hemispherical dome shape, a cylindroid shape and other forms such as a reversed-frustoconical shape, i.e. having a larger closed end diameter at its top wall than at its open end. The dry gas chamber is the chamber formed inside the covering sleeve member below the dry gas seal.

Thus according to a first embodiment of the invention, the dry gas chamber is below the humidification liquid chamber and contains the food product container and the compartment forming sleeve member attached. It is anticipated that covering sleeve member may be made from spun or deep drawn aluminum and formed to provide for all the sealing required by spin forming and rolling it in parts. In such a case, covering sleeve member annular wall may be made from one of heat-shrinkable injection stretch blown PET and Polyolefin material and PVC material and then joined to the covering sleeve member bottom wall by ultrasonic welding or gluing.

A thin-walled, open ended support cylinder, with support cylinder holes close to its top end, is placed to rest at the opposite open end on the covering sleeve member bottom wall between the covering sleeve member side wall and the covering sleeve member annular wall and to contact the food product container bottom edge.

The annular plastic heat-shrinking vapor absorber retention space is defined within the within the dry gas chamber between the inner surface of the support cylinder, inner surface covering sleeve member annular wall and the inner surface covering sleeve member bottom wall. An annular thermal wax retention space is also defined in the dry gas chamber between the outer surface of the support cylinder, the inner surface of the covering sleeve member annular wall and the inner surface of the covering sleeve member bottom wall. The annular thermal wax retention space may be filled with a suitable thermal wax that melts at temperatures ranging from 70° F. to 160° F. Support cylinder prevents the covering sleeve member bottom wall from collapsing and deforming its shape relative to food product container, and also shields the hand of a user gripping the apparatus from excessive heat. The thermal wax 138 may be eliminated and replaced with a dry gas.

Several cooling actuation means and cooling actuation means stages are provided. The first is triggered when covering sleeve member is rotated relative to the food product container side wall, which causes the dry gas seal and dry gas seal sits over a seal breaking structure provided, to permit fluid communication between the exposed humidification liquid from the humidification liquid chamber and the dry gas chamber. The second cooling actuation means and second cooling actuation means stage is provided as well. A deformable ring structure seal preferably made from one of an O-ring seal, a metal seal, a rubber band seal, a putty seal, and sealing wax seal, a glue bonding agent and shaped in the form of a thin loop forms the dry gas seal, a deformable material being preferred. Depressing the covering sleeve member over the dry gas seal and thereby deforming its shape permits humidification liquid from the humidification liquid chamber to leak and enter the dry gas chamber where it can ionize chemical compounds and at the same time evaporate into the dry gas. A good result is also achieved if dry gas seal is made from a deformable structure such as a thin metal band layered with either a sealing wax material or a sealing putty material.

The compartment forming sleeve member is preferably made with protuberances forming distinct compartments with the food product container side wall and also with the covering sleeve member side wall to provide strength, surface area, and permit a variety of distinct chemical compounds to be stored exclusively in distinct compartments between any of said protuberances.

The annular plastic heat-shrinking vapor absorber retention space holds a plastic heat-shrinking vapor absorber such as a silica gel and forms of absorbers described in table 1. Annular plastic heat-shrinking vapor absorber retention space is a stretch-formed heat-shrinkable portion of covering sleeve member. If covering sleeve member is made from aluminum, then covering sleeve member annular wall must be made as a separate item made from one of heat-shrinkable PET and heat-shrinkable PVC and the attached by a suitable glue to the covering sleeve member bottom wall. The covering sleeve member annular wall responds to an increase in temperature by deforming and shrinking and flattening to increase the volume of the dry gas chamber. This deformation is caused by the plastic heat-shrinking vapor absorber heating up as it absorbs humidification liquid vapor from the dry gas.

The covering sleeve member annular wall preferably forms a shape that intrudes into the volume of the dry gas chamber. The protruded shape of the covering sleeve member annular wall is important in enhancing the functioning of the apparatus. The shape of covering sleeve member annular wall can be an inverted cup, a dome, and preferably any suitable shape that minimizes the volume of the equivalent cylindrical volume formed by just the covering sleeve member side wall with a flat bottom. The shape of covering sleeve member annular wall must initially minimize the dry gas chamber's volume and then maximize its intrusion into the dry gas chamber when heated. In the examples shown in the figures, the shape of the covering sleeve member annular wall forms an inverted cup-like shape and a dome. Advantageously, the annular plastic heat-shrinking vapor absorber retention space is in fluid communication with dry gas. When the apparatus cooling actuation means is activated, the plastic heat-shrinking vapor absorber heats up the covering sleeve member annular wall. When heated, the covering sleeve member annular wall shrinks and minimizes its area. The annular plastic heat-shrinking vapor absorber retention space contracts and moves outwardly from the food product container domed bottom wall and causes the volume of the dry gas chamber to increase and generate a substantial negative pressure on dry gas. This lowers the partial vapor pressure of the dry gas and the partial vapor pressure of any humidification liquid vapor in the dry gas chamber and thus in the compartment forming sleeve member.

It is anticipated that compartment forming sleeve member may also be made from one of pressure-formed and deep drawn aluminum. It is anticipated that the compartment forming sleeve member side wall can be layered with a wick material that is made to just hold humidification liquid without spilling the same when it receives it. The inward facing protuberances and the outward facing protuberances can be formed by first making the compartment forming sleeve member side walls as a cylinder, then placing its cylindrical wall over a mold and heat-shrinking it to form the inward facing protuberances and the outward facing protuberances. Preferably, the inward facing protuberances tangentially touch the food product container side wall and the outward facing protuberances form a multitude of distinct compartments with the food product container side wall to hold either chemical compounds or humidification liquid against the food product container side wall. The outward facing protuberances also tangentially touch the covering sleeve member side wall and the inward facing protuberances form a multitude of distinct compartments with the covering sleeve member side wall to permit fluid communication with the dry gas.

In all embodiments, it is anticipated that the walls of the compartment forming sleeve member walls may also be infused or layered with ionizable chemical compounds that have reversible endothermic entropy-increasing reactions with the humidification liquid. The compartment forming sleeve member can be heat-shrunk to form its shape by hot-spraying it with a stream of particulates of ionizable chemical compounds at high impact pressure as it is thermally shrunk to form its shape on a mold. In all cases, the compartment forming sleeve member must have a vapor passageway formed by its outer surface walls and the covering sleeve member side wall to only permit vapor to pass through to the plastic heat-shrinking vapor absorber. This is easily achieved in the case of a film material forming the compartment forming sleeve member by banding a vapor wicking material over the compartment forming sleeve member restriction portion.

Other methods of inserting ionizable soluble salts into the compartment forming sleeve member include using a soluble material such as poly vinyl acetate (PVA), layered on the outside wall of the compartment forming sleeve member and then attaching the ionizable chemical compounds to the PVA layer. Other laminating materials such as water soluble glues may be used for this purpose. A dry gas is provided in the dry gas chamber preferably at just below ambient atmospheric pressure.

Extremely dry gas such dry air and dry $co_2$ is provided. The dry gas can be stored at moderate pressure at room temperature. Dry gas can be easily manufactured using either a pressure precipitation system, and by using a cooling system, or a desiccant stack to remove humidification liquid vapor from the wet gas. Dry gas when stored within the dry gas chamber, acts as if said dry gas chamber is evacuated for the purposes of humidification liquid introduced to said dry gas chamber. This is because dry gas has such a low humidification liquid vapor pressure that it can be said to be a vacuous partial humidification liquid partial vapor pressure. In a closed food product container, when exposed to humidification liquid vapor, a dry gas cools by absorbing humidification liquid vapor from its environment in the same manner that water evaporates when exposed to a vacuum. However, since a dry gas carries humidification liquid vapor within its molecular structure as electrostatically bound vapor, it does not permit easy condensation of humidification liquid vapor on surfaces that are above its dew point temperature. This results in a heat transport means that can be understood if one compares what happens to an evacuated gas and its temperature relations to pressure. Dry gas has component molecules of moisture that can only exert a low partial humidification liquid vapor pressure and acts as if it's vapor is in a vacuum. This interstitial molecular sieving of dry gas's potential is a measure of its relative dew point temperature with respect to humidification liquid vapor which like an evacuated gas in a negative temperature in relation to wet gas at room temperature. The partial vapor pressure of the humidification liquid vapor in dry gas is very low, and as such the moisture behaves as if it is suspended in a vacuum when exposed to dry gas. Thus, any action performed by a dry gas in the practice of this invention is equivalent to actions that take place in an evacuated environment for humidification liquid vapor except for the fact that a vacuum environment will evaporate humidification liquid and humidification liquid vapor may condense on cold surfaces that are cooler than the vapor's temperature. Dry gas is an electromotive transport means. This is justified by the fact that the dry gas acts as phonons with definite discrete unit or quantum of vibrational mechanical energy. Phonons and electrons are the two main types of elementary particle excitations central to thermal energy contributing to heat capacity. The removal of polar humidification liquid vapor molecules such as water molecules in vapor form into dry gas is due to an electromotive heat transport potential. Dry gas hyperpnoea is known to change airway reactivity and ion content of rabbit tracheal side (respir physiol. 1997 July; 109 (1):65-72). In the paper entitled, "the nature of gas ions", it is shown that the negative ions in a dry gas are in general a cluster of molecules which for a certain range of electric forces and pressures passes through a transition stage until finally, the negative carriers are practically all electrons, [nature 95, 230-231(29 Apr. 1915) doi:10.1038/095230b0]. In the book "conduction of electricity through gases", (Cambridge university press), it is shown that the excess of the velocity of diffusion of the negative ions over that of the positive is much greater when the gas is dry than when it is moist. Thus dry gas is an electromotive heat transport means. Dry gas essential is therefore superior to a vacuum when it comes to the evaporation of humidification liquid and there is a low partial humidification liquid vapor pressure at any achievable surface temperature of a cooling device especially if the dry gas relative dew point with respect to humidification liquid vapor is in the range below the formation of a solid from the humidification liquid. In the case of water vapor, it is below 32° F. In polymer electromotive membranes (PEM) such as Nafion®, a hydrophobic Teflon-like backbone is used with a sulfonic end group attached to electromotive transport moisture through a membrane. Poly vinyl acetate (PVA) containing membranes are also used for the purposes of filtration of ions from a solution. The vapor pressure of humidification liquid vapor is gradated in such chemicals to generated the flow as for example, thirsty molecules of Nafion® keep pulling humidification liquid vapor deeper and deeper through their structure by electromotive heat transport. Dry gas behaves in a similar fashion, by generating a spherical gradient of dry gas to transport humidification liquid vapor and equilibrate vapor pressure of the humidification liquid vapor.

The potential to remove humidification liquid such as water from the dry gas can result in dew points between 10° F. and −150° F. Thus any humidification liquid that is above these temperatures has a tendency to be absorbed by the dry gas that is below its dew point temperature. This potential for dry gas and specially designed wicking layers to absorb humidification liquid from cold surfaces can be exploited with several cooling processes to generate a continuous process that results in far more efficient cooling that could otherwise be achieved with either desiccants and vacuums or stoichiometric endothermic reactions. For example, to cool 16 oz of beverage by 30° F. one needs to dissolve at least 127 g of potassium chloride in about 380 g of water using conventional prior art. This is not commercially viable in a self-cooling food product container technology that relies only on this process. This invention can in one mode use far less ionizable compounds (67 g) in one mode with 100 g of humidification liquid and regenerate the ionizable compounds for reuse. For example, ion exchange compounds and other types of electrochemical and electromotive membranes such as PEM, absorb water vapor and preferentially cool by transmitting protons through their structure, converting liquid to transmitted vapors. The compartment forming sleeve member can be manufactured from similar materials such as ion exchange film materials to act in a similar fashion transmitting water formed by reactions of the chemicals in the humidification liquid chamber to further cool. The dry gas in the dry gas chamber can interact multiple times with humidification liquid vapor in the dry gas chamber to humidify and further cool.

Given a beverage mass of $m_b$, the heat capacity $c_p$, the heat to be removed to bring about a temperature change of $\Delta t$, is given by $$Q_c = m_b\, c_p\, \Delta t,$$

The amount of water (kg/sec) evaporated from an area of exposure to dry gas at temperature equal to the water and with starting humidity ratio, $x_s$=0.005, (kg of $H_2O$ per kg of dry gas), to generate water with a relative humidity ratio, x=0.02, is given by the empirical formula (the 2003 Ashrae handbook-HVAC Applications), (Ashrae 2003), (Shah 1990, 1992, 2002):

$$g = \theta A_{x_s - x}$$

Where, θ=(25+19 v), and v is the velocity of the gas flow.

As an example using dry air, substantial calculations show that for a flow rate of 1 m/sec of air for 45 seconds of flow at a starting relative humidity of 0.005 and an exposure area of about 225 $cm^2$, (6"×6" cooling matrix), the approximate rate of removal of water is equal to 0.158 g/sec. The total heat required to raise 7.8 g water from a room temperature of 22° C. to a vapor is given by dry gas is given by:

$$E_{Total} = E_h + E_v$$

Where, $E_h$ Is the energy used to heat the water and $E_v$ Is the energy required to evaporate the water at 100° C.

$$E_h = 4.184\ \frac{\text{J}}{\text{Cal}} \times 7.8\ \text{g} \times 82^\circ\ \text{C.} = 2676\ \text{Joules},$$

$$E_v = 40650\ \frac{\text{J}}{\text{Mole}} \times \frac{7.8\ \text{g}}{18\ \text{g/Mole}} = 17615\ \text{Joules}$$

This translates 17,615 joules of energy per cooling matrix removed by dry gas only. Only 54,790 joules of energy are required to cool 453 g (16 fluid oz.) Of beverage by 20° C. from room temperature. Thus if no endothermic actions occur, only two (2) second wicking layers may be required in the cooling matrices even though many more can be added. It is evident there is a lot of thermodynamic potential stored between the dry gas for heat H removal. Dry Air, $CO_2$, and nitrogen have very similar thermodynamic behavior for humidification processes. As such dry air is not the only gas that can be used for this purpose. Any suitable extremely dry gases such as dry $co_2$ will suffice as long as its dew point can be adequately lowered to be thermodynamically acceptable.

Studies published by W. W. Mansfield in Nature (205, 278 (16 Jan. 1965); DOI:10.1038/205278A0) entitled the "Effect of carbon dioxide on evaporation of water", and studies published by Frank Sechrist, in nature (199, 899-900; 31 Aug. 1963), entitled "Influence of gases on the rate of evaporation of water" show that water containing dissolved carbon dioxide, or surrounded by an atmosphere of this gas, evaporated 15-50 percent more rapidly than water in the presence of just air. Thus, advantageously, the use of a dry gases such as $CO_2$, which is already found in carbonated beverages, can definitely increase the cooling capacity of dry gases on water.

The present invention differs from all the cited prior art and discloses a novel technology for cooling bottles and cans (metal and plastic beverage food product containers) with a label like structure with the additional aspect of using electromotive heat transport means of vapors through to progressively cool a beverage by multiple means. The cost of manufacture is now only limited by the cost of the covering sleeve member, the cost of the compartment forming sleeve member, the cost of chemical components, and the cost of the processes used to manufacture the apparatus.

Dry gas can also transport water vapor from cold solutions in an electrolyte invasion process to dehydrate these ionic solutions and permit solutes to be active again for further use of their thermodynamic potential. The dry gas will not only cool, but also permit the stoichiometric imbalance of reusing solutes to further perform cooling. The invention can be practiced with only dry gas and a dry gas chamber without chemicals. For example, the humidification liquid can be generated by the chemical reactions of water donating hydrated chemicals in the dry gas chamber. This produced humidification liquid can be evaporated and absorbed by the dry gas to further cool. Further, the plastic heat-shrinking vapor absorber keeps the dry gas dry within the dry gas chamber. Humidification liquid, vapor absorbed by dry gas can be sorbed into plastic heat-shrinking vapor absorber to lower the vapor pressure of the humidification liquid chamber and cause further evaporation and cooling of the humidification liquid held between the compartment forming sleeve member and the food product container side wall, which in turn cools the food product.

Removal of the absorbed humidification liquid vapor from the wet dry gas by the plastic heat-shrinking vapor absorber permits the dry gas to be refurbished and used again without a need for a large volume of dry gas in the dry gas chamber and without the need for a vacuum. Thus, the present invention has several advantages in methods and function over evaporative, endothermic and desiccant-vacuum systems disclosed in prior art.

Second Embodiment of the Present Invention

A second embodiment of the invention is shown in FIG. 11, FIG. 12 and FIG. 20. In the second embodiment of the invention, the same elements used in the first embodiment are used to reconfigure another method of use and operation of the apparatus. This time, the dry gas seal is moved further down and placed to seal between the inward facing surface of the covering sleeve member side wall and the outward facing surface of the compartment forming sleeve member side wall bottom edge. Thus, the compartment forming sleeve member, the dry gas seal, the covering sleeve member seal and the food product container in-part form the humidification liquid chamber. The humidification liquid is held in reacting chemical compounds that are highly hydrated. Thus the humidification liquid is released in place by reactions of the reacting chemical compounds that have endothermic reactions that generate water as humidification liquid. The dry gas chamber is formed below the dry gas seal separated from the humidification liquid chamber. In this embodiment of the invention, reacting chemical compounds are stored exclusively in distinct compartments on the two surfaces of the compartment forming sleeve member wall, in the distinct compartments formed by the food product container side wall with the outward facing protuberances of the compartment forming sleeve member. Reacting chemical compounds can also be stored outside the compartment forming sleeve member side wall, in the distinct compartments formed by the covering sleeve member side wall with the inward facing protuberances of the compartment forming sleeve member.

Third Embodiment of the Present Invention

A third embodiment of the invention is shown in FIG. 15. In the third embodiment of the invention, the same elements used in the first embodiment are used to reconfigure another method of use and operation of the apparatus 10. In a third embodiment of the invention, the dry gas seal is simply moved to seal between the inward facing surface of the compartment forming sleeve member side wall top edge and the outward facing surface of the food product container side wall. Humidification liquid is used to fill the distinct compartments formed between the food product container side wall and the outward facing protuberances of the compartment forming sleeve member.

Fourth Embodiment of the Present Invention

A fourth embodiment of the invention is shown in FIG. 16. In the fourth embodiment of the invention, the same elements used in the first embodiment are used to reconfigure another method of use and operation of the apparatus. In a fourth embodiment of the invention, the dry gas seal is again moved approximately half way up the inward facing surface of the compartment forming sleeve member side wall to seal between the inward facing surface of the compartment forming sleeve member side wall top edge and the outward facing surface of the food product container side wall as in the second embodiment. Humidification liquid is filled into the distinct compartments formed below the dry gas seal between the inward facing surface of outward facing protuberances of the compartment forming sleeve member the outward facing surface of the food product container side wall. This permits dissolving chemical compounds to be filled above the dry gas seal into the distinct compartments formed between the inward facing surface of outward facing protuberances of the compartment forming sleeve member the outward facing surface of the food product container side wall.

Fifth Embodiment of the Present Invention

In a fifth embodiment of the invention, no covering sleeve member is required. As before, a food product container is provided with a compartment forming sleeve member with a compartment forming sleeve member side wall that has surface protuberances preferably on the inside surface as shown in FIG. 23 and FIG. 24. These compartment forming sleeve member side wall protuberances can be in the form of waves with inward facing undulations and outward facing undulations as before. However, only the inward facing protuberances are preferred in this embodiment. These inward facing protuberances preferably are spaced from each other and can take the form of thin flexible ribs that are deformable to break barriers between the distinct compartments. The inward facing protuberances are required to increase its strength, surface area, and permit a variety of distinct reacting chemical compounds to be stored exclusively in distinct compartments between any of inward facing protuberances of the compartment forming sleeve member side wall against the food product container side wall. These protuberances of the compartment forming sleeve member side wall are but examples of the possible protuberances that can be made on the compartment forming sleeve member side wall. As before, the inward facing protuberances of the compartment forming sleeve member side wall mate tangentially with a food product container side wall to form the distinct outward facing distinct compartments with the food product container side wall. These distinct compartments hold endothermically reacting chemical compounds (and may also hold dissolving chemical compounds) in the distinct compartments separated from one another before they react.

The compartment forming sleeve member has a compartment forming sleeve member sealing portion which can be made to seal against the food product container side wall to form a fluid seal around the inward facing protuberances of the compartment forming sleeve member side wall mate tangentially with a food product container side wall. When the compartment forming sleeve member sealing portion is sealed against the surface of the food product container side wall the closed space forms a humidification liquid chamber which holds reacting chemical compounds and dissolving chemical compounds in between the compartment forming sleeve member the food product container side wall.

A cooling actuation means 41 is provided as shown in FIG. 24 by massaging the compartment forming sleeve member against the food product container side wall to one of deform and break off the inward facing protuberances of the compartment forming sleeve member side wall against the food product container side wall to permit the reacting chemical compounds to mix with each other and react and generate a first endothermic cooling of the food product. Advantageously, a second endothermic cooling can be achieved if dissolving chemical compounds are provided to mix and dissolve with reaction released humidification liquid from the reactions. The invention as stated in the opening paragraphs provided the following advantages, a) A variety of distinct reacting chemical compounds and dissolving chemical compounds can be stored exclusively in distinct compartments between any of the inward facing protuberances against the food product container side wall. Many species of distinct reacting chemical compounds can be stored between the inward facing protuberances when they form distinct compartments against the food product container side wall. Thus pairs of endothermically reacting chemical compounds of different species of reactants can be stored in said distinct compartments. Further different species of dissolving chemical compounds can also be stored in said distinct compartments.

b) Further, humidification liquid created by the reacting chemical compounds can be used to endothermically dissolve dissolving chemical compounds to generate even more cooling.

c) deforming the protuberances permits the reacting chemicals to come into contact with each other and mix so that react endothermically.

It is an object of the present invention to provide a method of cooling a food product container using a novel heat transport means to remove heat from a food product using dry gas as an ion reformation agent that causes reformation of solutes from their ions in solution to their original non-ionic states to be reused again multiple times for the same purpose.

It is another object of the present invention to provide a method of assembling the self-cooling a food product container in its completed form with a food product such as a beverage therein with a dry gas heat transport means to cool said food product container.

It is still another object of this invention to provide a self-cooling apparatus for cooling a food product container using a conventional filled and sealed food product container in its completed form using endothermic ionization of chemical compounds with water to further cool a food product.

It is a further object of the present invention to provide an apparatus to that uses the humidification of a substantially dry gas to evaporate water from solutions of ionized chemicals compounds to regenerate said ionized compounds in a non-ionic form again to further ionize them to further cool a food product endothermically.

It is a further object of the present invention to provide an apparatus to that uses the humidification of a substantially dry gas to evaporate water from solutions formed by reacting chemicals compounds that react endothermically to cool and reaction released humidification liquid such as water, and to use dry gas and a vapor absorber to further cool by evaporation.

It is finally an object of the present invention to provide such an apparatus which is thermodynamically simple, viable and cost effective of removing heat from and thereby cooling a food product.

The present invention accomplishes the above-stated objectives, as well as others, as may be determined by a fair reading and interpretation of the entire specification.

Accordingly, the present invention can achieve much more cooling including the following:

a) Remove and evaporate water vapor from cold solutions to increase cooling;

b) Dehydrate ionized compounds with negative entropy of solution back to their original ionizable compound states to reuse them over again for more cooling (conservation of ionizable compounds);

c) Remove heat of evaporation from a cold solution but also any reversible reformation energy of compounds from ionic solutions to prevent a reheating by the reversal of heat of formation of said ions from solution.

d) To evaporate water vapor from reaction-formed water using a dry gas to take away more heat and clean vapor to further cool.

e) To automatically rarify dry gas by deformation of an annular plastic heat-shrinking vapor absorber retention space to increase the volume of the dry gas chamber and effectuate rarefication of a dry gas and cause even more evaporation of humidification liquid by lowering the partial vapor pressure of the same.

Heat Transport Means

The first heat transport means disclosed in this invention uses a substantially dry gas as a medium for regenerating ionic states from a solution of the humidification liquid and solutes forming ions for reuse again. This achieves the following:

a) A cooling by ionizing compounds that dissolve in humidification liquid that enters into the dry gas chamber;

b) Further cooling by dry gas reconstituting and reforming the ionizable compounds in a reversible salting of humidification liquid to deplete the solvent of the solution and dry solutes for reuse with more humidification liquid entering the dry gas chamber to achieve more of the same by reusing regenerated solutes of demineralization to further ionize and cool again and repeat the cooling cycle.

c) More cooling by evaporation of the humidification liquid of (a) or (b) by the dry gas.

The humidification liquid is preferably water and can also be a liquid with an ionizing potential for the ionizable chemical compounds or solutes.

The deposition of solutes by dry gas medium such as by dry gas removes the heat generated by demineralization as the humidified dry gas medium increasing its dew point temperature without heating up. Thus, there is no need to store a stoichiometric ratio of solvents such as humidification liquid and ionizable compounds Such as ionizable compounds to cool a beverage. The humidification liquid can be in excess of the ionizable compounds and the ionizable compounds will ionize multiple times through multiple mineralization and demineralization cycles. If the rate of solvation and the rate of demineralization of such solution is controlled, a dry gas will regenerate solutes for further solvation by removing the humidification liquid at a controlled rate from such a reaction and essentially transport this water vapor for reuse without reheating the cooling surfaces. The ions give off the same energy they are absorbed from the humidification liquid ions being broken. The efficiency is in the direct transfer of the bond energies from broken humidification liquid molecules to the reformation energy of humidification liquid vapor as a vapor that is immediately transported away or absorbed by dry gas humidification and taken away. An example using water is shown:

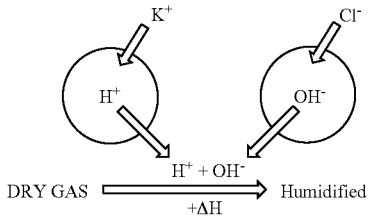

Where the product is a liquid with water, a quantity of the product itself can function as the humidification liquid such as water, if it does not react adversely with the solutes. Where the product is semi-solid or solid, a separate liquid which preferably is simply a suitable humidification liquid provided.

A food product container is provided, including a food product container having a release port and a release port opening means. The food product container preferably is one of a metal can and a plastic bottle. A dry gas is provided preferably one of air, nitrogen and carbon dioxide. The dry gas preferably has a dew point temperature in relation to humidification liquid vapor below 10° F.

BRIEF DESCRIPTION OF THE DRAWINGS

Various other objects, advantages, and features of the invention will become apparent to those skilled in the art from the following discussion taken in conjunction with the following drawings representing the preferred embodiments of the invention, in which:

In FIG. 11, the humidification liquid chamber is filled with hydrated reacting chemical compounds that reaction released humidification liquid by their endothermic reactions with one another. The plastic heat-shrinking vapor absorber is between the compartment forming sleeve member bottom wall and the covering sleeve member bottom wall. When the dry gas seal is broken by finger pressure, the covering sleeve member side wall can be massaged by hand to cause the reacting chemical compounds to mix and react endothermically and generate a first endothermic cooling and at the same time create humidification liquid. The humidification liquid vapor is absorbed by dry gas and as before and transported into the plastic heat-shrinking vapor absorber D to cause a second cooling.

DETAILED DESCRIPTION OF THE PREFERRED EMBODIMENTS

Figure 1:
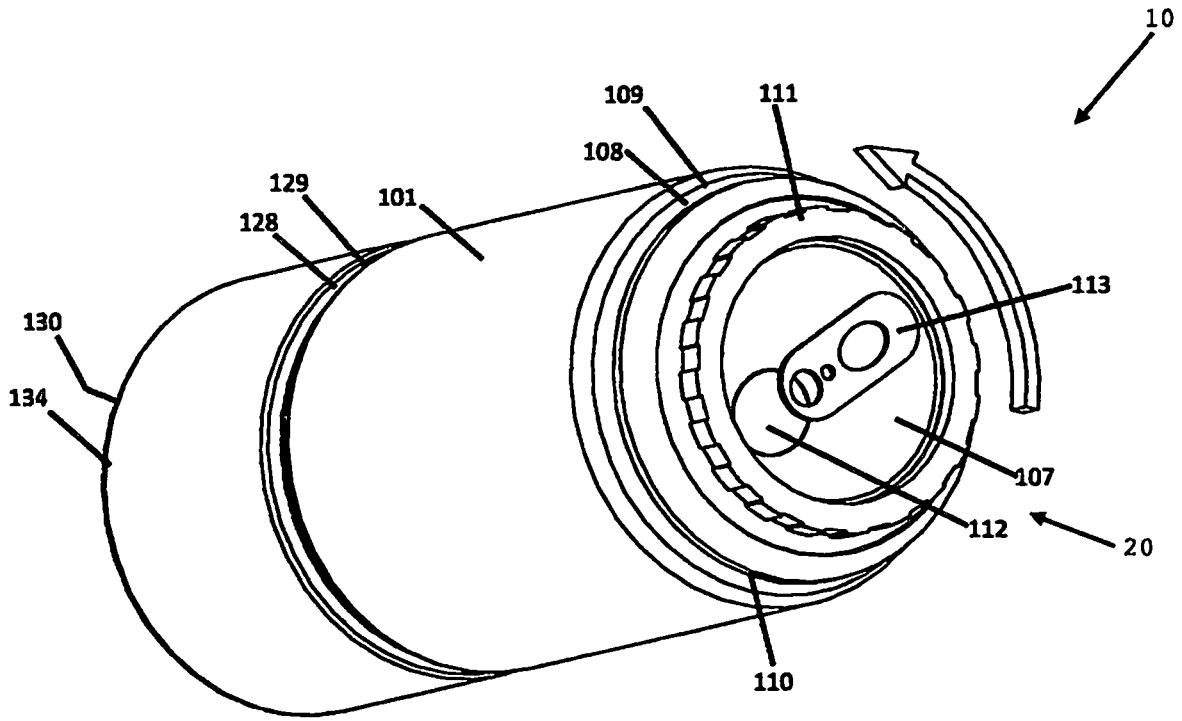
FIG. 1 shows a food product container as a metal can affixed to a covering sleeve member showing some details of the sealing portions of the covering sleeve member and some details of the food product container top wall. The curved arrow shows that the food product container can rotate in relative to the covering sleeve member and vice versa to activate the cooling when the surface of a seal on the food product container is disrupted by a seal breaking structure.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

For orientation purposes and clarity, the food product container 20 is assumed to be standing in a vertical orientation with the food product container 20 standing in a normal placement orientation. This invention uses the thermodynamic potential of the evaporation of a humidification liquid hl, such as water or a suitable liquid and the ability of a substantially low vapor pressure medium such as a dry gas DG to force this evaporation from even cold liquids.

First Embodiment of the Invention

Referring to FIG. 1-10, a standard food product container 20 is provided. Food product container 20 is preferably is a cylindrical beverage food product container of standard design, and with standard food product release means 113 and a standard food product release port 112. Food product container 20 is provided with a seal breaking structure 122 on the food product container side wall 100 surface which can be an indentation that does not breach the food product container side wall 100. Seal breaking structure 122 can also be a simple self-adhesive protuberance that disrupts the smoothness of the food product container side wall 100 and thus can disrupt its sealing ability. The location of the seal breaking structure 122 shall be provided accordingly in the following.

A covering sleeve member seal 121 is provided in the form of a thin loop structure made from one of an O-ring seal, a metal band seal, a rubber band seal, a putty seal, and sealing wax seal, and a glue bonding agent. Preferably the covering sleeve member seal 121 is provided in the form a looped rubber band, usually ring shaped, and commonly used to hold multiple objects together such as for holding a stack of papers. Covering sleeve member seal 121 diameter preferably is about 75% of the perimeter that circumscribes the food product container 20. The covering sleeve member seal 121 cross-sectional dimensions preferably are less than 4 mm. The covering sleeve member seal 121 should form a tight sealing band around the food product container 20. The covering sleeve member seal 121 is placed circumferentially and sealingly tight around the food product container side wall 100 in a plane parallel to the diametric plane of the food product container 20 and close to the food product container top wall 107.

A dry gas seal 123 is provided preferably also in the form of an O-ring seal, a rubber band seal, a putty seal, and sealing wax seal, a glue bonding agent and shaped in the form of a thin loop, usually a ring structure. Preferably dry gas seal 123, is made from a seal material such as the type with a rectanguloid cross section, such as a rubber band commonly used to hold multiple objects together. The dry gas seal 123 cross-sectional dimensions preferably is less than 4 mm. The dry gas seal 123 is preferably expandable to form a tight seal around the food product container 20. The dry gas seal 123 is placed in a plane circumferentially slanted at a small angle relative to the diametric plane of the food product container 20. Since a round-sectioned seal will crawl and tend to symmetrize on the diametric plane of the food product container 20, a rectanguloid-sectioned seal is preferred but not necessary. The dry gas seal 123 is slanted at an angle relative to the relative to the diametric plane of the food product container 20 with a maximal distal separation of about 20 mm below covering sleeve member seal 121. The maximal separation between the covering sleeve member seal 121 and the dry gas seal 123 is dictated by the volume of space that can be formed between the two seals when the apparatus is completed as will be determined later. Seal breaking structure 122 is located between dry gas seal 123 and the covering sleeve member seal 121 before the apparatus 10 is used and should be almost tangent to the dry gas seal 123.

Figure 22:
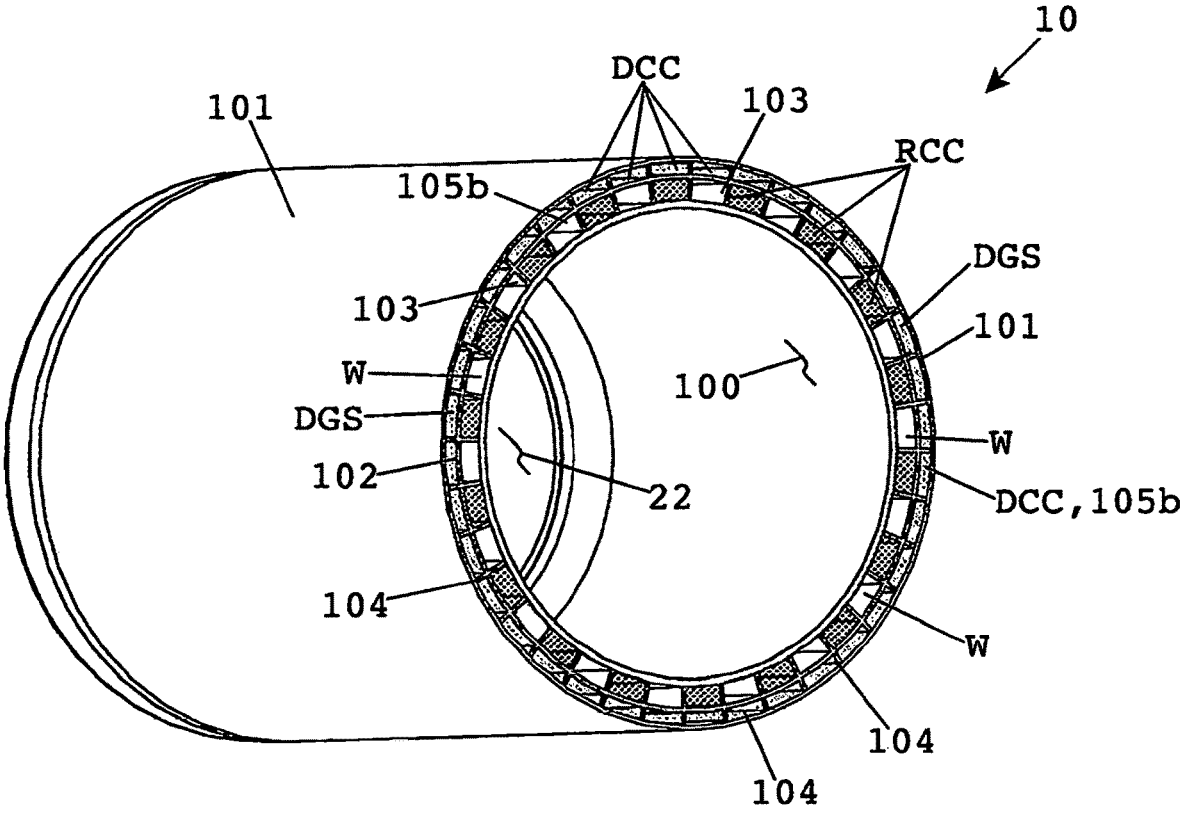
FIG. 22 shows another form taken by the protuberances as an example of a case when they can be ribs on the walls of the Compartment forming sleeve member.

A compartment forming sleeve member 102 is provided with a compartment forming sleeve member side wall 105 and compartment forming sleeve member bottom wall 106 and in a first embodiment, the compartment forming sleeve member 102 is preferably made from impermeable materials such as one of heat-shrinkable stretch-formed polyvinyl chloride (PVC), and heat-shrinkable stretch-formed polyethylene terephthalate (PET), injection molded plastics and rubbers. Other materials may be used depending on the way the compartment forming sleeve member 102 is fashioned. Outward facing surface of the compartment forming sleeve member side wall 105 is preferably lined with a flexible wick 140 made from a wicking material such as one of cotton, porous plastic, woven mesh, absorptive paper, and wool. Compartment forming sleeve member side wall 105 may be laminated with wick 140 on the inside surfaces also. Wick 140 must be thin to reduce its impact as a thermal mass on the functioning of the apparatus 10. Compartment forming sleeve member 102 can initially be formed with cylindrical compartment forming sleeve member side wall 105 and then lined with the wick 140 and then molded into a variety of shapes by one of compressive molding and heat-shrinking to form projected protuberances on its surface. Otherwise its shape may be injection molded with the wick 140 placed inside the mold side walls to adhere to the compartment forming sleeve member side wall 105. For example, compartment forming sleeve member side wall 105 is preferably made with inward facing protuberances 103 and outward facing protuberances 104 respectively on its walls to increase its surface area and provide for strength, surface area, and permit a variety of distinct chemical compounds to be stored between any of the spaces between the protuberances, as shown in FIG. 2, FIG. 12, FIG. 13, and FIG. 20. The number of protuberances must be more than one and can be any suitable number that permits granular chemicals to be stored between said protuberances. FIG. 2, FIG. 12, FIG. 20, FIG. 21 and FIG. 22 are but examples of the possible protuberances that can be made on the compartment forming sleeve member 102. For example, compartment forming sleeve member 102 may be injection molded to have curved or linear ribs projecting as shown in FIG. 22 from its walls to serve the same the same purpose of distinct compartmentalizing the compartment forming sleeve member side wall 105 to store reactive chemical compounds RCC of a variety of chemical compounds S, that can react with one another to provide endothermic cooling, and to store dissolving chemical compounds DCC of a variety of chemical compounds S that can dissolve endothermically in a humidification liquid HL. A variety of projected shapes such as the aforementioned protuberances may be used to increase the strength and surface area of compartment forming sleeve member 102. The projected shapes form channels of such protuberances, such as the inward facing protuberances 103 and outward facing protuberances 104 shown as an example in FIG. 2, FIG. 12, FIG. 20, FIG. 21 and FIG. 22 to give strength to compartment forming sleeve member 102 and also to permit dry gas DG to fill and saturate the outside surface of the compartment forming sleeve member 102 and if required the inside surface the compartment forming sleeve member 102. Preferably the projected protuberances of compartment forming sleeve member 102 form channels along the compartment forming sleeve member side wall 105 to also permit dry gas DG to fill and saturate the compartment forming sleeve member 102. Preferably, the compartment forming sleeve member 102 is lined with a layer of wick 140 to absorb humidification liquid HL and to hold a minimum volume of humidification liquid HL by osmotic pressure without spilling it. Inward facing protuberances 103 and outward facing protuberances 104 of the compartment forming sleeve member side wall 105 must frictionally tangentially contact the food product container side wall 100, to form distinct compartments between the compartment forming sleeve member side wall 105 and the food product container side wall 100.

The compartment forming sleeve member side wall 105 is circumferentially attached to frictionally touch tangentially contact the food product container side wall 100 to cover at least in part the food product container side wall 100 below dry gas seal 123. Ultrasonic welding, glues and tape may also be used to hold it firmly in place and to at least form distinct compartments with the food product container side wall 100. Preferably, the compartment forming sleeve member side wall 105 extends to cover-in-part an exposed surface of the food product container side wall 100 below the dry gas seal 123, but it is anticipated that compartment forming sleeve member side wall 105 may also cover and surround in whole the food product container side wall 100 below the dry gas seal 123, and that compartment forming sleeve member bottom wall 106 extend to cover and surround the food product container domed bottom wall 22 as a cup-like sleeve structure. Inward facing protuberances 103 and outward facing protuberances 104 should be sturdy and prevent compartment forming sleeve member side wall 105 from collapsing under reduced pressures.

Covering sleeve member 30 is provided. Covering sleeve member 30 is preferably made from one of heat-shrinkable materials stretch-formed polyethylene terephthalate (PET), polyvinyl chloride (PVC), and other heat-shrinkable materials also in the form of a thin-walled cup-like structure that to surrounds and encloses in whole or in part the food product container 20. Preferably, covering sleeve member 30 has covering sleeve member side wall 101 shaped to follow the contour of food product container side wall 100. Covering sleeve member side wall 101 can take on a variety of shapes but must permit said covering sleeve member side wall 101 to mate with portions of the food product container side wall 100 during the manufacturing process as will be described in the foregoing. The covering sleeve member side wall 101 covers in whole or in part a sealed food product container 20 containing a food product P. Covering sleeve member side wall 101 is preferably made from one of heat-shrinkable materials stretch-formed polyethylene terephthalate (PET), polyvinyl chloride (PVC), and other heat-shrinkable materials, however, covering sleeve member side wall 101 can also be made with thin aluminum material as a deep-drawn container, and must be re-formable by spin forming and crimping to form seals with the food product container 20. Covering sleeve member side wall 101 preferably covers in-part food product container side wall 100 and may extend to cover in part the food product container top wall 107. The covering sleeve member side wall 101 just slidingly fits over the compartment forming sleeve member 102. Should the covering sleeve member side wall 101 extend and cover the of the food product container top wall 107, then an extension grip 111 made from a simple plastic ring is provided to snap to the food product container top wall seam 114 to permit a user to be able to grip and rotate extension grip 111 and thus rotate the food product container 20 relative to the covering sleeve member 30.

Figure 17:
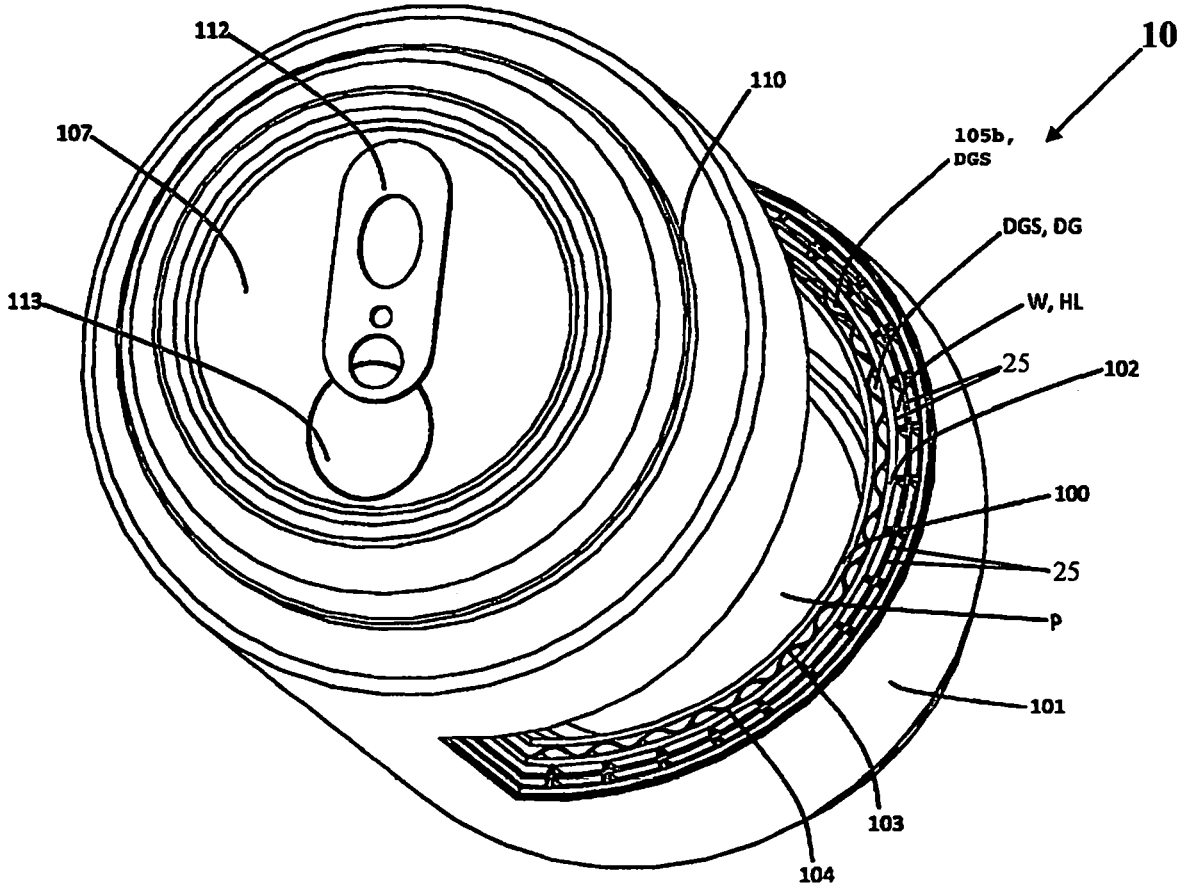
FIG. 17 shows a partial cut-away view of the apparatus 10 with protuberances on the compartment forming sleeve member and support structures on the covering sleeve member.

The covering sleeve member side wall 101 covers over compartment forming sleeve member 102 and covers in-whole or in-part the food product container 20. Covering sleeve member side wall 101 preferably covers in-part food product container side wall 100 and may extend to cover in part the food product container top wall 107. Covering sleeve member side wall 101 has a covering sleeve member sealing portion 108 that can be heat-shrunk to shrink in diameter and seal against the food product container side wall 100 to form a covering sleeve member side wall seal 109. As shown in FIG. 17, covering sleeve member side wall 101 may be constructed with support structures 25 such as channels and cavities that permit it to have adequate structural strength to prevent collapse when a rarefication of dry gas GS occurs.

It is anticipated that covering sleeve member side wall end 110 is located at the covering sleeve member sealing portion 108, but it is contemplated that the covering sleeve member side wall end 110 may extend beyond the covering sleeve member sealing portion 108. When the covering sleeve member sealing portion 108 is heat-shrunk or mechanically formed, covering sleeve member side wall 101 clamps around the surface of covering sleeve member seal 121 and dry gas seal 123 to form humidification liquid chamber W between the two seals respectively. Humidification liquid HL is sealingly stored between the humidification liquid chamber w.

The covering sleeve member 30 is rotatable relative to the food product container side wall 100. Thus, advantageously, dry gas seal 123 and covering sleeve member seal 121 rotate with covering sleeve member 30 in unison, relative to the food product container side wall 100. It is anticipated that covering sleeve member side wall 101 deforms by compressive shrinking around the covering sleeve member seal 121 to securely hold the covering sleeve member seal 121 and provide for the same to sealingly rotate with covering sleeve member 30. It is anticipated that covering sleeve member side wall 101 partially deforms by compressive shrinking around the covering sleeve member seal 121 to securely hold the covering sleeve member seal 121 and provide for the same to sealing rotate with covering sleeve member 30. However, it is anticipated that covering sleeve member seal 121 may not rotate with covering sleeve member 30 but still forms a seal. However, dry gas seal 123 must rotate in unison with covering sleeve member 30 relative to the food product container side wall 100.

Covering sleeve member side wall 101 has a covering sleeve member sealing portion 109 that can be heat shrunk or mechanically formed to shrink and seal against the food product container side wall 100 as stated above. Covering sleeve member side wall 101 when shrunk also seals against the dry gas seal 123, pressing the same against the food product container side wall 100 to form a seal. It is anticipated that covering sleeve member sealing portion 108 deforms partially around the covering sleeve member seal 121 to securely hold the covering sleeve member seal 121 and provide for the same to rotate with covering sleeve member 30. It is anticipated that covering sleeve member side wall 101 also partially deforms around the dry gas seal 123 to securely hold the dry gas seal 123 and provide for the same to sealingly rotate with covering sleeve member 30 when rotated. This provides a first cooling actuation means θ, when covering sleeve member 30 is rotated.

Covering sleeve member side wall 101 has a covering sleeve member restriction portion 128 that can one of be heat-shrunk and be mechanically formed to clamp against a portion of the compartment forming sleeve member 102 to form a restricted vapor passageway **129*a* for humidification liquid HL vapor Vw and dry gas DG to pass through in a controlled manner. It is anticipated that when the covering sleeve member restriction portion 128 is shrunk, it clamps firmly around the surface of compartment forming sleeve member 102 and closes off any protuberances or projections to form a rotatable restricted vapor passageway 129*a*. It is anticipated that covering sleeve member side wall 101 slidingly rotates over restricted vapor passageway 129*a*** when rotated.

Covering sleeve member 30 has covering sleeve member bottom wall 130 that sealing connects to covering sleeve member side wall 101. Covering sleeve member bottom wall 130 sealing connects to an inward protruding covering sleeve member shrinkable annular wall 133. Covering sleeve member shrinkable annular wall 133 is flexible and can respond to pressure changes by either collapsing or expanding.

Covering sleeve member inner surfaces define in part the dry gas chamber DGS which extends to cover the compartment forming sleeve member and the space formed by the covering sleeve member bottom wall 130, covering sleeve member shrinkable annular wall 133.

It is anticipated that covering sleeve member 101 may also be made from one of spun aluminum, hydraulically formed aluminum and deep drawn aluminum to provide for all the sealing required. In such a case, covering sleeve member shrinkable annular wall 133 may also be made from one of heat-shrinkable PET and PVC material and added on to the covering sleeve member bottom wall 130 by ultrasonic welding or gluing. Covering sleeve member shrinkable annular wall 133 is flexible and can respond to pressure changes by either collapsing or expanding.

As shown in the figures, a thin-walled open ended support cylinder 132, with support cylinder holes 137 close to its top end may be placed to rest on the covering sleeve member bottom wall 130 between the covering sleeve member side wall 101 and the covering sleeve member shrinkable annular wall 133 and to act as a support member for the covering sleeve member bottom wall 130 against the food product container 20 to prevent shrinking forces from collapsing covering sleeve member bottom wall 130. Covering sleeve member shrinkable annular wall 133 is flexible and can respond to pressure changes by either collapsing or expanding.

Annular plastic heat-shrinking vapor absorber retention space 131 within the dry gas chamber DGS is formed between the space defined by the inner surface of the support cylinder 132, inner surface covering sleeve member shrinkable annular wall 133 and the inner surface covering sleeve member bottom wall 130. Annular plastic heat-shrinking vapor absorber retention space 131 is in fluid communication with the dry gas and is within dry gas chamber DGS. An annular thermal wax retention space 136 is also formed in the dry gas chamber DGS between the outer surface of the support cylinder 132, the inner surface of the covering sleeve member shrinkable annular wall 133 and the inner surface of the covering sleeve member bottom wall 130. Covering sleeve member shrinkable annular wall 133 is flexible and can respond to pressure changes by either collapsing or expanding. Annular thermal wax retention space 136 may be optionally filled with a suitable thermal wax 138 that can melt at temperatures ranging from 70° F. to 160° F. to regulate the amount of heat exposed to the covering sleeve member shrinkable annular wall 133. Support cylinder 132 prevents the covering sleeve member bottom wall 130 from collapsing and deforming its shape relative to food product container 20.

A cooling actuation means θ is provided when covering sleeve member 30 is rotated with the dry gas seal 123 and dry gas seal 123 crosses over seal breaking structure 122 to break the seal formed by the dry gas seal between the food product container side wall 100 and the covering sleeve member side wall 101 and to expose humidification liquid HL from the humidification liquid chamber W into the dry gas chamber.

The compartment forming sleeve member 102, is preferably designed with inward facing protuberances 103 and outward facing protuberances 104 such as shown in FIG. 2, FIG. 12, FIG. 13, and FIG. 20 to form a pattern of distinct compartments surrounding the food product container side wall 100. In such a case, the inward facing protuberances 103 will be tangent to the food product container side wall 100 and the outward facing protuberances 104 will be tangent to the covering sleeve member side wall 101. This increases its strength and surface area, and permits a variety of distinct reacting chemical compounds RCC that react endothermically and dissolving chemical compounds DCC that dissolve endothermically to be stored isolated from one another in the respective chambers formed between protuberances as shown in FIG. 22. It is anticipated that each respective undulation serves as a storage means for a distinct chemical compounds S that dissolves endothermically to cool.

Annular plastic heat-shrinking vapor absorber retention space 131 holds a plastic heat-shrinking vapor absorber D, such as silica gel, molecular sieves, clay desiccants such as montmorillonite clays, calcium oxide, and calcium sulfide. Annular plastic heat-shrinking vapor absorber retention space 131 is preferably stretch-formed by one of thermoforming, injection-stretch-blowing, and by vacuum forming when covering sleeve member 30 is formed. Covering sleeve member shrinkable annular wall 133 responds to an increase in its temperature by deforming to increase the volume of the dry gas chamber DGS and thus rarefy the dry gas contained therein. This deformation is caused by the plastic heat-shrinking vapor absorber D heating up and thus heating covering sleeve member shrinkable annular wall 133 as it absorbs humidification liquid HL vapor from humidified dry gas DG in the dry gas chamber DGS. The dry gas chamber DGS is in fluid communication with the plastic heat-shrinking vapor absorber D and with the restricted vapor passageway 129*a* and thus, advantageously, the annular plastic heat-shrinking vapor absorber retention space 131 is in fluid communication with the dry gas chamber DGS, and the interior of the compartment forming sleeve member 102. When the cooling actuation means θ is activated, the plastic heat-shrinking vapor absorber D heats up the covering sleeve member shrinkable annular wall 133. The covering sleeve member shrinkable annular wall 133 protrudes and intrudes into the dry gas chamber DGS. The shape of the protuberance is important in enhancing the cooling performance of the apparatus. The shape of the protuberance formed by covering sleeve member shrinkable annular wall 133 can be an inverted cup, a dome, and preferably any suitable shape that minimizes the volume of dry gas chamber DGS. Covering sleeve member shrinkable annular wall 133 is flexible and can respond to pressure changes by either collapsing or expanding.

The shape of covering sleeve member shrinkable annular wall 133 must minimize the dry gas chamber DGS and maximizes its intrusion into the dry gas chamber DGS. In the examples shown in the figures, the shape of the of the protuberance formed by covering sleeve member shrinkable annular wall 133 is an inverted cup-like shape and a dome. Covering sleeve member shrinkable annular wall 133 is flexible and can respond to pressure changes by either collapsing or expanding. When heated, the to covering sleeve member shrinkable annular wall 133 shrinks and minimizes its area. The annular plastic heat-shrinking vapor absorber retention space 131 expands and increases in volume outwardly and causes the volume of the dry gas chamber DGS to maximize and generate a substantially lower pressure on dry gas DG that is less than its initial pressure which preferably is just below atmospheric ambient pressure. This lowers the vapor pressure of the dry gas DG and any humidification liquid vapor Vw in the dry gas chamber DGS.

The compartment forming sleeve member 102 is preferably made from an impervious plastic material such as PET and PVC. However, in a fifth embodiment of the invention, said compartment forming sleeve member 102 may be made from a simple corrugated cardboard. If made from a non-plastic material, the protuberances of the compartment forming sleeve member 102 can also be formed by means non-water soluble glues added to a wicking material to form compartment forming sleeve member 102 and then molding the material to the desired shape as the glue dries. It is anticipated that compartment forming sleeve member 102 can be made to have outward facing protuberances 104 that can just hold humidification liquid HL against the food product container side wall 100 when it receives, and also hold chemical compounds S against the food product container side wall 100.

To form the inward facing protuberances 103 and the outward facing protuberances 104, the material used to make compartment forming sleeve member 102 is placed over a mold and formed by one of heat-shrinking, if made from heat-shrinkable material, injection molded, if made from a plastic material, and press formed with glue, if made from a wicking material. Thus, the compartment forming sleeve member 102 can have inward facing protuberances 103 and the outward facing protuberances 104 which when bounded by the food product container side wall 100 can hold not only liquids but also distinct chemical compounds S that can one of, dissolve endothermically and cool by their solvation and react endothermically and reaction released humidification liquid and cool. It is anticipated that if the to compartment forming sleeve member 102 can also be formed as a moldable wick material such from a cotton with a dryable insoluble glue added to it.

A cardboard 134 is optionally provided but not necessary, to glued to just cover the covering sleeve member bottom wall 130 to act as an insulator and protect the consumer against possible burns from heat generated by the plastic heat-shrinking vapor absorber D. The cardboard 134 must be breathable, and preferably has a small cardboard hole 135 to permit the free flow of gases to and from atmosphere as the annular plastic heat-shrinking vapor absorber retention space wall 133 flattens.

In all the embodiments, it is anticipated that the walls and the interior of the material of compartment forming sleeve member 102 may be infused with ionizable chemical compounds S that have reversible endothermic reactions with humidification liquid HL. This can be done by layering the walls of compartment forming sleeve member 102 with ionizable salts such as potassium chloride, ammonium chloride, and ammonium nitrates and other types of endothermic salts with endothermic ionization potential. If made from heat-shrinkable plastic material such as PET and PVC, the compartment forming sleeve member 102 can be heat-shrunk to form its final shape by hot-spraying it at high impact pressure with a stream of particulates of ionizable chemical compounds S to thermally shrink it and form its shape on a mold and coating it at the same time with the ionizable chemical compounds S. In all cases, the compartment forming sleeve member 102 has a wick on its outward surface that must form, as will be described later, a restricted vapor passageway 129*a* that only permits humidification liquid vapor Vw to pass through to the plastic heat-shrinking vapor absorber D in the dry gas chamber DGS. This is easily achieved in the case of a plastic film material forming the compartment forming sleeve member 102 by banding a wicking material over the compartment forming sleeve member restriction portion 128.

Other methods of inserting ionizable soluble chemical compounds S such as endothermic salts unto and into the material of compartment forming sleeve member 102 include using a polyvinyl acetate (PVA) layer on the outside wall of the compartment forming sleeve member 102 and then attaching the ionizable chemical compounds S to the PVA layer. Other laminating materials such as humidification liquid hl-soluble glues may be used for this purpose.

A dry gas DG is provided inside the dry gas chamber DGS at preferably just under ambient atmospheric pressure. The dry gas GS is provided by a dry gas source DGS and it fills the spaces between the plastic heat-shrinking vapor absorber D and the compartment forming sleeve member 102 in dry gas chamber e.

Method of Manufacture of First Embodiment

Figure 18:
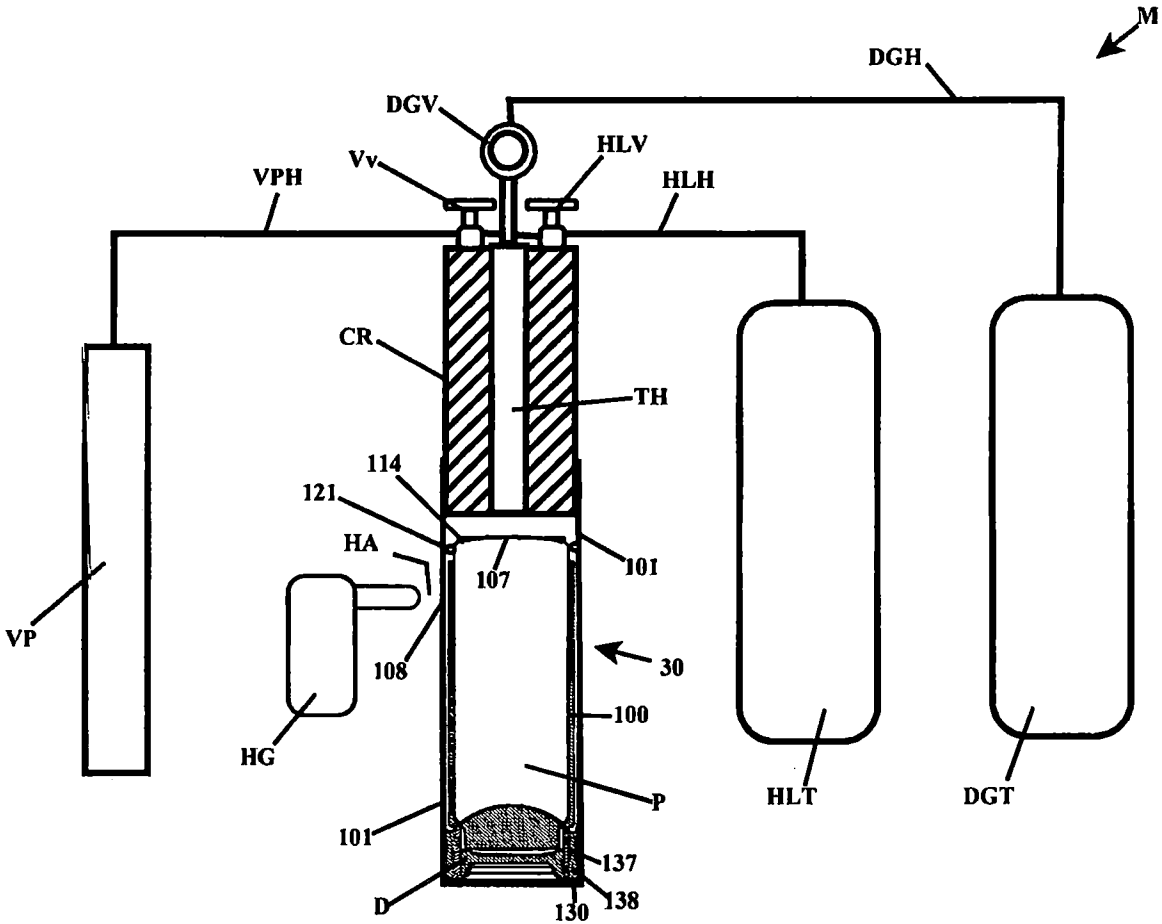
FIG. 18 shows the manufacturing method of the present invention when a heat-shrinkable plastic is used to form the covering sleeve member.
Figure 19:
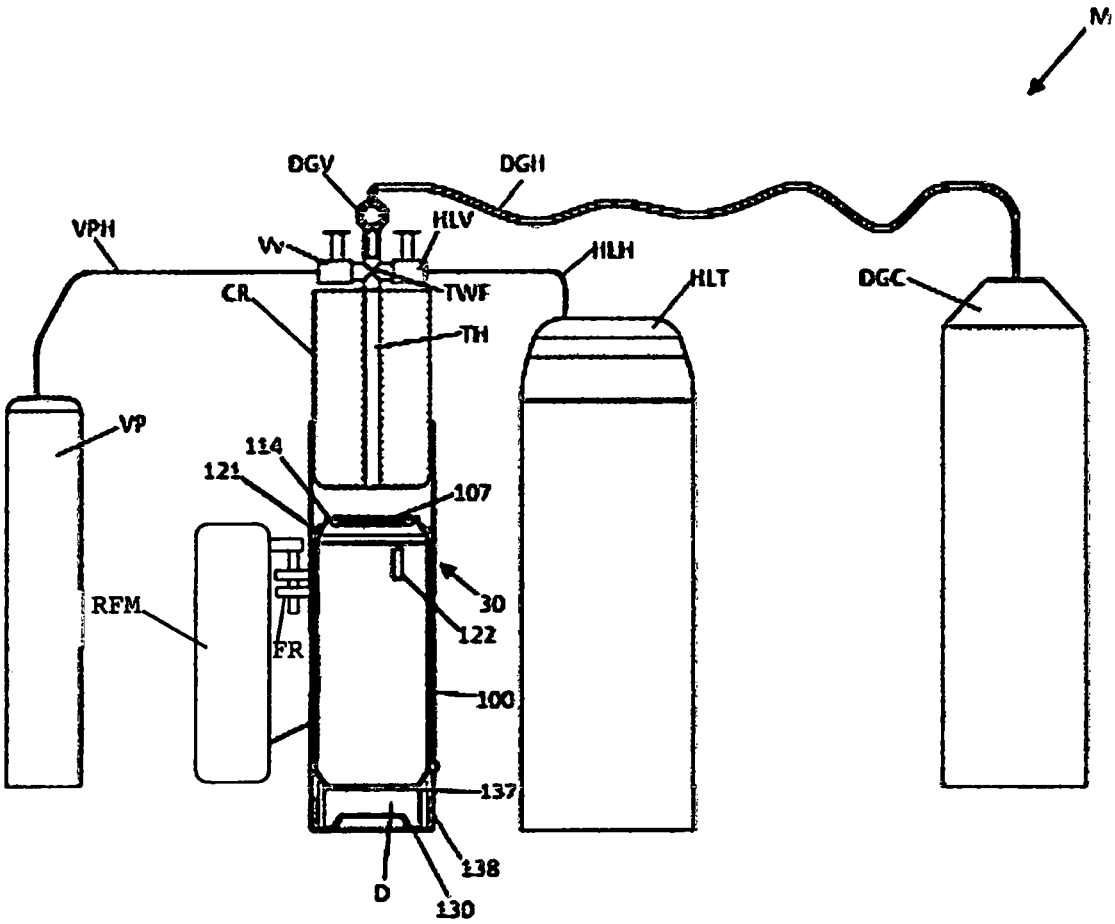
FIG. 19 shows the manufacturing method of the present invention when aluminum is used to form the covering sleeve member.

A manufacturing method M of the apparatus 10 is described herein as shown in FIG. 18 and FIG. 19. This manufacturing method M generally applies to all the embodiments except for some ordering of tasks that may either change or be eliminated as required. A standard food product container 20 is provided. A covering sleeve member seal 121 provided and covering sleeve member seal 121 is placed circumferentially and sealingly tight around the food product container side wall 100 in a plane parallel to the diametric plane of the food product container 20 and to band around the food product container top wall seam 114.

A dry gas seal 123 is provided as a rectanguloid seal like a rubber band and is expanded and placed in a plane circumferentially slanted at a small angular slant relative to the diametric plane of the food product container side wall 100 to have a maximal separation of about 50 mm and a minimal separation of about 20 mm below covering sleeve member seal 121. Preferably, a plastic self-adhesive label forming the seal breaking structure 122 is provided and attached to the food product container side wall 100 to lay inside and between the maximal separation gap between dry gas seal 123 and the covering sleeve member seal 121.

A compartment forming sleeve member 102 is provided, and attached circumferentially to cover at least in part the food product container side wall 100 below dry gas seal 123 using with one of friction, a glue and double sided adhesive tape.

Figure 2:
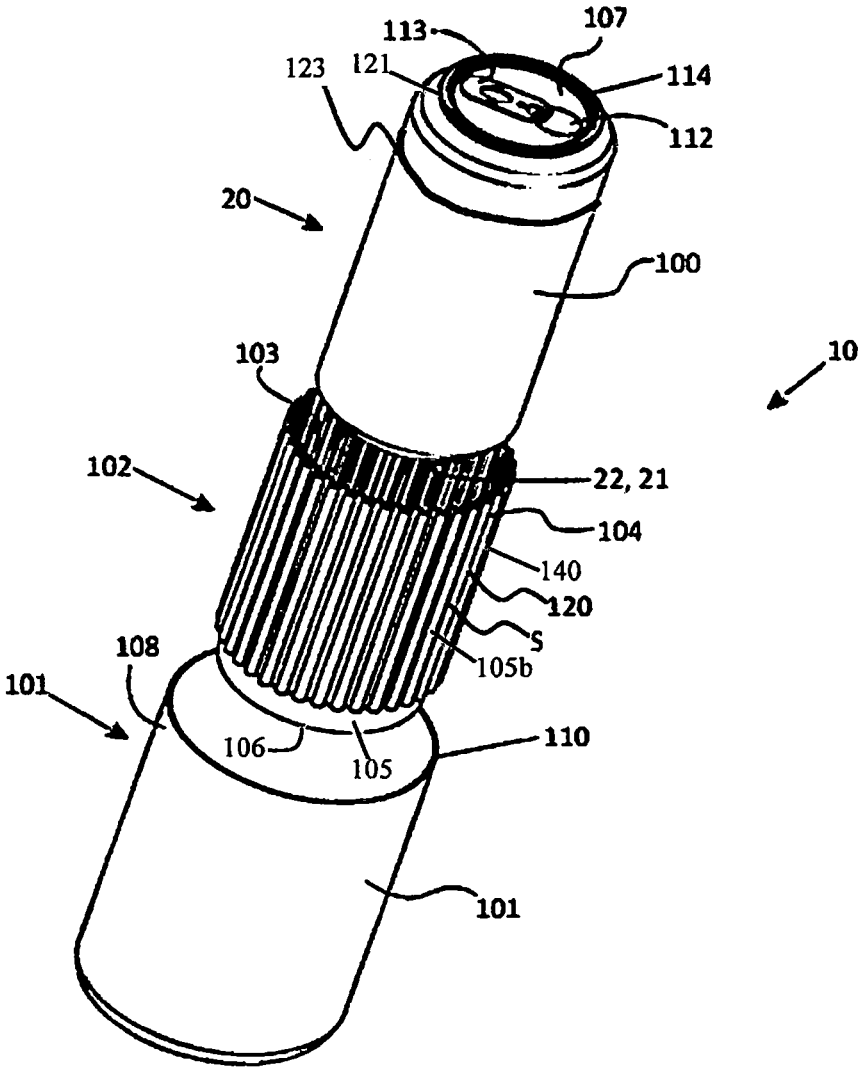
FIG. 2 is an example of one form of the compartment forming sleeve member with inward facing protuberances and the outward facing protuberances. This increases its surface area. The compartment forming sleeve member side wall is shown impregnated with ionizable chemical compounds S. The inward facing protuberances and the outward facing protuberances provide a simple means to store chemicals, and also to permit dry gas free passage inside the apparatus.
Figure 3:
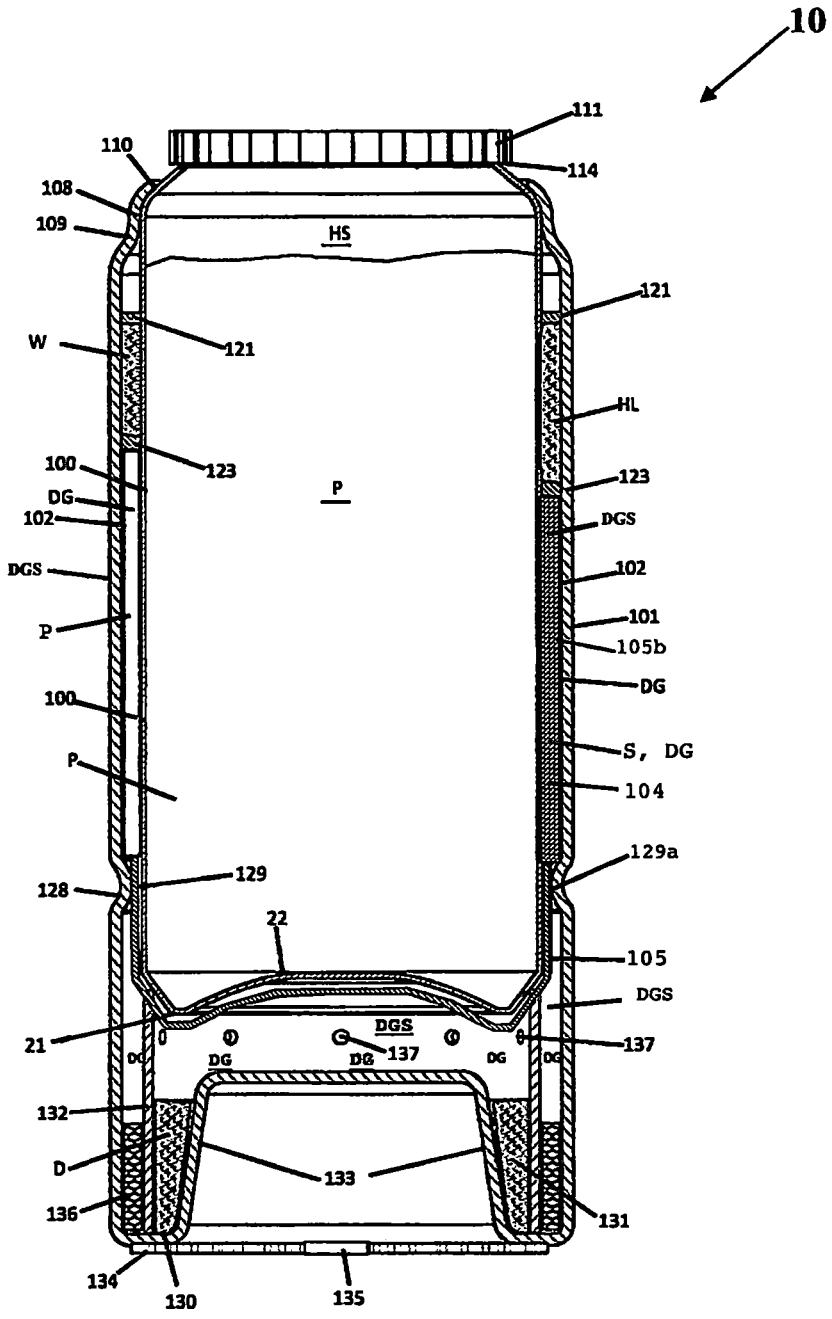
FIG. 3 shows a cross section of the apparatus according to the first embodiment before it is used. A food product container is shown as a metal can affixed to the covering sleeve member side wall and showing some details of the covering sleeve member sealing portions and some details of the food product container top wall, and the dry gas chamber. The humidification liquid chamber is above the dry gas chamber between two seals. The annular plastic heat-shrinking vapor absorber retention space, and the annular thermal wax retention space are shown. Covering sleeve member annular wall is shown forming an inverted cup as an example.
Figure 4:
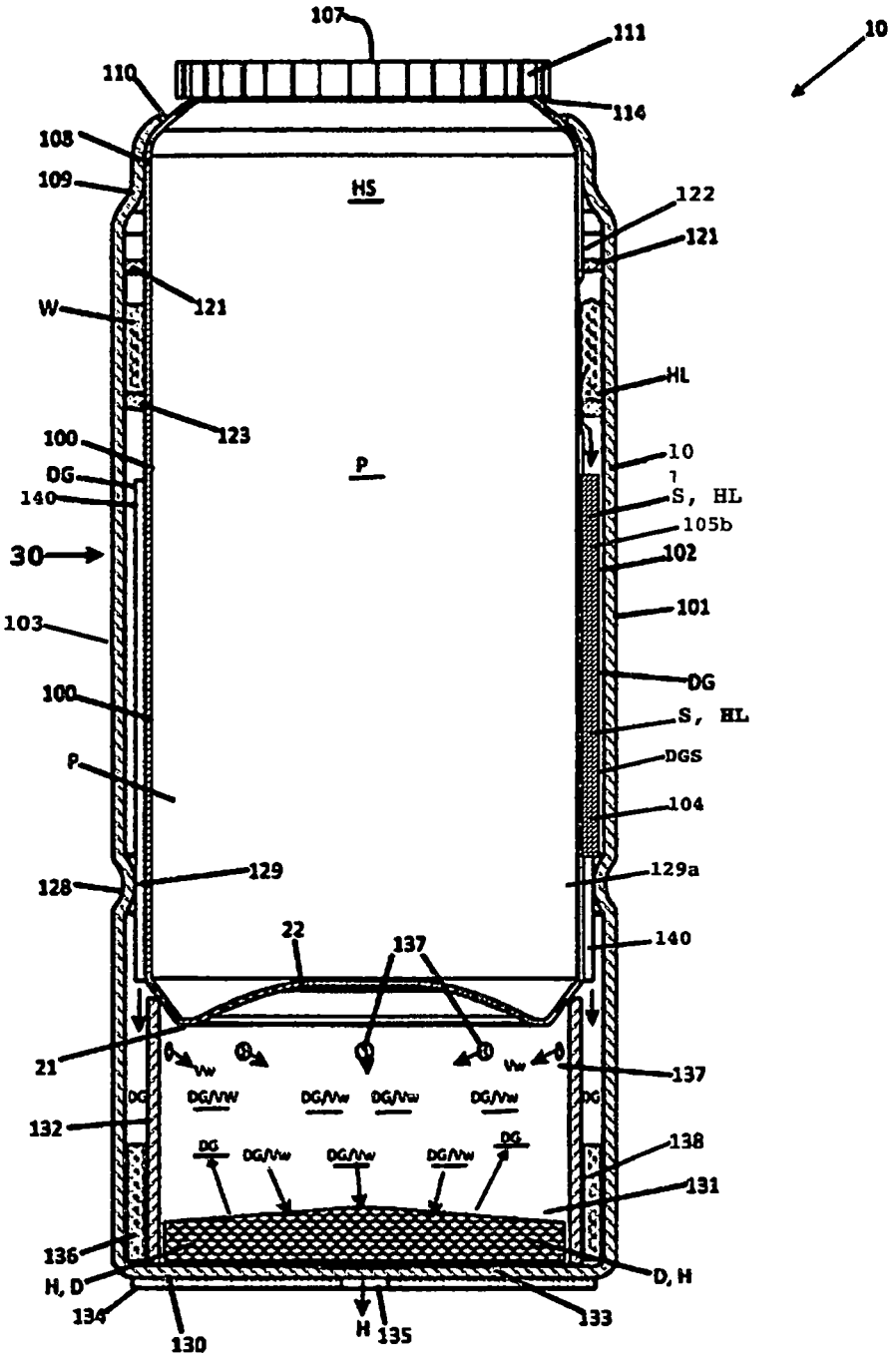
FIG. 4 shows a cross section of the apparatus after the cooling actuation means is used. Note that the cross section depends on where it is taken since the protuberances may be at a minimal or maximal diameter, and in this case they are taken at a minimal diameter. The wick is saturated with humidification liquid which dissolves the chemical compounds endothermically to provide a first cooling means. The covering sleeve member annular walls has shrunk to a near flat plane, and the annular plastic heat-shrinking vapor absorber retention space has increased in volume pulling a negative pressure on the dry gas chamber. The arrows indicate the flow of dry gas and vapor into and from the inward facing protuberances of the compartment forming sleeve member to provide for a second cooling means. The left side of the food apparatus shows a cross-section of the compartment forming sleeve member forming the inward facing protuberances with dry gas in it, while the right side of the apparatus shows a cross-section of the compartment forming sleeve member forming the outward facing protuberances with chemical compounds in the dry gas chamber.
Figure 5:
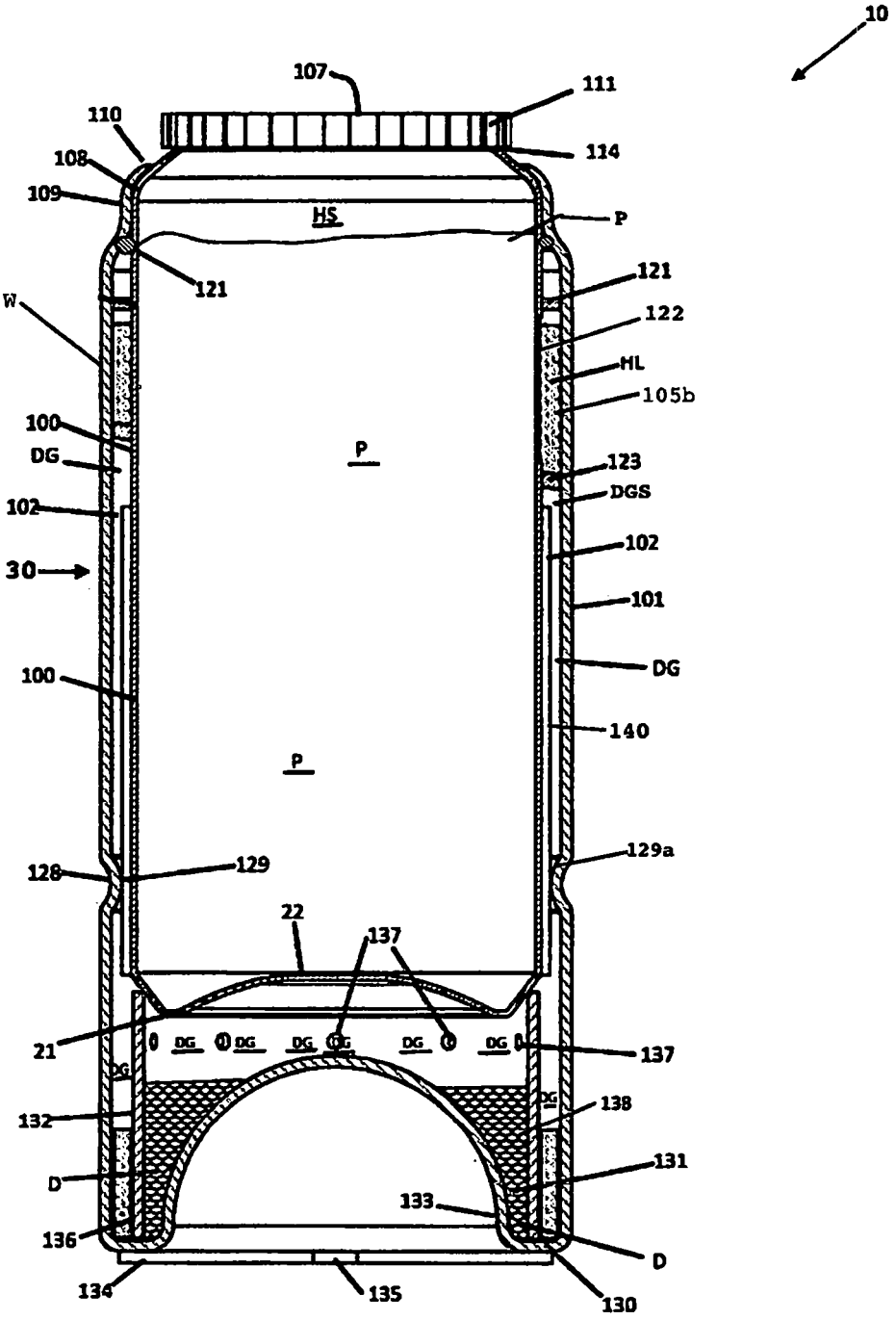
FIG. 5 shows a cross section of the apparatus with a domed annular plastic heat-shrinking vapor absorber retention space before it is used.
Figure 6:
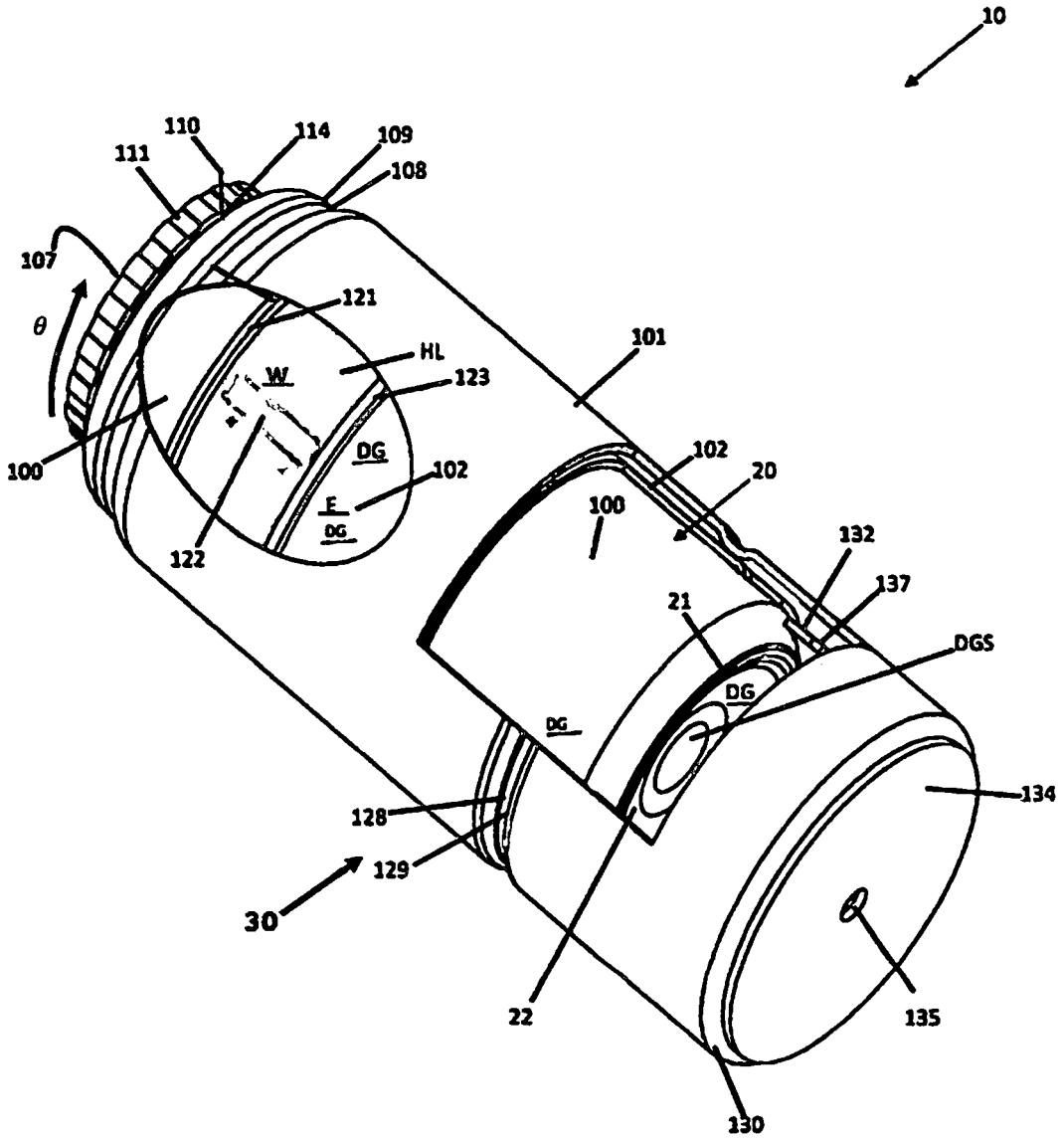
FIG. 6 shows partial cut away view of the covering sleeve member side wall to show the details of the humidification liquid chamber, the dry gas chamber and the seals. The seal breaking structure is shown before the cooling actuation means is used.
Figure 7:
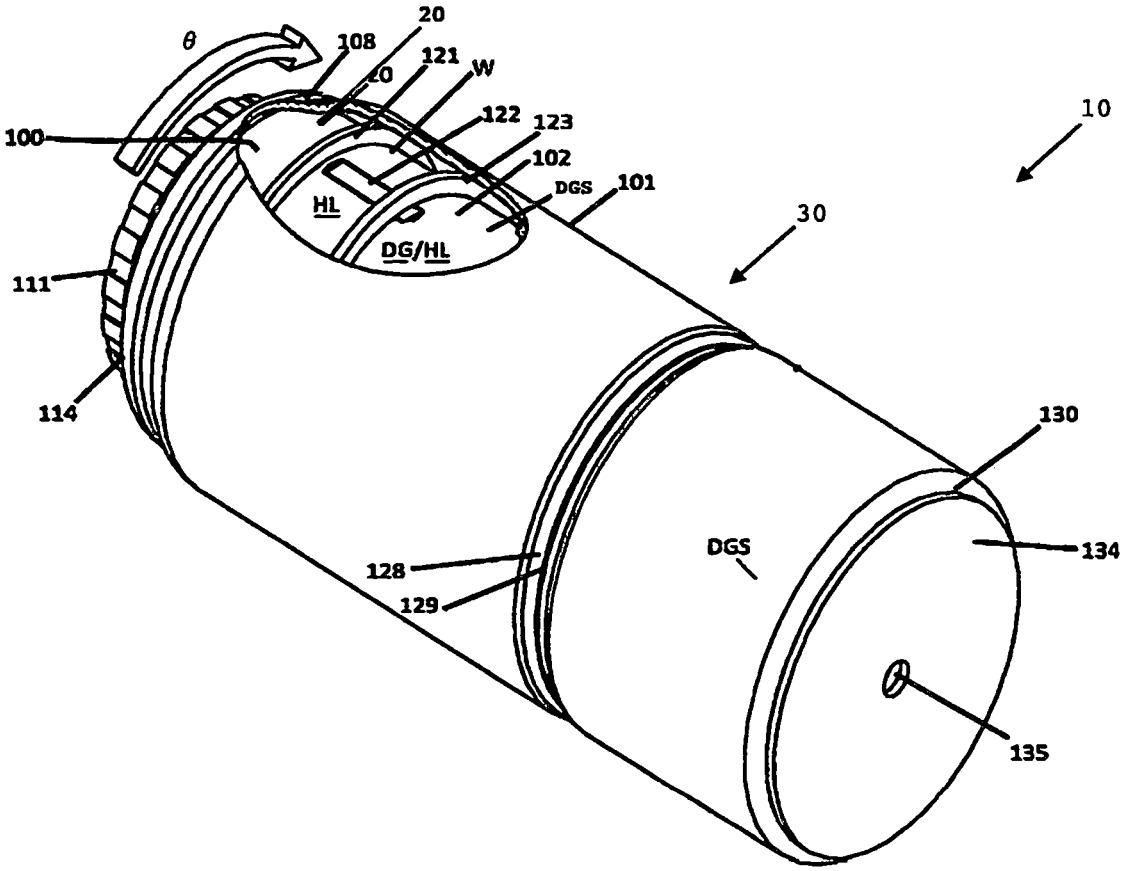
FIG. 7 shows partial cut away view of the covering sleeve member side wall to show the details of the humidification liquid chamber, the dry gas chamber and the seals. The seal breaking structure crossing the dry gas seal to start the cooling actuation means by leaking humidification liquid into the dry gas chamber.
Figure 8:
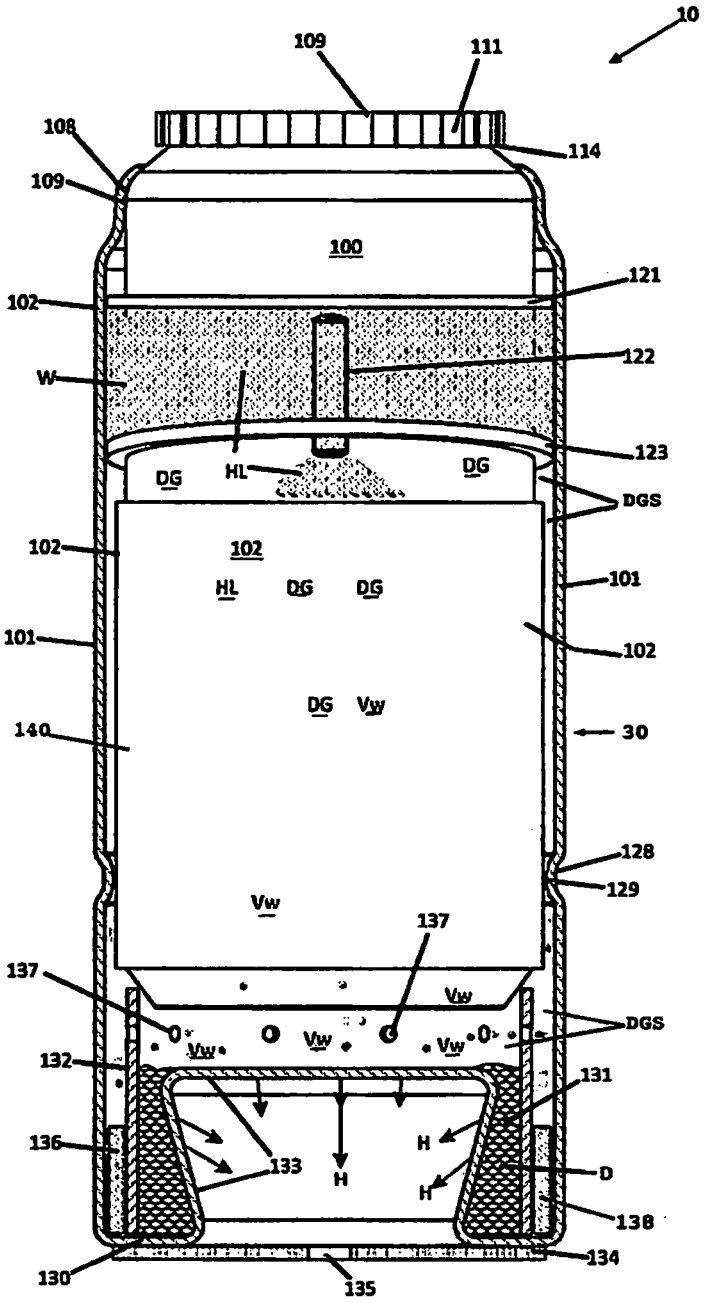
FIG. 8 shows a cross section of the apparatus according to the first embodiment just after the cooling actuation means is used and the plastic heat-shrinking vapor absorber is still cool. The covering sleeve member annular wall is shown as a truncated invert cone-shaped cup to increase the volume of the intrusion of the annular plastic heat-shrinking vapor absorber retention space into the dry gas chamber.
Figure 9:
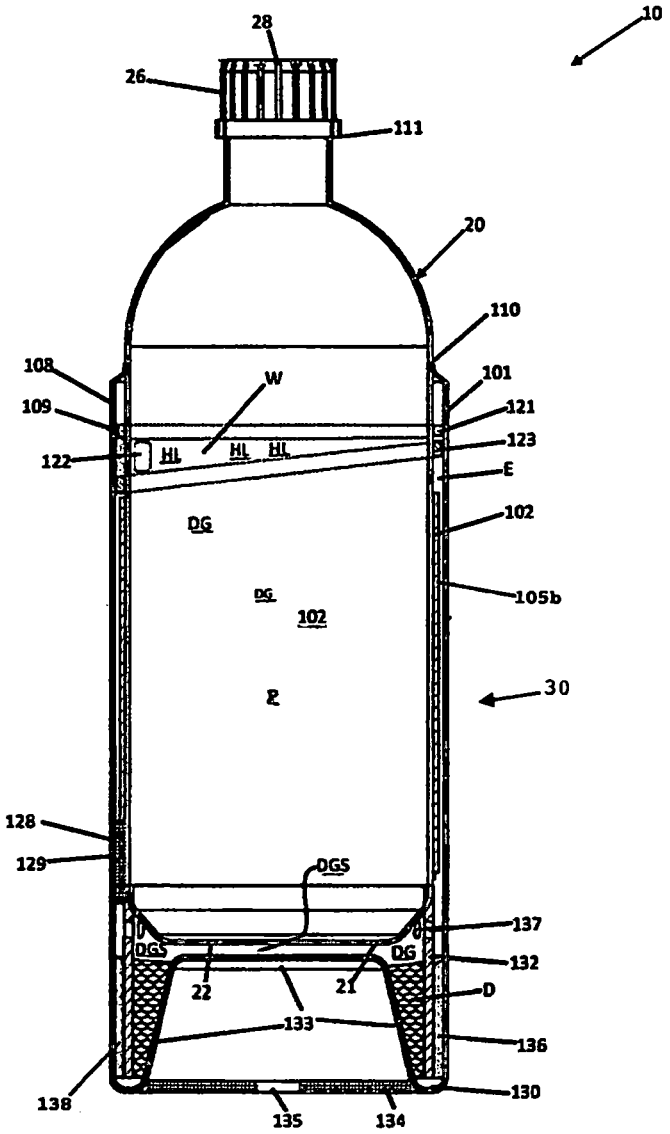
FIG. 9 shows a cross section of the first embodiment of the invention apparatus when the food product container is a bottle. A food product container is shown as a bottle.

Covering sleeve member 30 is provided as cup-like structure with straight covering sleeve member side wall 101 as shown in FIG. 2. Covering sleeve member side wall 101 should be taller than food product container 20 by at least 50 mm and should extend beyond the food product container top wall 107. The covering sleeve member side wall 101 just fits over to cover and surround the compartment forming sleeve member 102.

Support cylinder 132 is placed to sit on covering sleeve member bottom wall 130 with support cylinder holes 137 close to the food product container 20 to form the annular plastic heat-shrinking vapor absorber retention space 131 and the annular thermal wax retention space 136. Thermal wax 138 is placed to fill the annular thermal wax retention space 136 and plastic heat-shrinking vapor absorber D is filled into the annular plastic heat-shrinking vapor absorber retention space 131.

Food product container 20 with the compartment forming sleeve member 102, seal breaking structure 122, the covering sleeve member seal 121 and the dry gas seal 123, is inserted to sit on support cylinder 132 inside the covering sleeve member 30.

A cylindrical rod CR is provided with a through hole TH through its length and with a three-way fitting TFW attached to the through hole TH. The first input of the three-way fitting TFW is connected by a dry gas hose DGH to fluidly communication with dry gas pressure canister DGC via a dry gas valve DGV. The second input of the three-way fitting TFW is connected by a vacuum pump hose VPH to a vacuum pump VP via a vacuum valve Vv. The third input of the three-way fitting TFW is co a humidification liquid valve HLV which is connected by a humidification liquid hose HLH to a humidification liquid valve HLT.

The cylindrical rod CR outer diameter is made to fit exactly inside the covering sleeve member 30 and it is inserted about 20 mm into the open end of covering sleeve member 30 and covering sleeve member 30 is heat shrunk to seal around it. The humidification liquid valve HLV, the dry gas valve DGV and the vacuum valve Vv are shut off.

The dry gas valve DGV at a low pressure of about 1 psig and the vacuum valve Vv are first opened to permit dry gas GS to flood the interior of the covering sleeve member 30 to purge any wet air and gases within the covering sleeve member 30 using the vacuum pump VP. After a few seconds of purging, the dry gas valve DGV is turned off to permit the vacuum pump VP to lightly rarify the dry gas DG remaining in the covering sleeve member 30 to a pressure just below ambient atmospheric pressure. A cut off valve to control the pressure may be provided, but the vacuum pump VP itself can be made to provide the rarefication required.

Hot air HA from a heat source HG such as a heat gun is first directed at the location of the covering sleeve member sealing portion 108 to shrink and clamp around the surface of dry gas seal 123 against the food product container side wall 100, after which the hot air HA is removed. This seals in dry gas GS at a rarefied pressure in the dry gas chamber DGS below the dry gas seal 123.

Then, the dry gas valve DGV and the vacuum valve Vv are shut off and the humidification liquid valve HLV is opened to permit humidification liquid HL to fill the annular space above the dry gas seal 123 between the food product container side wall 100 and the covering sleeve member side wall 101 up to a level just below the covering sleeve member seal 121 and then it is shut off.

Hot air HA from the heat source HG is now directed on the location of the covering sleeve member sealing portion 108 to shrink and clamp the covering seal 121 against the food product container side wall 100 after which the hot air HA is removed. This seals in the humidification liquid HL and forms the humidification liquid chamber W between the dry gas seal 123, the covering seal 121, food product container side wall 100 and the covering sleeve member side wall 101.

Then, the extra material of the covering sleeve member 30 above the food product container top wall seam 114 that is still attached to the cylindrical rod CR is cut off to create the covering sleeve member side wall end 110. Extension grip 111 is snapped to the food product container top wall seam 114 to act as an extension of the food product container 20. The apparatus 10 is now ready for use.

Method of Operation of the Apparatus According to the First Embodiment

Figure 10:
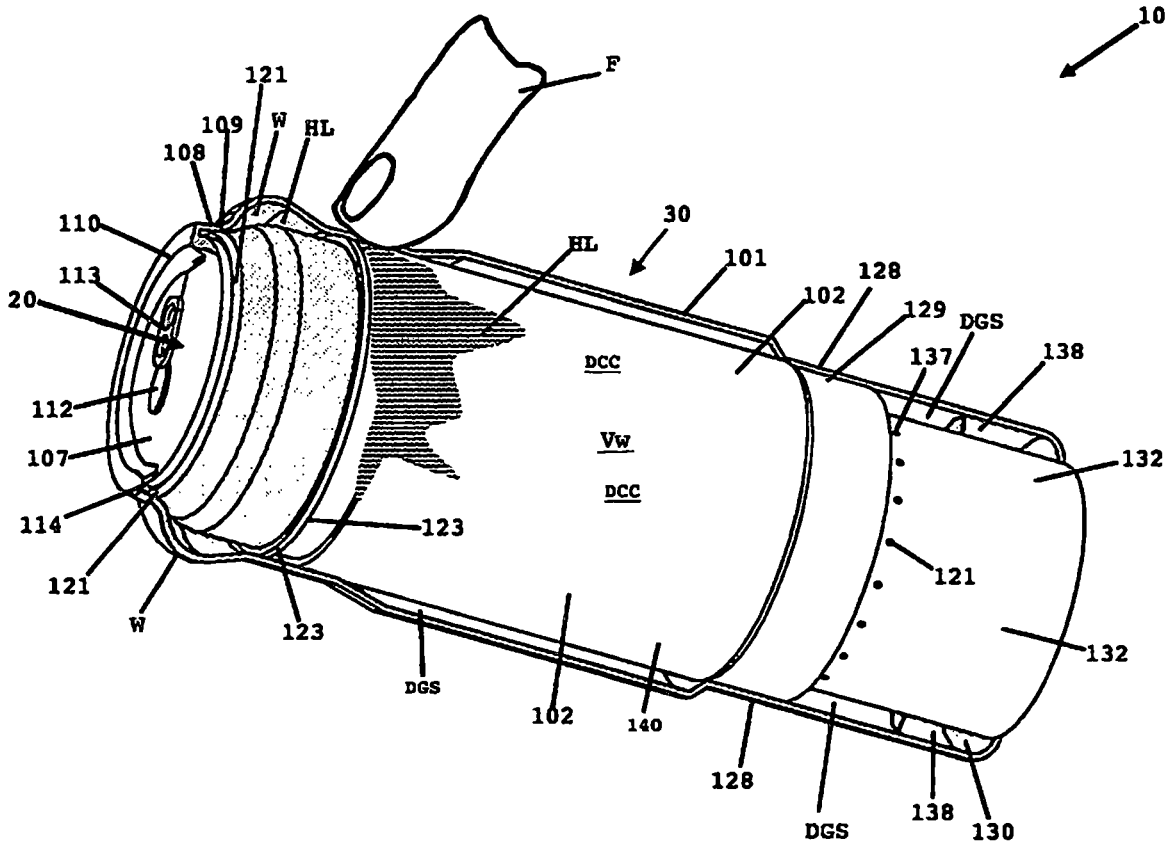
FIG. 10 shows a finger pressing upon the deformable ring structure forming the dry gas seal to permit a leak of humidification liquid into the dry gas chamber to saturate the compartment forming sleeve member.

It is anticipated that the cooling actuation means θ is activated before the food product release means 113 is used. However, should the food product release means 113 be actuated before the cooling actuation means θ, then it is anticipated that the pressure drop of the food product container 20 will cause a relaxation of the food product container side wall 100 and slacken the dry gas seal 123 relative to the food product container side wall 100 and thus the apparatus 10 can be still activated as shown in FIG. 10 by simply applying finger pressure 40 and pressing upon the covering sleeve member side wall 101 in the region of the dry gas seal 123 to deform the dry gas seal 123 and the food product container side wall 100 and permit the humidification liquid HL to leak into the dry gas chamber DGS. The apparatus can also be activated by the massage means provided also in the fifth embodiment to break the dry gas seal 123. In all case humidification liquid HL will fall through between the dry gas seal 123 and the food product container side wall 100 due to a gravitational pressure difference, and thus activate the cooling. Thus a second cooling actuation means is provided when food product release means 113 is first used. When cooling actuation means θ is actuated, the rotation of the covering sleeve member 30 with the covering sleeve member seal 121 and the dry gas seal 123 relative to the food product container side wall 100 causes seal breaking structure 122 to cross under the dry gas seal 123 and break the seal with the food product container side wall 100 that holds humidification liquid HL in the humidification liquid chamber W. Humidification liquid HL enters between the outward facing protuberances in the and dissolves the ionizable chemical compounds S held in them. This causes a first endothermic cooling of the humidification liquid HL. The humidification liquid HL also saturates compartment forming sleeve member side wall 105 and the wick 140 absorbs the humidification liquid as shown in FIG. 10. The dry gas DG absorbs humidification liquid vapor Vw from the wick 140 and the evaporation of the same causes a second further cooling of the humidification liquid HL. Further, a third cooling is achieved when the solution formed by the species of the dissolving chemical compounds DCC of the chemical compound S, and the humidification liquid is dried out by evaporation of the humidification liquid HL into the dry gas GS.

The heat of evaporation H is taken away by the dry gas DG as it becomes wet and lowers its dew point temperature. Note that the dry gas DG temperature does not increase by this process since its dew point temperature takes the heat of evaporation h of the humidification liquid HL away. The higher dew point temperature dry gas DG saturates the dry gas chamber DGS, and enters the restricted vapor passageway **129*a*. Dry gas DG is an electromotive transport means. The removal of polar water molecules in vapor form into dry gas DG is due to an electromotive heat transport potential. Dry gas DG changes the reactivity of the restricted vapor passageway 129*a*, (Respir. Physiol. 1997 July; 109 (1):65-72). Negative ions in a dry gas DG attract polar molecules of the humidification liquid HL in the restricted vapor passageway 129*a***. This is why when air is dry, one gets a greater propensity for electrostatic effects.

The plastic heat-shrinking vapor absorber D may be one of, a liquid, gel, and a solid that absorbs humidification liquid HL vapor Vw. Humidification liquid HL may also be a pressurized liquid in equilibrium with its vapor such as an ammonium solution, a dimethylether solution, and a carbonated solution. In such a case, table 1 provides for the various combinations of the plastic heat-shrinking vapor absorber D, the dry gas GS, and the humidification liquid HL that may be used with the invention.

As dry gas GS wetted by humidification liquid vapor Vw enters through the restricted vapor passageway 129*a* and then through the support cylinder holes 137 to be absorbed into the plastic heat-shrinking vapor absorber D to dehumidify, its vapor pressure lowers and the dew point temperature of the dehumidified dry gas GS falls far below the dew point temperature of the humidified dry gas DG in the dry gas chamber DGS. Dehumidified dry gas DG in the dry gas chamber DGS is again pulled in by the higher vapor pressure of the dry gas chamber DGS and to again absorb more vapor and transport it to the plastic heat-shrinking vapor absorber D. Plastic heat-shrinking vapor absorber D heats up as it sorbs the humidification liquid vapor Vw and the annular plastic heat-shrinking vapor absorber retention space wall 133 which is tensioned by being pre-stretch-formed, responds to the increase in its temperature by deforming and shrinking in area. When heated, the annular plastic heat-shrinking vapor absorber retention space wall 133 shrinks in surface area and moves outwardly from the food product container domed bottom 22 causing the volume of the dry gas chamber DGS to increase and thus generate a substantial lower vapor pressure in the fixed amount of rarified dry gas DG in the dry gas chamber DGS. This lowers the vapor pressure of the dry gas DG in the dry gas chamber DGS even more and any humidification liquid vapor Vw in the dry gas chamber DGS is pulled into the dry gas DG to evaporate. This deformation of the annular plastic heat-shrinking vapor absorber retention space wall 133 continues with the continued generation of more heat of evaporation h, causing the annular plastic heat-shrinking vapor absorber retention space wall 133 to preferably flatten and thus increase the volume of the dry gas chamber DGS relative to its original volume.

In order to prevent the covering sleeve member bottom wall 130 from collapsing and deforming its shape, support cylinder 132 takes up the compressive forces of the annular plastic heat-shrinking vapor absorber retention space wall 133 against the food product container bottom edge 21 and prevents the covering sleeve member bottom wall 130 from deforming. Thus, the flattening of the annular plastic heat-shrinking vapor absorber retention space wall 133 will not affect the structure of the covering sleeve member bottom wall 130. The deformation and flattening of the annular plastic heat-shrinking vapor absorber retention space wall 133 causes the dry gas chamber DGS to increase in volume, and since there is a fixed amount of dry gas DG in the dry gas chamber DGS, a lower pressure is created inside the dry gas chamber DGS. The annular plastic heat-shrinking vapor absorber retention space 131 is also made larger by the flattening of the annular plastic heat-shrinking vapor absorber retention space wall 133. This causes the plastic heat-shrinking vapor absorber D to continuously shift, move, fall and spread over the flattened annular plastic heat-shrinking vapor absorber retention space wall 133. This spreading agitates the plastic heat-shrinking vapor absorber D and makes it more effective as it assumes a greater surface area. Further, preferably the dry gas DG is preferably at atmospheric pressure when it is stored between the dry gas chamber DGS. The negative pressure generated on the dry gas DG causes even more absorption of humidification liquid vapor Vw into the dry gas DG by evaporation of humidification liquid HL. The approximately 1840-fold expansion of humidification liquid HL into humidification liquid vapor Vw in the dry gas chamber DGS due to the gasification of humidification liquid HL increases the relative vapor pressure of the dry gas chamber DGS in relation to the annular plastic heat-shrinking vapor absorber retention space 131. Thus, advantageously, the humidification liquid vapor Vw in the dry gas chamber DGS naturally wants to enter into the plastic heat-shrinking vapor absorber D. Thus, dry gas DG is an electromotive heat transport means for humidification liquid vapor Vw into the plastic heat-shrinking vapor absorber D without the need for a true vacuum.

As dry gas DG delivers the humidification liquid vapor Vw into the plastic heat-shrinking vapor absorber D, its actual temperature increases due to the heat generated by the plastic heat-shrinking vapor absorber D. The heat from the plastic heat-shrinking vapor absorber D is partially absorbed by the dry gas DG and its dew point temperature lowers even more. This causes dry gas DG to migrate again into the plastic heat-shrinking vapor absorber D and collect more humidification liquid vapor Vw from dry gas chamber DGS. The cooling continues in this fashion dehydrating the ionizable compounds on the dry gas chamber DGS. The ionizable compounds are not absolutely necessary for the invention to work, however they improve the cooling efficiency since dry gas DG will absorb humidification liquid vapor Vw from even cold humidification liquid HL. The ultimate source of heat of evaporation h is the food product P, which cools by this method. "salting" the dry gas chamber DGS by drying out the chemical compounds S back to their original form (if used), makes them reusable for further cooling. Drying out the dry gas DG by the plastic heat-shrinking vapor absorber D makes it also reusable again for further cooling.

Further, the deformation motion of the annular plastic heat-shrinking vapor absorber retention space walls 133 causes the plastic heat-shrinking vapor absorber D to move and spread out to permit unexposed plastic heat-shrinking vapor absorber D to take action and effectuate the sorbing of humidification liquid vapor Vw into the plastic heat-shrinking vapor absorber D. It is anticipated that a heat-absorbing thermal wax 138 such as ordinary candle wax may be placed in the annular thermal wax retention space 136 between support cylinder 132 and the covering sleeve member side wall 101 to absorb heat of evaporation h from the plastic heat-shrinking vapor absorber D and store the heat of evaporation h. However, this has been found to be effective only if a large amount of plastic heat-shrinking vapor absorber D, is used for a large food product container 20 in excess of 20 oz in volume.

Further the covering sleeve member 30 can be made from shrinkable material such as TPX™ formed from a combination of plastic materials called Polymethylpentene and glass beads, the resulting covering sleeve member 30 will be capable of quickly releasing absorbed heat of evaporation h through its structure and radiate the heat of evaporation h quickly to atmosphere. Further, the deformation motion of the annular plastic heat-shrinking vapor absorber retention space walls 133 causes the atmospheric air in it to absorb heat from the plastic heat-shrinking vapor absorber D and remove this heat through the cardboard hole 137 if used, or directly to the atmosphere as the heated air volume beneath the flattening annular plastic heat-shrinking vapor absorber retention space walls 133 is expelled.

Cardboard 134 is provided but not necessary. Preferably, but not necessarily, cardboard 134 is made to fit and cover the covering sleeve member bottom wall 130 and is glued to covering sleeve member bottom wall 130 protect the consumer against possible burns. Cardboard 134 has a small central cardboard hole 135 to permit the free flow of gases to atmosphere due to the flattening of the annular plastic heat-shrinking vapor absorber retention space wall 133.

In all embodiments, it is anticipated that the walls and the material used to form compartment forming sleeve member 102 may be layered with ionizable dissolving chemical compounds DCC, that have reversible endothermic reactions with humidification liquid HL.

A dry gas DG is provided inside the dry gas chamber DGS at preferably just under ambient atmospheric pressure. The dry gas GS is provided by a dry gas source DGS and it fills dry gas chamber DGS and the empty spaces between the plastic heat-shrinking vapor absorber D and the compartment forming sleeve member 102.

Second Embodiment of the Invention

Figure 11:
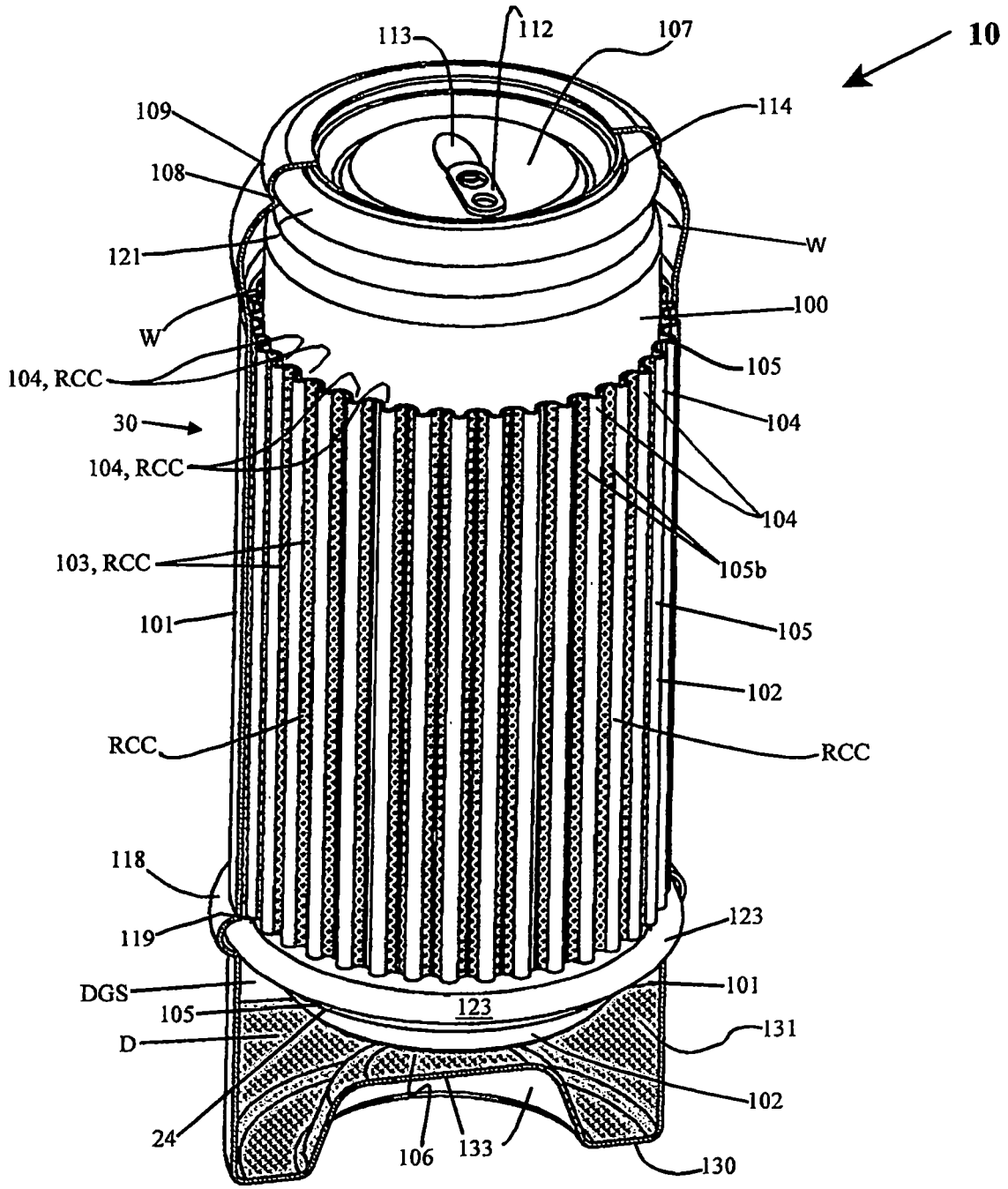
FIG. 11 shows a second embodiment of the present invention.
Figure 12:
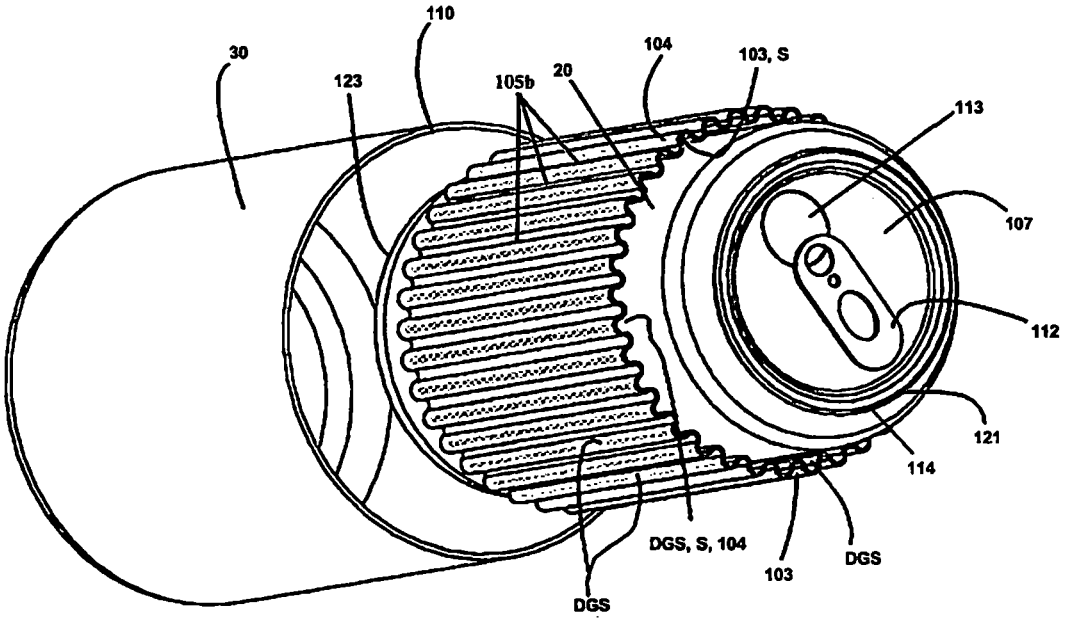
FIG. 12 shows the compartment forming sleeve member surrounding the food product container side wall and about to be inserted into the covering sleeve member.
Figure 13:
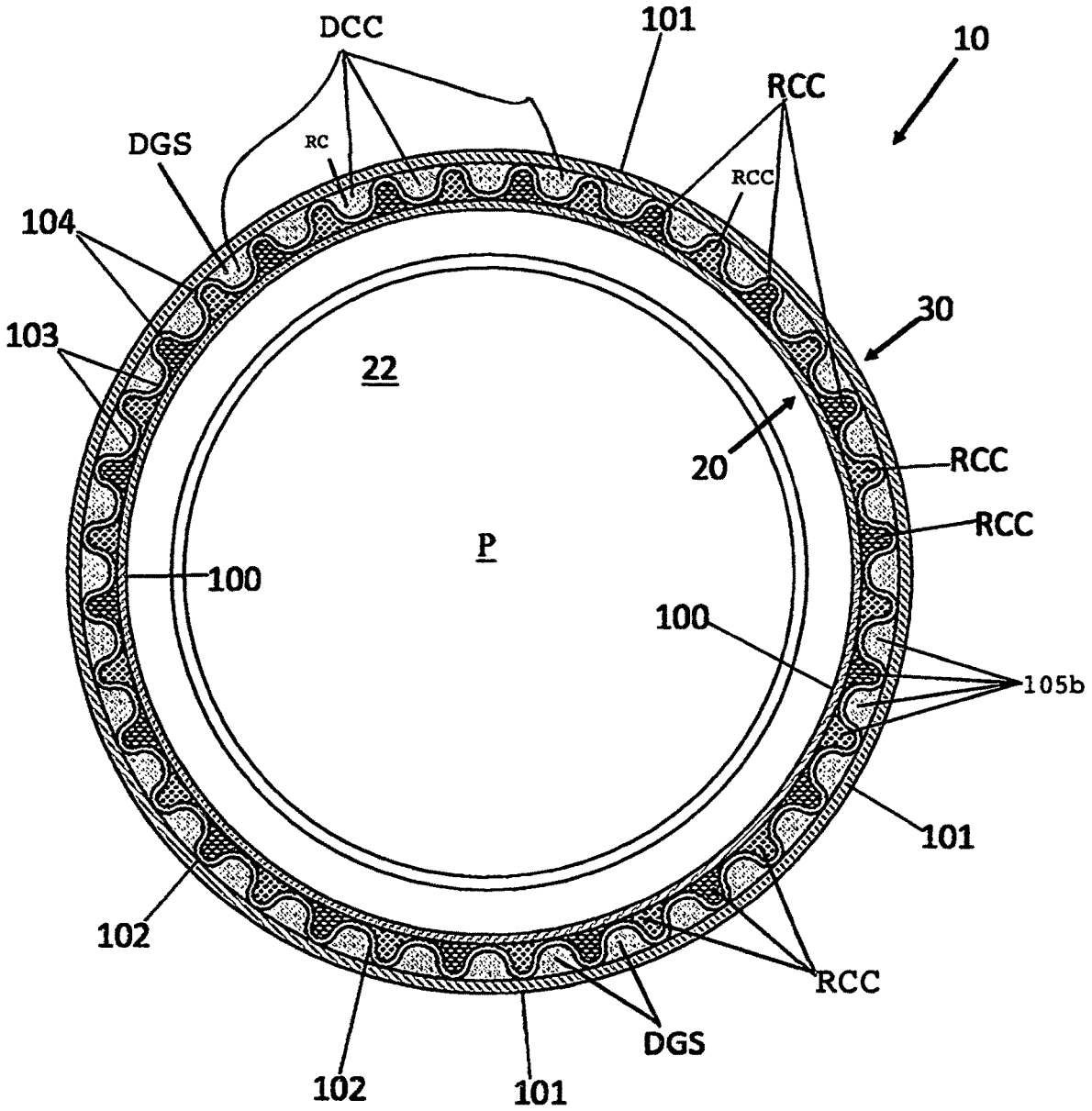
FIG. 13 shows a cross section of the compartment forming sleeve member with the inward facing protuberances and the outward facing protuberances carrying dissolving chemical compounds and reacting chemical compounds in them surrounding the food product container side wall.
Figure 14:
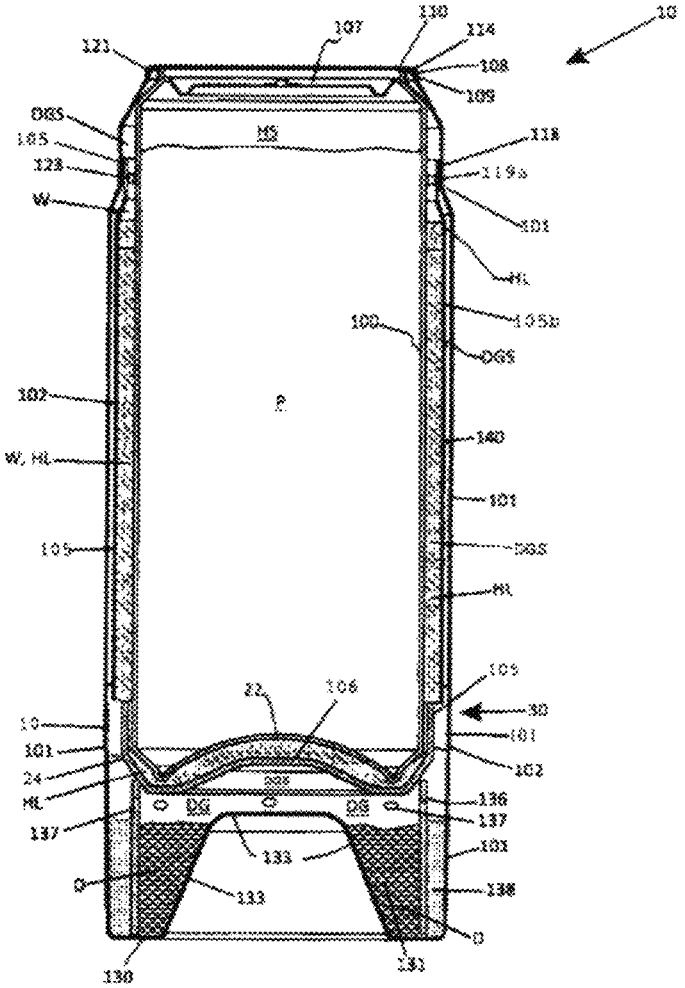
FIG. 14 shows a third embodiment of the present invention. In this embodiment, the humidification liquid is shown surrounding the food product container side wall and the dry gas chamber surrounds the subassembly.

Referring to FIG. 11 and FIG. 12, and FIG. 13, a standard food product container 20 is provided. As before, food product container 20 is preferably a cylindrical beverage container of standard design, and with standard food product release means 112.

As shown in FIG. 10 and FIG. 11, and FIG. 12, as before, a covering sleeve member seal 121 is provided in the form of a thin loop structure made from one of an O-ring seal, a metal band seal, a rubber band seal, a putty seal, and sealing wax seal, and a glue bonding agent. Preferably the covering sleeve member seal 121 is provided in the form a looped band, usually O-ring shaped. The covering sleeve member seal 121 cross-sectional dimensions preferably are less than 4 mm. The covering sleeve member seal 121 should form a tight seal around the food product container top wall seam 114. The covering sleeve member seal 121 is placed circumferentially and sealingly tight around the food product container side wall 100 in a plane parallel to the diametric plane of the food product container 20 and close to the food product container top wall 107 to sit around food product container top wall seam 114.

As before, a compartment forming sleeve member 102 is provided as described in the first embodiment, with a compartment forming sleeve member side wall 105 and compartment forming sleeve member bottom wall 106 and as in the first embodiment, the compartment forming sleeve member 102 is preferably made from thin impermeable one of heat-shrinkable stretch-formed polyvinyl chloride (PVC), and heat-shrinkable stretch-formed polyethylene terephthalate (PET). Other materials may be used depending on the way the compartment forming sleeve member 102 is fashioned.

As before, the compartment forming sleeve member 102 can initially be formed with cylindrical compartment forming sleeve member side wall 105 and then molded into a variety of shapes by one of compressive molding and heat-shrinking to form projected protuberances on its surface. Otherwise its shape may be injection molded or compression formed.

As before, compartment forming sleeve member side wall 105 is preferably made with inward facing protuberances 103 and outward facing protuberances 104 respectively on its walls to increase its surface area and provide for strength, surface area, and permit a variety of distinct reacting chemical compounds RCC, to be stored between independent protuberances, as shown in FIG. 13. The number of protuberances must be more than one so that at least reacting chemical compounds RCC may be used with the apparatus 10. A variety of projected shapes of the compartment forming sleeve member side wall 105 such as the aforementioned protuberances may be used to increase the strength and surface area of compartment forming sleeve member 102. The projected shapes form distinct compartments with the protuberances, such as the inward facing protuberances 103 and outward facing protuberances 104 shown as an example in FIG. 11, FIG. 12, and FIG. 13 and FIG. 20, to give strength to compartment forming sleeve member 102, and also to permit reacting chemical compounds RCC to be placed therein and for the dry gas DG to fill and saturate the same. Preferably, the projected protuberances of compartment forming sleeve member 102 form distinct compartments on the compartment forming sleeve member side wall 105 to also permit dry gas DG to interact with the reacting chemical compounds RCC. Inward facing protuberances 103 of the compartment forming sleeve member side wall 105 must frictionally tangentially contact the food product container side wall 100 to form distinct compartments for the reacting chemical compounds RCC between the compartment forming sleeve member side wall 105 and the food product container side wall 100.

The compartment forming sleeve member side wall 105 is circumferentially attached to frictionally tangentially contact the food product container side wall 100 to cover at least in part the food product container side wall 100 below the covering sleeve member seal 121. Grease, soft pliable glues and waxes may also be used to hold it firmly in place and to at least form distinct compartments with the food product container side wall 100. Preferably, the compartment forming sleeve member side wall 105 extends to cover-in-part as much of the exposed surface of the food product container side wall 100 below the covering sleeve member seal 121 as possible.

As before, a dry gas seal 123 is provided preferably also in the form of an O-ring seal, a metal band seal, a rubber band seal, a putty seal, and sealing wax seal, a glue bonding agent and shaped in the form of a thin loop, usually a ring structure. The dry gas seal 123 is placed circumferentially and sealingly tight around the compartment forming sleeve member side wall 105 in a plane parallel to the diametric plane of the food product container 20 and close to the compartment forming sleeve member side wall lower edge 24. A maximal distal separation between the covering sleeve member seal 121 and the dry gas seal 123 is optimum for this version of the invention to work. Dry gas seal 123 when placed around the compartment forming sleeve member side wall lower edge 24 should have an outer diameter slightly greater than the outside diameter of the outward facing protuberances 104 of the compartment forming sleeve member 102. This permits a proper seal to be formed by the dry gas seal 123 with the covering sleeve member 30.

As before, it is anticipated that compartment forming sleeve member side wall 105 may also cover and surround in whole the food product container side wall 100 below the dry gas seal 123, and that compartment forming sleeve member bottom wall 106 extend to cover and surround the food product container domed bottom wall 22 as a cup-like sleeve structure.

As before, the inward facing protuberances 103 of the compartment forming sleeve member 102 are held tangentially tight against the food product container side wall 100 preferably by friction. And again, the outward facing protuberances 104 and the food product container side wall 100 form a collection of distinct compartments with the food product container side wall 100. The inward facing protuberances 103 and the covering sleeve member side wall 101 also form a collection of distinct compartments above the dry gas seal 123. The distinct compartments formed by outward facing protuberances 104 and the food product container side wall 100 and are filled with reacting chemical compounds RCC selected from pairs of hydrated chemical compounds S that react endothermically to generate the humidification liquid HL that will be used by the apparatus 10. Each such one of the pair of reacting chemical compounds RCC selected is placed in a neighboring distinct compartment formed by the outward facing protuberances 104 and the food product container side wall 100.

Covering sleeve member 30 is provided. Covering sleeve member 30 is made from one of stretch-formed polyethylene terephthalate (PET), polyvinyl chloride (terephthalate or PVC), and other materials such as deep drawn aluminum, in the form of a thin-walled cup-like sleeve that surrounds and encloses in whole or in part the food product container 20. Preferably, covering sleeve member 30 has a covering sleeve member side wall 101 that can just slidingly fit over compartment forming sleeve member side wall 105, and has a shape that follows the contour of food product container side wall 100. Covering sleeve member side wall 101 can take on a variety of shapes but must permit said covering sleeve member side wall 101 to mate sealingly with portions of the food product container side wall 100 to hold and form seals with the dry gas seal 123 and the covering sleeve member seal 121 when so formed as will be described in the foregoing.

The covering sleeve member side wall 101 covers in whole or in part a sealed food product container 20 containing a food product P with the compartment forming sleeve member 102 attached. Covering sleeve member side wall 101 preferably covers in-part food product container side wall 100 and may extend to cover in part the food product container top wall 107. Covering sleeve member side wall 101 can be made with many types of materials but preferably heat-shrinkable plastics such as PET and PVC are preferred. Covering sleeve member side wall 101 can also be made with aluminum as a deep drawn container, and must be re-formable by spin forming and crimping to form seals with the food product container 20.

As before, covering sleeve member 30 has covering sleeve member bottom wall 130 that sealing connects to covering sleeve member side wall 101. Covering sleeve member bottom wall 130 sealing connects to an inward protruding covering sleeve member shrinkable annular wall 133. Covering sleeve member shrinkable annular wall 133 is flexible and can respond to pressure changes by either collapsing or expanding.

As stated earlier, it is anticipated that covering sleeve member 101 may be made from spun or deep drawn aluminum and formed to provide for all the sealing required by spin forming and rolling it in parts. In such a case, covering sleeve member shrinkable annular wall 133 may be made from heat-shrinkable PET or PVC material and added on to the covering sleeve member bottom wall 130 by ultrasonic welding or gluing. If needed, a thin-walled open ended support cylinder 132, with support cylinder holes 137 close to its top end is placed to rest at the opposite open end on the covering sleeve member bottom wall 130 between the covering sleeve member side wall 101 and the covering sleeve member shrinkable annular wall 133 and to contact the food product container 20. If the covering sleeve member side wall 101 is made strong enough, support cylinder 132 is not necessary.

Also as described earlier, annular plastic heat-shrinking vapor absorber retention space 131 within the covering sleeve member 30 is formed between the space defined by the inner surface of the support cylinder 132, inner surface covering sleeve member shrinkable annular wall 133 and the inner surface covering sleeve member bottom wall 130. Annular plastic heat-shrinking vapor absorber retention space 131 is filled with a plastic heat-shrinking vapor absorber D up to the height of the covering sleeve member shrinkable annular wall 133.

An annular thermal wax retention space 136 is also formed in the covering sleeve member 30 between the outer surface of the support cylinder 132, the inner surface of the covering sleeve member side wall 102 and the inner surface of the covering sleeve member bottom wall 130. Annular thermal wax retention space 136 may be optionally filled up to the height of the support cylinder 132, with a suitable thermal wax 138 that can melt at temperatures ranging from 70° F. to 160° F. Support cylinder 132 prevents the covering sleeve member bottom wall 130 from collapsing and deforming its shape relative to food product container 20.

Figure 20:
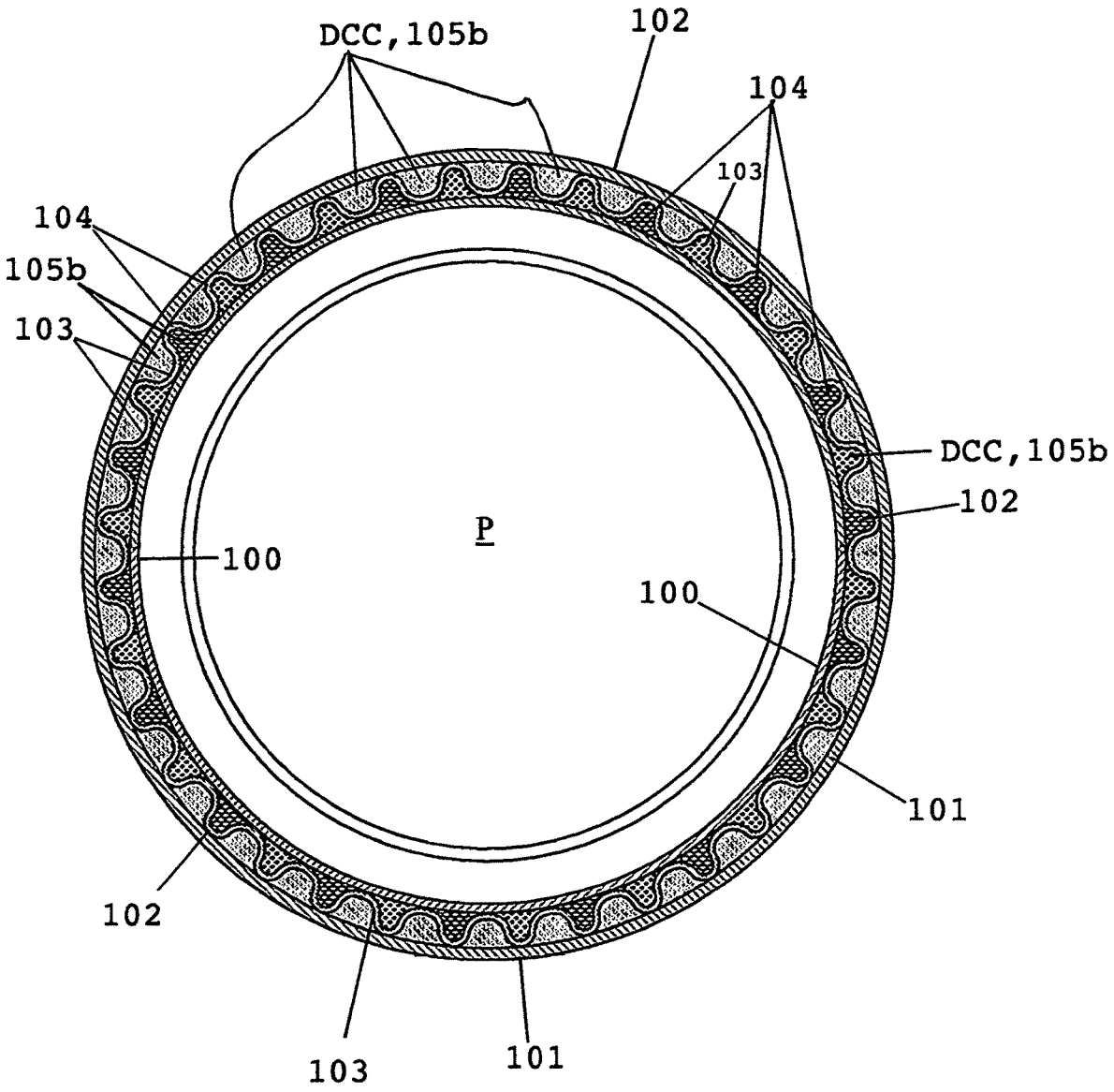
FIG. 20 again shows a cross section of the food product container wall surrounded by the compartment forming sleeve member and the covering sleeve member. The inward facing protuberances and the outward facing protuberances are shown to carry an independent set of dissolving chemical compounds in them surrounding the food product container side wall.
Figure 21:
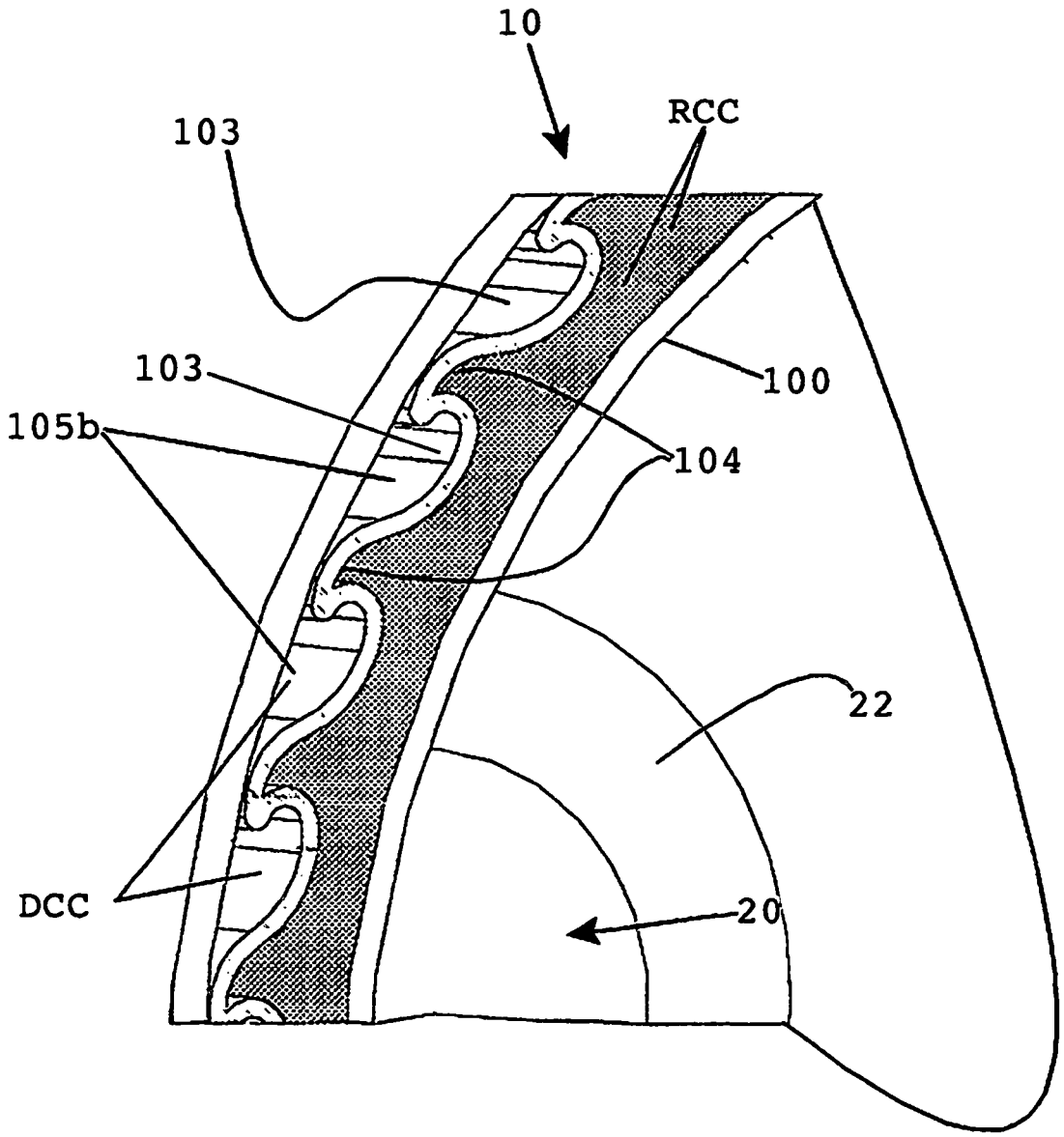
FIG. 21 shows a cross sectional blow-up of the apparatus showing the deformation of the protuberances when the covering sleeve side wall is massages by hand to mix reacting chemicals compounds separated by the inward facing protuberances. The dissolving chemicals compounds are also shown in the distinct compartments formed by the outward facing protuberances with the covering sleeve member as being stirred to form solutions.

When covering sleeve member is placed over the food product container 20 and the attached compartment forming sleeve member 102, the compartment forming sleeve member bottom wall 106 rests on the support cylinder 137 and the outward facing protuberances 104 on the compartment forming sleeve member side wall 105 tangentially touch the covering sleeve member side wall 101 to form distinct compartments **105*b* between the said walls. The covering sleeve member side wall 101 covers over the attached compartment forming sleeve member 102 and covers in-whole or in-part the food product container side wall 100. Inward facing protuberances 103 and the covering sleeve member side wall 101 form a collection of distinct compartments 105*b* above the dry gas seal 123 as shown in FIG. 13, and FIG. 20. Covering sleeve member side wall 101 preferably covers in-part food product container side wall 100 and may extend to cover in part the food product container top wall 107**.

As before, the covering sleeve member side wall 101 just fits over the compartment forming sleeve member 102 and should just tangentially touch the dry gas seal 123 tangentially. As before, the covering sleeve member side wall 101 has a covering sleeve member sealing portion 118 that is then shrunk in diameter to form a seal between the compartment forming sleeve member side wall 105 and the covering sleeve member side wall 101. This seal is used to seal a dry gas GS rarefied to just below atmospheric pressure and thus form a dry gas chamber DGS below the dry gas seal 123 that contains the support cylinder 132, the annular thermal wax retention space 136 with a thermal wax 138 therein, the annular plastic heat-shrinking vapor absorber retention space 131 with the plastic heat-shrinking vapor absorber D contained therein.

Preferably, more reacting chemicals compounds RCC are then placed in the distinct compartments **105*b* thus formed by the inward facing protuberances 103 and the covering sleeve member side wall 101. These distinct compartments 105*b* are adjacent to reacting chemicals compounds RCC that have been placed in the distinct compartments 105*b* formed before by the outward facing M protuberances 104 and the food product container side wall 100. Of course one could use the inward facing protuberances 103 and outward facing protuberances 104 to respectively store separate and different species of reacting chemical compounds RCC selected as pairs. Thus more than one species of pairs of reacting chemical compounds RCC can be used with the apparatus 10**. Preferably the variety of distinct reacting chemical compounds RCC that can react with each other endothermically are species chosen from pairs such as $BA(OH)_2 \cdot 8H_2O(s)$ and $NH_4SCN(s)$, and $NH_4NO_3(s)$, and $NH_4CL(s)$. These reacting chemical compounds RCC have humidification liquid HL stored between their hydrated structure.

A humidification liquid chamber w, is thus formed above the dry gas seal 123 with inward facing protuberances 103 and outward facing protuberances 104 containing the reacting chemical compounds RCC that have water as humidification liquid HL in them. To avoid premature reactions, the reacting chemical compounds RCC pairs that can react with one another are placed in distinct outward facing protuberances 104 separated by inward facing protuberances 103 respectively. The same is true for the reacting chemical compounds placed in distinct inward facing protuberances 103 separated by outward facing protuberances 104 respectively.

Dry gas GS rarefied to just below atmospheric pressure is provided to fill and purge covering sleeve member 30 further. Covering sleeve member side wall 101 has a covering sleeve member sealing portion 108 that can be shrunk in diameter to seal over covering seal 121 and form seal form a covering sleeve member side wall seal 109. Covering sleeve member sealing portion 108 when shrunk in diameter forms a seal with the covering seal 121 between the food product container top wall seam 114 and the covering sleeve member 30 to seal off the humidification liquid chamber W from atmosphere.

As before, it is anticipated that covering sleeve member side wall end 110 is located at the covering sleeve member sealing portion 108, but it is contemplated that the covering sleeve member M side wall end 110 may extend beyond the covering sleeve member sealing portion 108.

Covering sleeve member sealing portion 108 can be either be heated and heat shrunk if made from heat-shrinkable material or roll formed roll formed with a rolling former machine to shrink in diameter and seal against the covering seal 121 against the food product container top wall seam 114 and hold the rarefied dry gas GS therein.

FIG. 13 shows the separation arrangement of the reactive chemical compounds RCC in the humidification liquid chamber W.

Method of Manufacture of Second Embodiment

A standard food product container 20 is provided.

As before, a dry gas seal 123 is provided and first placed circumferentially and sealingly around the food product container side wall 100 in a plane parallel to the diametric plane of the food product container 20 and to band and seal around the compartment forming sleeve member side wall bottom edge 24.

As described earlier, the compartment forming sleeve member 102 is provided preferably as a cylindrical structure with inward facing protuberances 103 and outward facing protuberances 104. Inward facing protuberances 103 should have a diameter that is just a slide fit over food product container side wall 100. Thus compartment forming sleeve member 102 is slid over the food product container side wall 100 to sit on dry gas seal 123 and attached circumferentially to cover at least in part the food product container side wall 100 above the dry gas seal 123.

The desired species of reacting chemicals compounds RCC are then filled into the respective outward facing protuberances 104 that form respective chambers.

As before, a covering sleeve member seal 121 is provided and placed circumferentially and tightly around the food product container side wall 100 in a plane parallel to the diametric plane of the food product container 20 and to band around the food product container top wall seam 114.

As before, covering sleeve member 30 is provided. Covering sleeve member side wall 101 should be of a length greater than the food product container 20 and in fact it is preferable that it extends beyond the food product container top wall 107 by at least 50 mm for manufacturing purposes.

To avoid repletion, as before support cylinder 132 (not shown as an example of not being absolutely necessary) may be placed to sit on covering sleeve member bottom wall 130 with support cylinder holes 137 close to the food product container 20 to form the annular plastic heat-shrinking vapor absorber retention space 131 and the annular thermal wax retention space 136. Thermal wax 138 (not shown as an example of not being absolutely necessary) is placed to fill the annular thermal wax retention space 136. Plastic heat-shrinking vapor absorber D is filled into the annular plastic heat-shrinking vapor absorber retention space 131.

The subassembly of the food product container 20, the compartment forming sleeve member 102, the covering sleeve member seal 121 and the dry gas seal 123 just sit frictionally against the covering sleeve member side wall 101 with compartment forming sleeve member bottom wall 106 spaced above plastic heat-shrinking vapor absorber D. The desired species of reacting chemicals compounds RCC are then filled into the respective inward facing protuberances 103 that form respective chambers with the covering sleeve member side wall 101.

Cylindrical rod CR is provided as before. The humidification liquid valve HLV, the dry gas valve DGV and the vacuum valve Vv are shut off.

The dry gas valve DGV at a low pressure of about 1 psig and the vacuum valve Vv are first opened to permit dry gas GS to flood the interior of the covering sleeve member 30 to purge any wet air and gases within the covering sleeve member 30 using the vacuum pump VP. After a few seconds of purging, the dry gas valve DGV is turned off to permit the vacuum pump VP to lightly rarify the dry gas DG remaining in the covering sleeve member 30 to a pressure just below ambient atmospheric pressure. Hot air HA from heat source HG is first directed at the location of the covering sleeve member side wall 118 with covering sleeve member sealing portion 119 to heat-shrink it in diameter to form a seal between the covering sleeve member side wall 100 against the dry gas seal 123 and causes the dry gas seal 123 to seal against the compartment forming sleeve member side wall 105, after which the hot air HA is removed. This traps dry gas GS in a rarefied state in the plastic heat-shrinking vapor absorber D below the dry gas seal 123.

As before, if made from a heat-shrinkable plastic, hot air HA is then directed at the location of the covering sleeve member sealing portion 108 of the covering sleeve member side wall 101 to shrink and clamp the covering sleeve member sealing portion 108 around the surface of covering sleeve member seal 121 to clamp the same against the food product container top wall seam 114 and form a seal, after which the hot air HA is removed. This seals the humidification liquid chamber W with rarefied dry gas GS.

If made from a deep drawn and spun aluminum, forming rollers from a rolling forming machine RFM is directed at the location of the food product covering sleeve member sealing portion 108 of the covering sleeve member side wall 101 to shrink and clamp the covering sleeve member sealing portion 108 around the surface of covering sleeve member seal 121 to form the seal against the food product container top wall seam 114.

Thus dry gas GS at a rarefied pressure is now sealed inside the humidification liquid chamber w, and inside the dry gas chamber DGS and also permeates the plastic heat-shrinking vapor absorber D. Then, the dry gas valve DGV and the vacuum valve Vv are shut off. As before, the extra material of the covering sleeve member 30 that is still attached to the cylindrical rod CR is cut off to create the covering sleeve member side wall end 110. The apparatus 10 is now ready for use.

Method of Operation of the Apparatus According to the Second Embodiment

Cooling actuation means 40 is activated by using finger pressure f to deform the dry gas seal 123 causing fluid communication between the humidification liquid chamber W and the dry gas chamber DGS. It is anticipated that cooling actuation means 40 is activated before the food product release means 113 is used. However, should the food product release means 113 be actuated before the cooling actuation means, then it is anticipated that the pressure drop of the food product container 20 will cause a relaxation of the food product container side wall 100 and slacken the grip of the dry gas seal 123 relative to the compartment forming sleeve member side wall 105 and thus will cause fluid communication between the humidification liquid chamber W the dry gas chamber DGS and the plastic heat-shrinking vapor absorber D.

The covering sleeve member side wall 101 can then be massaged by hand relative to the compartment forming sleeve member side wall 105 to cause the reacting chemical compounds RCC in the humidification liquid chamber W to react with each other to endothermically cool and at the same time reaction released humidification liquid HL. The massaging deforms the inward facing protuberances and the outward facing protuberances 104 of the compartment forming sleeve member 102 to permit the reacting chemical compounds RCC to mix and react with each other to provide a first cooling means of the apparatus 10 by endothermic reaction cooling and at the same time provides a means to reaction released humidification liquid HL for a second cooling means.

The rarefication of the dry gas GS will force humidification liquid HL thus generated by reactions to evaporate as humidification liquid vapor Vw into the dry gas dg. The dry gas DG absorbs humidification liquid vapor Vw and this lowers the dew point temperature of the dry gas DG and it to becomes wet gas in a third cooling means of the apparatus 10. Additional heat of evaporation, h, is taken away from the humidification liquid HL by the dry gas DG as it becomes wet and lowers its dew point temperature. The higher dew point temperature dry gas DG saturates the dry gas chamber DGS and is absorbed by the plastic heat-shrinking vapor absorber D in the annular plastic heat-shrinking vapor absorber retention space 131. Plastic heat-shrinking vapor absorber D heats up as it sorbs the humidification liquid vapor Vw and the annular plastic heat-shrinking vapor absorber retention space wall 133 which is tensioned by being stretch-formed, responds to the increase in its temperature by deforming and shrinking its area.

As before, when heated, the annular plastic heat-shrinking vapor absorber retention space wall 133 shrinks its surface area and moves outwardly away from the food product container domed bottom wall 22 causing the volume of the dry gas chamber DGS and the humidification liquid chamber W to increase and thus generating a substantial lower vapor pressure in the fixed amount of rarified dry gas DG in the dry gas chamber DGS. This lowers the vapor pressure of the dry gas DG in the dry gas chamber DGS. The pressure in the dry gas chamber DGS is now lower and it will absorb more humidification liquid vapor Vw to continue the cooling process.

Further, the deformation motion of the annular plastic heat-shrinking vapor absorber retention space walls 133 causes the plastic heat-shrinking vapor absorber D to move and spread out to permit unexposed plastic heat-shrinking vapor absorber D to take action and effectuate the sorbing of humidification liquid vapor Vw into the plastic heat-shrinking vapor absorber D and a second cooling means is provided by the evaporation of the humidification liquid HL generated by the reactions.

Third Embodiment of the Invention

Figure 15:
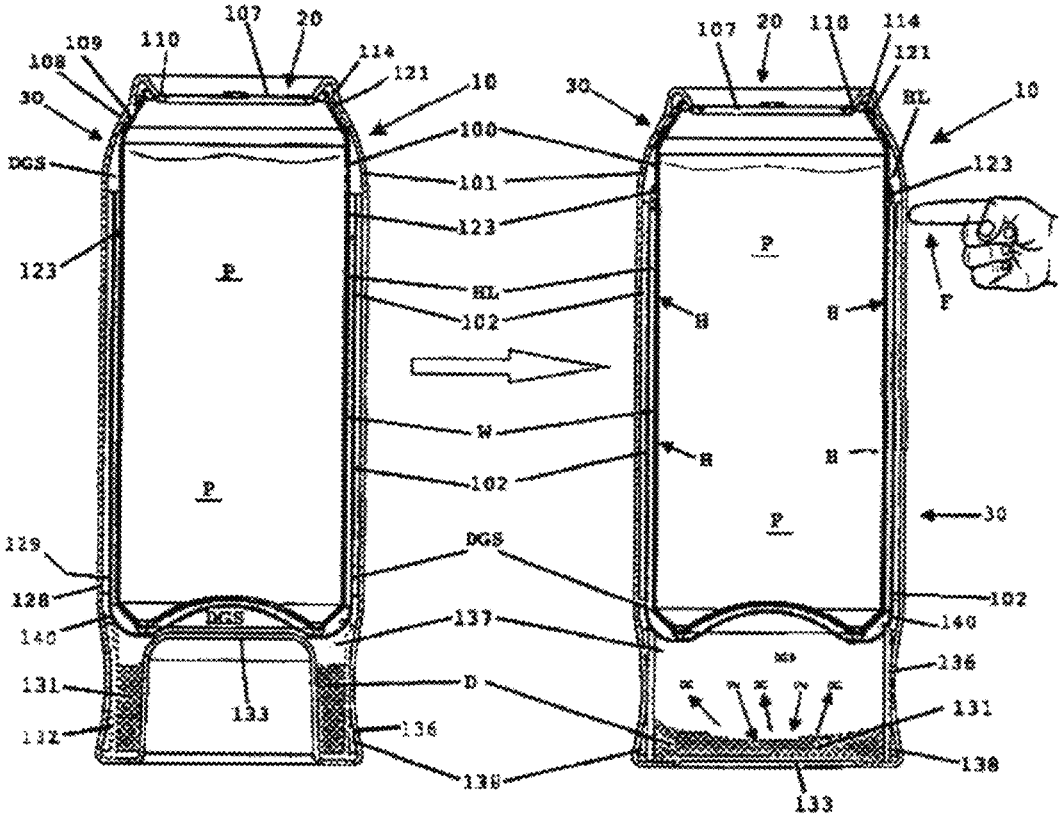
FIG. 15 shows the third embodiment of the present invention. In this embodiment, the humidification liquid is shown entering into the dry gas chamber and falling into the wick as the dry gas seal is broken.

Referring to FIG. 15, a standard food product container 20 is provided. This embodiment is just another version of the first and second embodiment with the same elements. The difference between this third embodiment and the first embodiment is that the dry gas seal 123 is made at the compartment forming sleeve member side wall top edge 105*a* of the compartment forming sleeve member side wall 105 and the food product container side wall 100.

As before, covering sleeve member seal 121 is provided as described in the first embodiment of the invention, in the form of a thin loop structure made from one of an O-ring seal, a metal ring seal, a rubber band seal, a putty seal, and sealing wax seal, and a glue bonding agent. The covering sleeve member seal 121 should be expandable to form a tight sealing band around the food product container 20. The loop diameter of covering sleeve member seal 121 is placed circumferentially and sealingly tight around the food product container top wall seam 114 in a plane parallel to the diametric plane of the food product container 20.

As before, a dry gas seal 123 is provided as described in the first embodiment of the invention preferably also in the form of an O-ring seal, metal band seal, a rubber band seal, a putty seal, and sealing wax seal, a glue bonding agent and shaped in the form of a thin loop, usually a ring structure. The dry gas seal 123 is placed circumferentially and sealingly tight around the food product container side wall 100 in a plane parallel to the diametric plane of the food product container 20 and spaced about 20 mm from the covering sleeve member seal 121.

As before, compartment forming sleeve member 102 in the shape of a thin cup is provided with the compartment forming sleeve member side wall 105 and the compartment forming sleeve member bottom wall 106. Compartment forming sleeve member 102 is a thin-walled cup-like structure with compartment forming sleeve member side wall 105 and compartment forming sleeve member bottom wall 106 that surrounds in part the food product container side wall 100 forming an annular gap with the food product container side wall 100.

As before, the compartment forming sleeve member 102 is preferably formed from either injection-molded plastic material such as PET and PVC. The compartment forming sleeve member 102 can also be formed as a thin deep drawn aluminum cup. The compartment forming sleeve member 102 can also be injection molded, however it is anticipated that compartment forming sleeve member 102 is made from heat-shrinkable plastic material such as PET and PVC. As such the compartment forming sleeve member 102 should be tall enough to surround the food product container bottom domed wall 22 and for the compartment forming sleeve member side wall 105 to cover most of the food product container side wall 100 with the compartment forming sleeve member top edge 105*a* just above the dry gas seal 123. The compartment forming sleeve member side wall 105 is shrunk in diameter to and clamp over the dry gas seal 123 to form a fluid seal between the food product container side wall 100. The inward surface of the compartment forming sleeve member side wall 105, the dry gas seal 123, outward surface of the food product container side wall 100, the outward surface of the food product domed bottom wall 22 and the inward surface of the compartment forming sleeve member bottom wall 106 form a humidification liquid chamber W filled with humidification liquid HL to surround the food product container side wall 100 in part and the food product domed bottom wall 22. Humidification liquid fills the humidification liquid chamber W up to just below dry gas seal 123. Thus, when compartment forming sleeve member 102 is either heat shrunk or crimped to seal over the dry gas seal 123, dry gas seal 123 forms a seal between the compartment forming sleeve member side wall 105 and the food product container side wall 100 in part to form the sealed humidification liquid chamber W which contains humidification liquid HL. The humidification liquid HL thus surrounds the food product container bottom domed wall 22 and the food product container side wall 100 in part.

As before a wick 140 is optionally provided but not necessary. Wick 140 is bonded to the outward facing wall of compartment forming sleeve member side wall 105 as described earlier.

As before, the covering sleeve member side wall 101 has a covering sleeve member sealing portion 118 that can be shrunk in diameter to form a restricted vapor passageway 119*a* on the wick 140 against the compartment forming sleeve member side wall 105. The compression of covering sleeve member sealing portion 118 also causes the dry gas seal 123 to seal between the compartment forming sleeve member side wall 105 and the food product container side wall 100.

As before, when the covering sleeve member sealing portion 108 is shrunk in diameter it forms a covering sleeve member seal 109 with the covering seal 121 and clamps around the food product container top wall seam 114 to form the dry gas chamber DGS. The dry gas chamber DGS extends between the covering sleeve member seal 121, the covering sleeve member side wall 101, the food product container side wall 100 above the dry gas seal 123 in-part, the dry gas seal 123 and the outward facing surface of the compartment forming sleeve member 102. A dry gas DG preferably just under ambient atmospheric pressure is provided inside the dry gas chamber DGS.

As before, covering sleeve member 30 has covering sleeve member bottom wall 130 that sealing connects to covering sleeve member side wall 101. Covering sleeve member bottom wall 130 sealing connects to an inward protruding covering sleeve member shrinkable annular wall 133. Covering sleeve member shrinkable annular wall 133 is flexible and can respond to pressure changes by either collapsing or expanding.

Food product container 20 is preferably a cylindrical beverage container of standard design, with standard food product release means 113 and a standard food product release port 112.

Covering sleeve member 30 is provided. Covering sleeve member 30 as described earlier is preferably made from one of stretch-formed, stretch blown PET and PVC to form a covering sleeve member 30 in the form of a thin-walled cup-like sleeve, but it can also be formed from deep drawn thin walled aluminum. Covering sleeve member 30 has covering sleeve member side wall 101 that surrounds in whole or in part the food product container 20 with compartment forming sleeve member 102 attached to said food product container side wall 100. Covering sleeve member side wall 101 can take on a variety of shapes to give it strength but must permit said covering sleeve member side wall 101 to mate with portions of the food product container side wall 100 as will be described in the foregoing. The covering sleeve member side wall 101 covers in whole or in part a sealed food product container 20 containing a food product P. Covering sleeve member side wall 101 can be made with other plastic materials that can shrink when heat is applied to their surfaces. Covering sleeve member side wall 101 preferably covers in-part food product container side wall 100 and may extend to cover in part the food product container top wall 107. The covering sleeve member side wall 101 just slidingly fits and circumferentially surrounds the wick 140 on the compartment forming sleeve member 102. Covering sleeve member side wall 101 preferably covers in-part food product container side wall 100 and may extend to cover in part the food product container top wall 107. It is anticipated that covering sleeve member side wall end 110 is located at the covering sleeve member sealing portion 108, but it is contemplated that the covering sleeve member side wall end 110 may extend beyond the covering sleeve member sealing portion 108 and above the food product container top wall 107. When the covering sleeve member sealing portion 108 is shrunk, it clamps around the surface of compartment forming sleeve member 102 and forms an annular dry gas chamber DGS defined by the surfaces of the dry gas seal 123, the covering sleeve member seal 121 and the food product container side wall 100 in part and the covering sleeve member side wall in part.

Covering sleeve member 30 protects compartment forming sleeve member 102. When the covering sleeve member side wall 101 is heat shrunk, it should not clamp around the surface of compartment forming sleeve member 102 but must permit humidification liquid vapor Vw to able to pass between the covering sleeve member side wall 101 and the outward facing compartment forming sleeve member side wall 105. It is anticipated that covering sleeve member sealing portion 118 partially deforms around the compartment forming sleeve member 102 to securely hold the same and provide for a restricted vapor passageway 119*a*.

The outward facing surface of the compartment forming sleeve member side wall 105, the dry gas seal 123, and the inward facing surface in part covering sleeve member 30 form a dry gas chamber DGS. The outward facing surface of the food product container side wall 100, the covering sleeve member seal 121, and the inward facing surface in part food product container side wall 101 form a humidification liquid chamber w.

Covering sleeve member 30 has covering sleeve member bottom wall 130 that sealing connects to covering sleeve member side wall 101. Covering sleeve member bottom wall 130 sealing connects to an inward protruding covering sleeve member shrinkable annular wall 133. Covering sleeve member shrinkable annular wall 133 is flexible and can respond to pressure changes by either collapsing or expanding. Covering sleeve member shrinkable annular wall 133 is filled with plastic heat-shrinking vapor absorber D up to the level of the covering sleeve member shrinkable annular wall 133. The inside surfaces of covering sleeve member 30 below the covering sleeve member seal 121 form a dry gas chamber DGS containing a dry gas GS.

It is anticipated that covering sleeve member 101 may be made from spun or deep drawn aluminum and formed to provide for all the sealing required by spin forming and rolling it in parts. In such a case, covering sleeve member shrinkable annular wall 133 may be made from heat-shrinkable PET or PVC material and added on to the covering sleeve member bottom wall 130 by ultrasonic welding or gluing. If needed, a thin-walled open ended support cylinder 132 provided as before, with support cylinder holes 137 close to its top end is placed to rest at the opposite open end on the covering sleeve member bottom wall 130 between the covering sleeve member side wall 101 and the covering sleeve member shrinkable annular wall 133 and to contact the compartment forming sleeve member bottom wall 105. If the covering sleeve member side wall 101 is made strong enough, support cylinder 132 is not necessary.

Annular plastic heat-shrinking vapor absorber retention space 131 within the dry gas chamber DGS is formed between the space defined by the inner surface of the support cylinder 132, inner surface covering sleeve member shrinkable annular wall 133 and the inner surface covering sleeve member bottom wall 130. Annular plastic heat-shrinking vapor absorber retention space 131 is in fluid communication with the dry gas chamber DGS and is within dry gas chamber DGS. An annular thermal wax retention space 136 is formed in the dry gas chamber DGS between the outer surface of the support cylinder 132, the inner surface of the covering sleeve member side wall 102 and the inner surface of the covering sleeve member bottom wall 130. Annular thermal wax retention space 136 may be optionally filled with a suitable thermal wax 138 that can melt at temperatures ranging from 70° F. to 160° F. Support cylinder 132 prevents the covering sleeve member bottom wall 130 from collapsing and deforming its shape relative to food product container 20.

A cooling actuation means, 40, is provided when a finger f is used to depress covering sleeve member side wall 101 at the location of the dry gas seal 123 to deform the same and expose humidification liquid HL from the humidification liquid chamber W into the dry gas chamber e.

It is anticipated that compartment forming sleeve member 102 may have shapes and forms that can assist in increasing the surface area, to help evaporation in the dry gas chamber DGS. It is anticipated that ionizable chemical compounds S are selected from the species of dissolving chemical compounds DCC that dissolve endothermically may be placed in inward facing protuberances 103 of the compartment forming sleeve member 102 as described earlier. This can be done by infusing the outward facing surface of compartment forming sleeve member 102 with said ionizable dissolving chemical compounds DCC as described earlier. Restricted vapor passageway 119*a* is formed by the clamping of covering sleeve member sealing portion 118 on wick 140.

Annular plastic heat-shrinking vapor absorber retention space 131 holds a plastic heat-shrinking vapor absorber D, such as silica gel, molecular sieves, clay desiccants such as montmorillonite clays, calcium oxide, and calcium sulfide. Annular plastic heat-shrinking vapor absorber retention space 131 is stretch-formed from a heat-shrinkable material including various forms of heat-shrinkable PET and various forms of heat-shrinkable PVC. Covering sleeve member shrinkable annular wall 133 responds to heat by deforming and shrinking its surface area. Advantageously, covering sleeve member shrinkable annular wall 133 shrinks in surface area and tends to flatten with heat received from the plastic heat-shrinking vapor absorber to increase the volume of the dry gas chamber DGS. This deformation is caused by the plastic heat-shrinking vapor absorber D heating up as it absorbs humidification liquid HL vapor Vw from humidified dry gas DG in the dry gas chamber DGS. The dry gas GS in the dry gas chamber DGS is in fluid communication with the plastic heat-shrinking vapor absorber D and with the restricted vapor passageway 119*a* and thus, advantageously, the annular plastic heat-shrinking vapor absorber retention space 131 is in fluid communication with the outside walls of compartment forming sleeve member 102.

The shape of covering sleeve member shrinkable annular wall 133 must minimize the dry gas chamber DGS before it is heated, and thus its intrusion into the dry gas chamber DGS must be designed to maximize and increase the volume of the dry gas chamber DGS. In the examples shown in FIG. 1, the shape of the covering sleeve member shrinkable annular wall 133 is an inverted cup. However, it could take on many shapes as shown in the various figures.

When heated, the covering sleeve member shrinkable annular wall 133 shrinks and minimizes its area. The annular plastic heat-shrinking vapor absorber retention space 131 expands and move outwardly and causes the volume of the dry gas chamber DGS to increase to generate a substantially lower pressure on dry gas DG less than its initial pressure which preferably is just below ambient atmospheric pressure. This lowers the vapor pressure of the dry gas DG and any vapor in the dry gas chamber DGS, and thus the vapor pressure in the compartment forming sleeve member 102. Thus, it is anticipated that covering sleeve member side wall 100 may be designed with annular protuberances or lateral protuberances to strengthen it and prevent it from collapsing under the rarefication force generated by the plastic heat-shrinking vapor absorber D. For example, the inward facing protuberances 103 and outward facing protuberances 104 shown in FIG. 2 may suffice to provide all the strength and surface area required to support covering sleeve member side wall 100 from the rarefication pressure force generated by the plastic heat-shrinking vapor absorber D. It is anticipated that the humidification liquid chamber W can be made to just hold enough humidification liquid HL without overflow when it receives it.

As before, the compartment forming sleeve member 102's outward facing surface forms a part of the dry gas chamber DGS. This surface can also be layered with ionizable compounds S when it is heat shrunk to form its shape by hot-spraying it with a stream of particulates of ionizable compounds carried by heated air at high impact pressure as it is thermally shrunk to form its shape on a mold. A dry gas DG at preferably just below atmospheric ambient pressure is provided inside the dry gas chamber DGS and to also fill the dry gas chamber DGS and create a slight pressure difference between the dry gas chamber DGS (lower pressure) and the humidification liquid chamber W.

Figure 16:
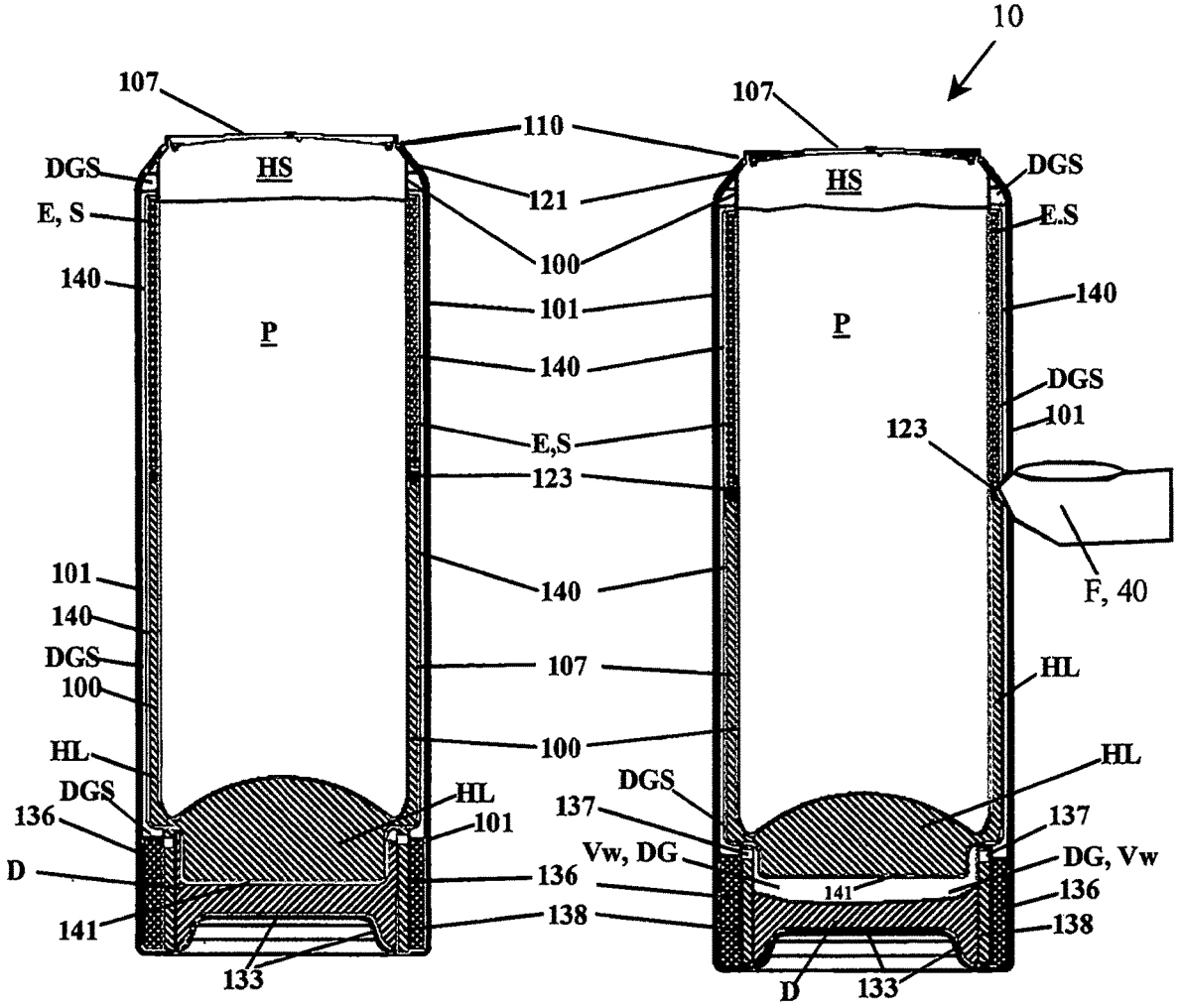
FIG. 16 shows the fourth embodiment of the invention with the dry gas chamber surrounding the humidification liquid chamber. The humidification liquid chamber is sealed at the center of the compartment forming sleeve member side wall by the dry gas seal. A finger is shown pushing on the dry gas seal to deform it and permit humidification liquid to enter into the dry gas chamber in a similar manner to that shown in FIG. 15. The flow of humidification liquid from the humidification liquid chamber is due to the difference in pressure between the dry gas chamber and the humidification liquid chamber. As the plastic heat-shrinking vapor absorber heats up and deforms the annular plastic heat-shrinking vapor absorber retention space it generates a negative pressure in the dry gas chamber. This pulls the humidification liquid from the humidification liquid chamber to the dry gas chamber to saturate the dry gas chamber and cause both endothermic cooling and evaporative cooling.

FIG. 16 shows the apparatus 10 according to the Fourth Embodiment when the cooling means F is actuated.

Method of Manufacture of Third and Fourth Embodiments

This method is essentially the same as the steps required for the first embodiment with slight differences, a standard food product container 20 is provided.

As before, a covering sleeve member seal 121 is provided and covering sleeve member seal 121 is expanded and placed circumferentially and tightly around the food product container side wall 100 in a plane parallel to the diametric plane of the food product container 20 and to band around the food product container top wall seam 114.

As before, dry gas seal 123 is provided and expanded and placed circumferentially and tightly around the food product container top wall 107 about 20 mm or so below covering sleeve member seal 121 in a plane parallel to the diametric plane of the food product container 20 to band around the food product container side wall 100.

Compartment forming sleeve member 102 is provided in the form of a cup-sleeve as described earlier is provided to frictionally encases and fits over food product container side wall 100 and just cover the dry gas seal 123. As before a wick 140 is optionally provided and bonded to the outward facing wall of compartment forming sleeve member side wall 105.

Humidification liquid HL is poured into compartment forming sleeve member 102 to fill the humidification liquid chamber W between the food product container and the compartment forming sleeve member 102 up to just below the dry gas seal 123.

Hot air HA is first directed at the compartment forming sleeve member 102 at location of the dry gas seal 123 to shrink and clamp the compartment forming sleeve member 102 in part around the surface of dry gas seal 123, after which the hot air HA is removed. This seals in humidification liquid HL and forms the sealed humidification liquid chamber w, formed by the annular gap between the food product container and the compartment forming sleeve member 102 up to just below the dry gas seal 123.

As before, covering sleeve member 30 is provided as cup-like structure with straight covering sleeve member side wall 101 as shown in FIG. 2.

As before, covering sleeve member side wall 101 should be taller than food product container 20 and should extend beyond the food product container top wall 107 by at least 50 mm. The covering sleeve member side wall 101 just fits over the compartment forming sleeve member 102:

As before, support cylinder 132 is placed to sit on covering sleeve member bottom wall 130 with support cylinder holes 137 close to the food product container 20 to form the annular plastic heat-shrinking vapor absorber retention space 131 and the annular thermal wax retention space 136. As before, thermal wax 138 is placed to fill the annular thermal wax retention space 136 and holds a plastic heat-shrinking vapor absorber D is filled in the annular plastic heat-shrinking vapor absorber retention space 131.

As before, food product container 20 with the compartment forming sleeve member 102, compartment forming sleeve member 102 attached, the covering sleeve member seal 121 and the dry gas seal 123 is inserted to sit on support cylinder 132 inside the covering sleeve member 30.

As before, cylindrical rod CR is provided with a through hole TH through its length and with a three-way fitting TFW attached to the through hole TH. As before, the first input of the three-way fitting TFW is connected by a dry gas hose DGH to fluidly communication with dry gas pressure canister DGC via a dry gas valve DGV. As before the second input of the three-way fitting TFW is connected by a vacuum pump hose VPH to a vacuum pump VP via a vacuum valve Vv. As before the third input of the three-way fitting TFW is connected by a humidification liquid tank HLT via a humidification liquid valve HLV.

As before the cylindrical rod CR outer diameter is made to fit exactly inside the covering sleeve member 30 and it is inserted about 20 mm into the open end of covering sleeve member 30 and covering sleeve member 30 is heat shrunk to seal around it. The humidification liquid valve HLV, the dry gas valve DGV and the vacuum valve Vv are shut off.

As stated earlier, the dry gas valve DGV regulated at a low pressure of about 1 psig and the vacuum valve Vv are first opened to permit dry gas GS to flood the interior of the covering sleeve member 30 to purge any wet air and gases within the compartment forming sleeve member 102, the dry gas chamber DGS and in the interior of the covering sleeve member 30 using the vacuum pump VP. After a few seconds of purging, the dry gas valve DGV is turned off to permit the vacuum pump VP to lightly rarify the dry gas DG remaining in the covering sleeve member 30 to a pressure just below ambient atmospheric pressure. A cut off valve to control the pressure may be provided, but the vacuum pump VP itself can be made to provide the rarefication required.

Hot air HA from the heat source HS is now directed on the location of the food product covering sleeve member sealing portion 108 of the covering sleeve member side wall 101 to shrink and clamp around the covering seal 121 after which the hot air HA is removed. This seals and forms the dry gas GS in the dry gas chamber DGS.

Then, the extra material of the covering sleeve member 30 that is attached to the cylindrical rod CR is cut off to create the covering sleeve member side wall end 110. The apparatus 10 is now ready for use.

Method of Operation of the Apparatus According to the Third and Fourth Embodiments It is anticipated that the cooling actuation means 40 is activated by finger f pressure to deform dry gas seal 123 before the food product release means 113 is used. However, should the food product release means 113 be used before the cooling actuation means 40, then, it is anticipated that the pressure drop due to the absence of a seal in the food product P and also within a carbonated food product to container 20 will cause a relaxation of the food product container side wall 100 and thus compromise the integrity of the seal formed by dry gas seal 123 between the compartment forming sleeve member 102 and the covering sleeve member side wall 101 and the slight rarefication of the dry gas GS will cause a pressure difference between the dry gas chamber DGS (lower pressure) and the humidification liquid chamber w. In either case of the cooling actuation means 40, humidification liquid HL will naturally cause the humidification liquid vapor Vw from the humidification liquid chamber W to evaporate into the dry gas chamber DGS. The slight rarefication of the dry gas GS will cause a pressure difference between the dry gas chamber DGS (lower pressure) and the humidification liquid chamber w. In either case of the cooling actuation means 40, humidification liquid vapor Vw will naturally be forced to evaporate and enter into the dry gas chamber DGS by the pressure difference between the dry gas chamber DGS and the humidification liquid chamber W. This starts the cooling process by evaporation of humidification liquid vapor Vw into the dry gas GS. The same happens when the food product release means 113 is used before the cooling actuation means 40. The hold of the dry gas seal 123 on the food product container side wall 100 is weakened when the carbonation pressure is released from the food product P and the slight rarefication of the dry gas GS will cause a pressure difference between the dry gas chamber DGS (lower pressure) and the humidification liquid chamber w. In either case of the cooling actuation means 40, humidification liquid vapor Vw will naturally be forced by to enter into the dry gas chamber DGS. Humidification liquid vapor Vw passes through into the dry gas chamber DGS which has dry gas DG in it. The dry gas chamber DGS is anticipated to contain chemical compounds S within it. This causes further endothermic cooling. Dry gas GS evaporates the humidification liquid HL into humidification liquid vapor Vw and evaporative cooling occurs. The dry gas DG absorbs humidification liquid vapor Vw and this lowers the dew point temperature of the dry gas DG and it becomes wet gas. The heat of evaporation, H, is taken away by the dry gas DG as it becomes wet and lowers its dew point temperature.

As before, the plastic heat-shrinking vapor absorber D heats up as it sorbs the humidification liquid vapor Vw and the annular plastic heat-shrinking vapor absorber retention space wall 133 which is tensioned by being stretch-formed, responds to the increase in its temperature by deforming and shrinking its area.

As before, when heated, the annular plastic heat-shrinking vapor absorber retention space wall 133 shrinks its surface area and moves outwardly away from the food product container domed bottom wall 22 causing the volume of the dry gas chamber DGS to increase and thus generating a substantial lower vapor pressure in the fixed amount of rarified dry gas DG in the dry gas chamber DGS. This lowers the vapor pressure of the dry gas DG in the dry gas chamber DGS. The pressure in the dry gas chamber DGS is now lower and thus humidification liquid vapor Vw is pulled into the dry gas chamber DGS at an accelerated rate. This deformation of the annular plastic heat-shrinking vapor absorber retention space wall 133 continues with the continued generation of more heat of evaporation h and causing the annular plastic heat-shrinking vapor absorber retention space wall 133 to tend to flatten and thus increase the volume of the dry gas chamber DGS relative to its original volume. The deformation and flattening of the annular plastic heat-shrinking vapor absorber retention space wall 133 causes the dry gas chamber DGS to increase in volume, and since there is a fixed amount of dry gas DG in the dry gas chamber DGS, a lower pressure is created inside the dry gas chamber DGS. The annular plastic heat-shrinking vapor absorber retention space 131 is also made larger by the flattening of the annular plastic heat-shrinking vapor absorber retention space wall 133. As before, this causes the plastic heat-shrinking vapor absorber D to continuously shift, move, fall, and spread over the flattened annular plastic heat-shrinking vapor absorber retention space wall 133. This spreading agitates the plastic heat-shrinking vapor absorber D and makes it more effective as it assumes a greater surface area. Thus, dry gas DG is an electromotive heat transport means for humidification liquid vapor Vw into the plastic to heat-shrinking vapor absorber D without the need for a vacuum.

The combination of the humidification liquid HL and the plastic heat-shrinking vapor absorber D is summarized in table 1 below:

TABLE 1

| Humidification liquid HL | Dry gas GS | Plastic heat-shrinking vapor absorber D |
|---|---|---|
| Purified water | Air, carbon dioxide gas. | Silica gel, 4a ° molecular sieves, clay desiccants such as montmorillonite clays, calcium oxide, calcium sulfide. Carbon sieves. Phosphorous pentoxide and montmorillonite clays Phosphorous pentoxide and carbon. |
| Ammonia-water solution | Nitrogen gas | Water, Sodium thiocyanate, Monomethyl amine-water, lithium nitrate, 4a ° molecular sieves. |
| Ethanol-water mixtures | Air | 5a ° molecular sieves, Carbon sieves |

FIG. 16 shows yet another version of the third embodiment with the dry gas seal 123 positioned about midway on the food product container side wall 100 to make room above the humidification liquid chamber to hold dissolving chemical compounds DCC above the dry gas seal 123. FIG. 16 also shows an outwardly heat-shrinkable projection 141 that forms the bottom wall of the compartment forming sleeve member 102. Heat-shrinkable projection 141 is an example of an outward projecting structure relative to the food product container 20 that increases the volume of the dry gas chamber DGS when heated by plastic heat-shrinking vapor absorber D, while at the same time it decreases the volume of the humidification liquid chamber W. It acts as a pump for the humidification liquid HL to rise and interact with dissolving chemical compounds DCC to provide endothermic cooling by their solvation. At the same time, the dry gas DG will cause the humidification liquid HL to evaporate to humidification liquid vapor Vw and cause even more cooling by evaporation. Thus by regulating the amount of humidification liquid HL pumped into the dissolving chemical compounds DCC and the evaporation rate of the humidification liquid hl, the drying and dissolving of the dissolving chemical compounds DCC can be regulated to provide for a repeated cooling using the same amount of the chemicals to repeat the solvation process and cooling.

Fifth Embodiment of the Present Invention

Figure 23:
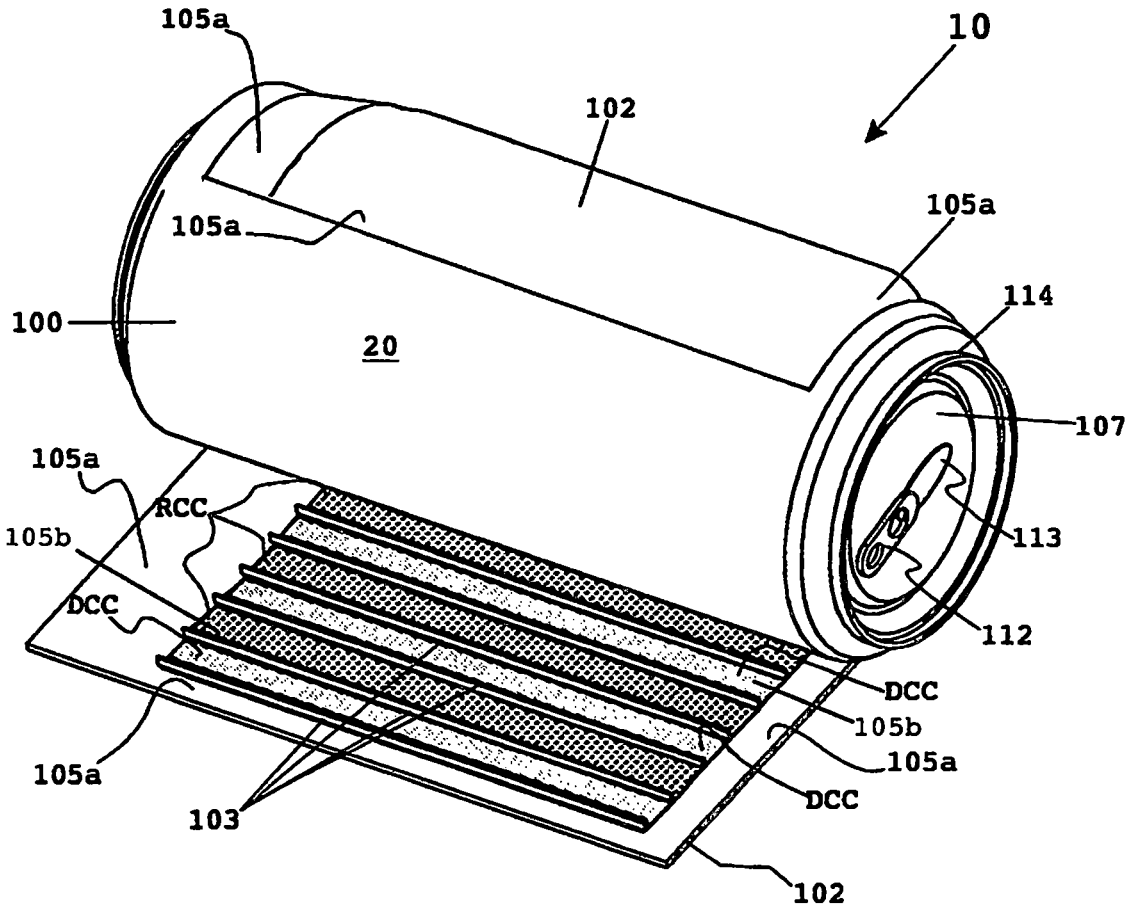
FIG. 23 shows the fourth embodiment of the invention with the distinct compartment forming sleeve in the form of a label on the food product container partially on the food product container wall and partially peeled off. The distinct compartment forming sleeve has protuberances that are linear ribs forming distinct compartments for storing chemical compounds around the food product container wall.
Figure 24:
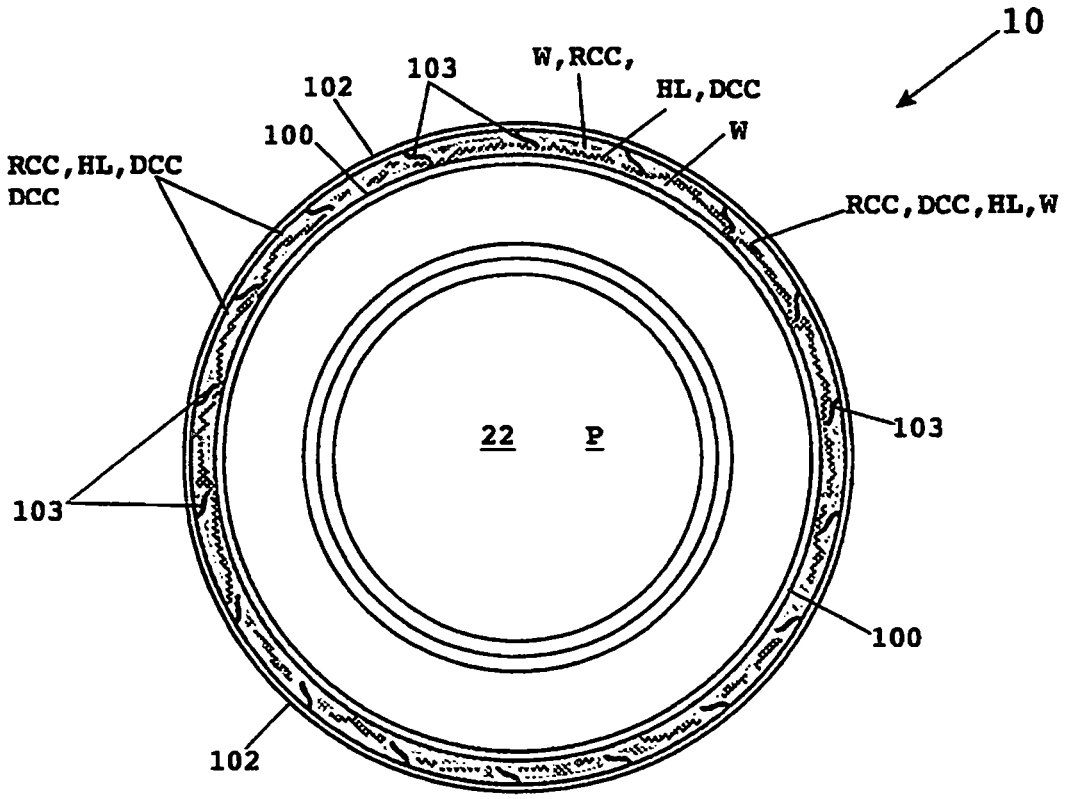
FIG. 24 shows a cross section of the apparatus according to the fourth embodiment of the invention with the distinct compartment forming sleeve in the form of cylindrical sleeve and the on the food product container. The distinct compartment forming sleeve has protuberances that are linear ribs forming distinct compartments for storing chemical compounds and they are shown to have been deformed to permit the reacting chemical compounds to react and mix and cool the food product container. The dissolving chemical compounds are also show in the mixture to permit them to dissolve and endothermically cool around the food product container wall.

As before, a food product container 20 is provided with a food product container side wall 100 and a food product container top wall 107 and opening means 112 with food product release means 113. Food product container side wall 100 has the compartment forming sleeve member 102 with a compartment forming sleeve member side wall 105 with inward facing protuberances 103 preferably on the inside surface as shown in FIG. 23 and FIG. 24. The inward facing protuberances 103 can be in the form of waves with inward facing protuberances 103 as before. Only the inward facing protuberances 103 are preferred in this embodiment, however one can still use the outward facing protuberating 104 for gripping. The inward facing protuberances 103 help to increase strength and permit a variety of distinct reacting chemical compounds RCC to be stored in distinct compartments **105*b* made between said inward facing protuberances 103 on the compartment forming sleeve member side wall 105. The compartment forming sleeve member 102 can be easily made with a single layer corrugated cardboard to form the distinct compartments 105*b* between said inward facing protuberances 103 and then laminated over with a plastic self-adhesive label to adhere to the food product container side wall 100. The corrugations can be made to mate with the food product container side wall 100 to form the distinct compartments 105*b*. It is anticipated that the compartment forming sleeve member 102 can be easily made with a rubber material whose elastic properties can advantageously form the distinct compartments 105*b*. A compartment forming sleeve sealing portion 105*a* is provided to form a seal with the food product container wall 100 and enclose the inward facing protuberances 103 to form the to humidification liquid chamber W against the food product container side wall 100. The inward facing protuberances 103 of the compartment forming sleeve member side wall 105 form distinct compartments 105*b* within the humidification liquid chamber W that can hold chemicals therein in distinct compartments 105*b*. The inward facing protuberances 103 as shown in FIG. 23 and FIG. 24 are but examples of the possible protuberances that can be made on the compartment forming sleeve member side wall 105. As before, the inward facing protuberances 103 contact and mate with the food product container side wall 100 to form the distinct compartments 105*b*** of the humidification liquid chamber W.

Each reacting chemical compound RCC is held exclusively in a distinct compartment **105*b*. The dissolving chemical compounds can also be added to be stored exclusively in distinct compartment 105***b*.

The compartment forming sleeve member 102 has a compartment forming sleeve member sealing portion 105*a* forms a fluid seal surrounding the inward facing protuberances 103 with a food product container side wall 100. When the compartment forming sleeve member sealing portion 105*a* is sealed against the surface of the food product container side wall 100, the closed space forms the humidification liquid chamber W which holds reacting chemical compounds RCC and dissolving chemical compounds DCC in between the distinct compartments 105*b* of the humidification liquid chamber W.

A cooling actuation means is provided by massaging the compartment forming sleeve member 102 with finger pressure F against the food product container side wall 100 to deform the inward facing protuberances 103 against the food product container side wall 100 to permit the reacting chemical compounds RCC to mix with each other and react and generate a first endothermic cooling of the food product P. Advantageously, a second endothermic cooling can be achieved if dissolving chemical compounds DCC are provided to mix and dissolve with reaction released humidification liquid HL from their reactions. The invention as stated in the opening paragraphs provided the following advantages:

d) A variety of distinct reacting chemical compounds RCC and dissolving chemical compounds DCC can be stored between any of inward facing protuberances 103 when they form distinct compartments 105*b* against the food product container side wall 100. Many species of distinct reacting chemical compounds RCC can be stored between the inward facing protuberances 103 when they form distinct compartments 105*b* against a food product container side wall 100. Thus pairs of endothermically reacting chemical compounds RCC of different species of reactants can be stored in said distinct compartments 105*b*. Further different species of dissolving chemical compounds DCC can also be stored in said distinct compartments 105*b*.

e) Further, humidification liquid HL created by the reacting chemical compounds RCC can be used to endothermically dissolve dissolving chemical compounds DCC to generate even more cooling.

f) deforming and either breaking bending the inward facing protuberances 103 by means of the massaging the compartment forming sleeve member 102 causes reacting chemical compounds RCC to react endothermically that are stored between separate distinct compartments 105*b* before they react can be made to react when the protuberances are deformed or broken to permit said reacting chemical compounds RCC to mix and react.

The compartment forming sleeve member 102 can also be made a cylindrical sleeve that wraps around the food product container side wall 100. In such a case, the compartment forming sleeve member sealing portion 105*a* is a barrier structure forming two circumferential sealing bands that enclose the humidification liquid chamber around the food product container side wall 100. The compartment forming sleeve member 102 can also be made from a rubbery and elastic material to make it pliable and to soft enough to be massaged by fingers to mix the said chemicals for cooling.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A self-cooling food product container apparatus, comprising:

a food product container with a food product container wall and a food product there in; a compartment forming sleeve member with a covering sleeve member side wall; a compartment forming sleeve member wall inward surface with at least one of deformable and breakable inward facing protuberances and deformable and breakable outward facing protuberances; said inward facing protuberances tangentially contacting said food product container wall to form a humidification liquid chamber with distinct compartments between said covering sleeve member side wall inward surface and said food product container wall; at least one pair of endothermically reacting chemical compounds that generates a humidification liquid by their reaction and each one of said pair of endothermically reacting chemical compounds being stored exclusively in separate said distinct compartments; at least one endothermically dissolving chemical compound that dissolves in said humidification liquid stored exclusively in at least one said distinct compartment;

a barrier structure surrounding said humidification liquid chamber separating said humidification liquid from the atmosphere;

and a humidification liquid release mechanism comprising said compartment forming sleeve member wall and said one of deformable and breakable inward facing protuberances and outward facing protuberances against said food product container wall to deform said inward facing protuberances and mix said reacting chemical compounds to react endothermically and cool said food product container wall and generate humidification liquid by their reactions and said at least one endothermically dissolving chemical compound for dissolving endothermically in said humidification liquid to further cool said food product container wall and thereby cool said product.

2. The apparatus of claim 1, wherein said compartment forming sleeve member is made from one of a plastic material and a rubber material and corrugated cardboard.

3. The apparatus of claim 1, wherein said barrier structure comprises one of a glue bond and an ultrasonic weld between said compartment forming sleeve member wall inward surface and said food product container wall.

4. The apparatus of claim 1, wherein said compartment forming sleeve member is cylindrical.

5. The apparatus of claim 1, wherein said compartment forming sleeve member is rectanguloid.

6. The apparatus of claim 1, wherein said pair of reacting chemical compounds comprises one of the following pairs: $Ba(OH)\cdot 8H_2O(s)$ and $NH_4SCN(s)$, $Ba(OH)_2\cdot 8H_2O(s)$ and $NH_4Cl(s)$, $Ba(OH)_2\cdot 8H_2O(s)$ and $NH_4NO_3(s)$, $NH_4NO_3(s)$ and $CaCl_2$).

7. A self-cooling food product container apparatus, comprising:

a food product container having a container side wall and a container top wall and a container bottom wall;

a collapsible covering sleeve member having a perimeter surrounding and spaced outwardly from said container side wall, such that an annular space is defined between said container side wall and said collapsible covering sleeve member;

a covering sleeve member restriction portion extending circumferentially around said container side wall and extending between and in sealing relation with each of said container side wall and said covering sleeve member, defining a dry gas chamber between said covering sleeve member restriction portion and said container side wall, said dry gas chamber containing a quantity of endothermically reacting chemical compound and a quantity of dry gas at a pressure below the ambient atmospheric pressure surrounding said apparatus;

a humidification liquid chamber containing a quantity of a humidification liquid comprising water, wherein said covering sleeve member restriction portion functions as a barrier structure separating said humidification liquid chamber and said dry gas chamber;

wherein said covering sleeve member restriction portion acting as a humidification liquid release mechanism for opening fluid communication between said humidification liquid chamber and said dry gas chamber at said barrier structure;

such that, upon opening said food product container, the difference in pressure between the dry gas and the surrounding ambient atmospheric pressure causes the portion of said covering sleeve member restriction portion to collapse and drive at least part of said humidification liquid out of said humidification liquid chamber and into said dry gas chamber, where said humidification liquid evaporates and thereby draws heat from said container, cooling the food product within said container.

8. The apparatus of claim 7, wherein said dry gas chamber contains at least a pair of endothermically reacting chemical compounds and at least one endothermically dissolving chemical compound.

9. The apparatus of claim 8, additionally comprising a compartment forming sleeve member contained within said dry gas chamber.

10. The apparatus of claim 9, wherein said compartment forming sleeve member is configured as an undulating sheet having a first compartment forming sleeve member side and a second compartment forming sleeve member side and retains the endothermically reacting chemical compound seated within undulations on said first compartment forming sleeve member side.

11. The apparatus of claim 7, wherein at least the portion of said container side wall abutting said covering sleeve member restriction portion said dry gas; and wherein said covering sleeve member restriction portion is manually flexible and wherein said humidification liquid release mechanism comprises the flexible at least a portion of said container side wall, which can be flexed to break the seal and release said humidification liquid into said dry gas chamber.

12. The apparatus of claim 7, wherein said covering sleeve member restriction portion comprises a sealing ring structure extending circumferentially around said container side wall.

13. The apparatus of claim 7, wherein said humidification liquid sealing structure comprises a portion of said covering sleeve member extending over and around said container bottom wall and sealingly closing the lower end of said covering sleeve member.

* * * * *